US011745457B2

(12) United States Patent
Langen

(10) Patent No.: US 11,745,457 B2
(45) Date of Patent: Sep. 5, 2023

(54) METHOD AND APPARATUS FOR FORMING CONTAINERS

(71) Applicant: LANCAN SYSTEMS INC., Brampton (CA)

(72) Inventor: H. J. Paul Langen, Brampton (CA)

(73) Assignee: LANCAN SYSTEMS INC., Brampton (CA)

( * ) Notice: Subject to any disclaimer, the term of this patent is extended or adjusted under 35 U.S.C. 154(b) by 241 days.

(21) Appl. No.: 15/612,858

(22) Filed: Jun. 2, 2017

(65) Prior Publication Data

US 2017/0348939 A1 Dec. 7, 2017

Related U.S. Application Data

(60) Provisional application No. 62/345,628, filed on Jun. 3, 2016.

(51) Int. Cl.
*B31B 50/60* (2017.01)
*B31B 50/52* (2017.01)
(Continued)

(52) U.S. Cl.
CPC ..... *B31B 50/60* (2017.08); *B31B 50/26* (2017.08); *B31B 50/28* (2017.08); *B31B 50/52* (2017.08);
(Continued)

(58) Field of Classification Search
CPC ..... B31B 50/60; B31B 50/26; B31B 50/28; B31B 50/52; B31B 50/24; B31B 50/624;
(Continued)

(56) References Cited

U.S. PATENT DOCUMENTS 1,359,772 A 11/1920 Weckbaugh
2,942,530 A 6/1960 Bodendoerfer
(Continued)

FOREIGN PATENT DOCUMENTS

CA 2347777 C 7/2009
CA 2885801 A1 4/2014
(Continued)

OTHER PUBLICATIONS

International Search Report issued by the Canadian Intellectual Property Office dated Feb. 8, 2019 in connection with International Patent Application No. PCT/CA2018/051525, 5 pages.
(Continued)

*Primary Examiner* — Valentin Neacsu
*Assistant Examiner* — Mary C Hibbert-Copeland

(57) ABSTRACT

A system and method are disclosed for forming a container from a generally flat re-configurable blank. A first portion of an outward facing surface of a blank support device is positioned proximate a first portion of a blank while the blank is in a first orientation. While the first portion of the blank is maintained in the first orientation, a second portion of said blank is rotated from the first orientation, around a second portion of the outward facing surface of the blank support device to form a blank that has a generally tubular configuration. The system and method may provide that during the rotating of said second portion of said blank, the blank is engaged on a surface side which forms an inner surface of the generally tubular configuration. Also disclosed is a system and method that includes retaining a reconfigurable blank in a holding apparatus; applying adhesive to a surface of the blank while said blank is retained in the holding apparatus.

30 Claims, 34 Drawing Sheets

(51) Int. Cl.

| | |
|---|---|
| ***B31B 50/28*** | (2017.01) |
| ***B65B 5/02*** | (2006.01) |
| ***B65B 41/06*** | (2006.01) |
| ***B65B 43/30*** | (2006.01) |
| ***B31B 50/26*** | (2017.01) |
| ***B65B 43/10*** | (2006.01) |
| ***B65B 43/14*** | (2006.01) |
| *B31B 50/00* | (2017.01) |
| *B31B 110/35* | (2017.01) |
| *B31B 50/62* | (2017.01) |
| *B31B 50/04* | (2017.01) |
| *B31B 100/00* | (2017.01) |
| *B31B 105/00* | (2017.01) |
| *B65D 5/02* | (2006.01) |

(52) U.S. Cl.
CPC ..... *B65B 5/024* (2013.01); *B65B 41/06* (2013.01); *B65B 43/10* (2013.01); *B65B 43/145* (2013.01); *B65B 43/305* (2013.01); *B31B 50/006* (2017.08); *B31B 50/042* (2017.08); *B31B 50/282* (2017.08); *B31B 50/624* (2017.08); *B31B 2100/002* (2017.08); *B31B 2100/0026* (2017.08); *B31B 2105/002* (2017.08); *B31B 2110/35* (2017.08); *B65D 5/0227* (2013.01)

(58) Field of Classification Search
CPC ... B31B 50/006; B31B 50/282; B31B 50/042; B65B 43/10; B65B 43/145; B65B 43/305; B65B 41/06
USPC ..... 493/175
See application file for complete search history.

(56) References Cited

U.S. PATENT DOCUMENTS

| | | | | |
|---|---|---|---|---|
| 3,134,307 | A | 5/1964 | Loeser | |
| 3,556,887 | A | 1/1971 | Adcock et al. | |
| 3,837,961 | A | 9/1974 | Vouillemin | |
| 3,990,210 | A | 11/1976 | McDonough et al. | |
| 4,060,443 | A | 11/1977 | Balla | |
| 4,194,440 | A | 3/1980 | Gorig | |
| 4,349,400 | A | 9/1982 | Gilden | |
| 4,452,596 | A | 6/1984 | Clauss et al. | |
| 4,490,130 | A | 12/1984 | Konzal et al. | |
| 4,637,199 | A | 1/1987 | Steck et al. | |
| 5,120,292 | A | 6/1992 | Ueda et al. | |
| 5,324,249 | A | 6/1994 | Konzal | |
| 5,393,291 | A | 2/1995 | Wingerter | |
| 5,772,568 | A | 6/1998 | Chen | |
| 5,889,263 | A | 3/1999 | Andersson | |
| 5,992,489 | A | 11/1999 | Busse | |
| 6,872,459 | B1 | 3/2005 | Frisk et al. | |
| 6,913,568 | B2 | 7/2005 | Frank et al. | |
| 7,425,246 | B2 | 9/2008 | Urscheler | |
| 10,035,321 | B2 | 7/2018 | Stahlecker et al. | |
| 2001/0002677 | A1 | 6/2001 | Grabber | |
| 2006/0124719 | A1 | 6/2006 | Mannlein | |
| 2009/0298662 | A1 | 12/2009 | Maatta et al. | |
| 2010/0012712 | A1 | 1/2010 | Swoboda et al. | |
| 2010/0044423 | A1* | 2/2010 | Graham | B65D 5/445 414/222.01 |
| 2010/0263333 | A1* | 10/2010 | Langen | B65D 5/42 53/456 |
| 2014/0150965 | A1 | 6/2014 | Larsson | |
| 2014/0215973 | A1 | 8/2014 | Hagelqvist et al. | |
| 2014/0287901 | A1 | 9/2014 | Hagelqvist | |
| 2015/0031517 | A1* | 1/2015 | Cavazza | B65B 43/185 493/124 |
| 2015/0329267 | A1 | 11/2015 | Holka et al. | |
| 2015/0367589 | A1* | 12/2015 | Graham | B31B 50/00 493/141 |
| 2018/0215497 | A1 | 8/2018 | Messerschmid | |
| 2018/0370666 | A1 | 12/2018 | Garza et al. | |

FOREIGN PATENT DOCUMENTS

| | | | |
|---|---|---|---|
| CA | 2765489 | C | 11/2017 |
| EP | 0074343 | B1 | 9/1986 |
| EP | 0541233 | A1 | 5/1993 |
| EP | 2527265 | A1 | 11/2012 |
| EP | 2049325 | B1 | 12/2012 |
| EP | 2608955 | B1 | 1/2017 |
| WO | 00/32482 | A1 | 6/2000 |

OTHER PUBLICATIONS

Written Opinion of the International Searching Authority issued by the Canadian Intellectual Property Office dated Feb. 8, 2019 in connection with International Patent Application No. PCT/CA2018/051525, 7 pages.

Kit L. Yam, The Wiley Encyclopedia of Packaging Technology, 3rd Edition, United States: John Wiley & Sons, Inc., Sep. 1, 2009, pp. 181-189, online: https://onlinelibrary.wiley.com/doi/pdf/10.1002/9780470541395.ch3.

Non-Final Office Action dated Mar. 16, 2022, mailed in the related U.S. Appl. No. 16/853,471.

* cited by examiner

METHOD AND APPARATUS FOR FORMING CONTAINERS

CROSS-REFERENCE TO RELATED APPLICATION

This application claims the benefit of U.S. Provisional Patent Application Ser. No. 62/345,628 filed on Jun. 3, 2016. The contents of the aforementioned application are incorporated by reference herein.

FIELD OF THE INVENTION

The present invention relates generally to methods and systems for forming containers, including cases.

BACKGROUND OF THE INVENTION

Containers are used to package many different kinds of items. One form of container used in the packaging industry is a carton. Cartons come in many different configurations and are made from a wide variety of materials. A related type of container used in the packaging industry is referred to as a case and is typically used for shipping items/products or cartons containing items/products. In the present document, the term "case" is used to refer to cartons, boxes, cases and other similar types of containers.

Cases come in many different configurations and are made from a wide variety of materials. Many cases are foldable and are formed from a flattened piece of material of a specific configuration (commonly called a case blank). Cases may be made from an assortment of foldable materials, including cardboard, paperboard, plastic materials, composite materials, and the like and possibly even combinations thereof.

In some known systems, partially formed tubular case blanks may be serially retrieved from a magazine, opened up from a flattened state into an erected state, and placed in a slot on a conveyor. The erected carton may then be moved by the conveyor to a loading station where the case may be filled with one or more items.

To permit the cases to be readily opened up into an erected state from a flattened state, the blanks may be held in the magazine in a partially folded configuration and be partially glued along at least one side seam to form a tubular configuration. Accordingly, each case may only require opposite panels to be pulled apart to provide a tubular shape that is suitable for delivery to a case conveyor. The case can then be moved by the case conveyor to be filled from a side while on the case conveyor and any required additional panel folding and gluing can be carried out to enclose and fully seal the case with one or more items/cartons contained therein.

However, such pre-folded and pre-glued blanks are not well adapted to shipping in bulk due to their asymmetric shape—being three layers thick on the glued seam area and two layers thick elsewhere. Unstable stacking characteristics of such blanks typically require the use of secondary containers and also reduce the number of blanks that can be shipped per unit volume. Both of these factors result in increased shipping costs compared to blanks that can be shipped to a case-filler in a completely flat arrangement. Additionally, some types of items/cartons do not lend themselves particularly well to being side-loaded into a case; rather such products/items/cases are more readily loaded into the top of an open-top carton. It can also be advantageous in some situations to be able to load some products through a relatively large opening, compared to smaller opening in a side-loaded carton.

Some other case forming systems are adapted to forming a case that can be top-loaded. In some known systems, a magazine may hold a number of blanks that are completely unfolded and unglued and which lie completely flat in a stack in the magazine. However, currently quite complicated systems are required in order to fold, configure and glue the case so that it is suitable to receive one or more items.

In the formation of cases from corrugated fibreboard material, it is also typically necessary as part of the forming process to fold over various parts of a blank made from a corrugated fibreboard material. However, current folding processes and machines are relatively complex.

One particular type of case that is in widespread use in packaging a wide variety of items/cartons is a case made from a corrugated material, such as corrugated fibreboard. The use of corrugated fibreboard generally enhances the strength of the case. Of those cases made from corrugated fibreboard, a common type is known as "Regular Slotted Container" case or "RSC" case and it is particularly well suited for packaging many types of items such as by way of example only, glass and plastic bottles, packaged goods, or other smaller cases/cartons.

Typically, an RSC blank is formed as a flat sheet of material, but usually is folded over and sealed down one seam with an adhesive to form a tubular shaped blank (often called a "knock down" RSC blank). After the knock down RSC blanks have been created, they are typically grouped with other RSCs and shipped to the facility of the customer where the knock-down RSCs are to be erected and filled/packed.

However, having to ship knock down RSCs from a location where they are formed to another location where they are erected has drawbacks, as referenced above.

Accordingly, an improved forming method and system is desirable which may permit a generally flat, unglued blank to be readily formed into a container such as a case, including for example an RSC case. This may for example, enable flat blanks to be formed into open top cases at the same location where they are filled with products/items/cases and then top-sealed. Also, an improved method and system of forming cases is desirable which can be rapidly and/or easily modified to accommodate cases of different sizes.

SUMMARY OF THE INVENTION

According to one aspect of the invention there is provided a a method for forming a container from a generally flat re-configurable blank. The method includes supporting a reconfigurable blank in a first orientation, positioning a first portion of an outward facing surface of a blank support device proximate a first portion of the blank while the blank is in said first orientation. While the first portion of the blank is in the first orientation, rotating a second portion of the blank from the first orientation, around a second portion of the outward facing surface of the blank support device to form a blank that has a second generally tubular configuration around the outward facing surface of the blank support device.

In another embodiment there is provided a method for forming a container from a generally flat foldable blank. The method includes holding a first portion of a reconfigurable blank in a fixed position relative to a first portion of an outward facing surface of a blank support device. While the first portion of the blank is in a fixed position relative to the first portion of the outward facing surface of the blank support device, rotating a second portion of the blank with a panel rotating apparatus around a second portion of the outward facing surface of the blank support device to form a blank that has a second generally tubular configuration, and wherein during the rotating of the second portion of the blank, the blank is held by the panel rotating apparatus at a surface side which forms an inwardly directed surface of the blank when the blank in formed into the second generally tubular configuration.

In another embodiment there is provided a method for forming a container from a reconfigurable blank. The method includes retaining a reconfigurable blank in a holding apparatus and applying adhesive to a surface of the blank while the blank is retained in the holding apparatus.

In another embodiment there is provided a system for forming a container from a re-configurable blank. The system includes a blank support device having an outward facing surface, the blank support device being positioned such that in operation a first portion of the outward facing surface of the blank support device is located proximate a first portion of the blank while the blank is in the first orientation. The system may include a rotating apparatus operable such that while the first portion of the blank is in the first orientation, the rotating apparatus is operable to rotate a second portion of the blank from the first orientation, around a second portion of the outward facing surface of the blank support device to form a blank that has a second generally tubular configuration around the outward surface of the blank support device.

In another embodiment there is provided a system for forming a container from a generally flat reconfigurable blank. The system includes a holding apparatus operable to hold a reconfigurable blank and an adhesive applicator operable to apply adhesive to a surface of the blank while the blank is held by the holding apparatus.

In another embodiment there is provided a system for forming a container from a generally flat foldable blank. The system includes a blank support device and a panel rotating apparatus. The blank support device having a wall with an outward facing surface, the wall having a recess configured to receive a portion of the panel rotating apparatus therein. The rotating apparatus operable to rotate at least a portion of the blank around the outward facing surface of the blank support device to form a blank that has a second generally tubular configuration around the outward surface of the blank support device. The rotating apparatus being operable such that when the rotating apparatus rotates the at least a portion of the blank around the outward facing surface of the blank support device, a portion of the rotating apparatus is received in the recess and the rotating apparatus is engaged with an inwardly directed surface of the blank in the generally tubular configuration.

In another embodiment there is provided a system for forming a container from a generally flat foldable blank. The system includes a blank support device having a first surface oriented generally at a first orientation, a second surface oriented at a second orientation that is at a first angle to the first orientation, and a third surface oriented at a second angle to the second orientation, wherein the blank has a first portion that is operable to be positioned proximate the first surface of the blank support device at the first orientation. The system may include a rotating sub-system operable to engage a second portion of the blank and rotate the second portion of the blank from the first orientation while the first portion is maintained in a position proximate the first surface of the blank support device to the second orientation such that the second portion is oriented in the second orientation that is generally at the angle to the first portion of the blank and with the second portion of the blank being positioned proximate the second surface of the blank support device. The system may also include a rotating sub-system operable to engage a third portion of the blank and rotate the third portion of the blank from the first orientation while the first portion is maintained in a position proximate the first surface of the blank support device to a third orientation, such that the third portion is oriented in a third orientation that is generally at the angle to the first portion of the carton blank and the third portion of the blank being positioned proximate the third surface of the blank support device. The system may further include a connection mechanism operable to fixedly connect the third portion of the blank and the second portion of the blank together to form a generally tubular shape blank around the blank support device, wherein in operation, the rotating sub-system rotates the second portion of the blank around the blank support device and the rotating sub-system rotates the third portion of the blank around the blank support device, and the connection mechanism fixedly connects the third portion and the second portion to form a tubular shaped blank.

In another embodiment there is provided a method for forming a container from a generally flat foldable blank. The method includes releasably holding a generally flat foldable blank having first, second and third portions all oriented at a first orientation, providing a mandrel having an outward facing surface, relatively positioning the first portion of the blank proximate to a first portion of surface of the mandrel, engaging second and third portions of the blank, and rotating the second and third portions of the blank from the first orientation while the first portion is maintained in a position proximate the first portion of the surface, around the mandrel into a position proximate to the surface of the mandrel, and fixedly connecting the third portion of the blank and the second portion of the blank together to form a tubular shape blank around the mandrel.

In another embodiment there is provided a method for forming a container from a generally flat foldable blank. The method includes releasably holding a generally flat foldable blank oriented at a first orientation in a holding apparatus and moving a blank support device having an outward facing surface to a folding station, and while moving the blank support device to the folding station, applying adhesive to a surface of the blank.

In another embodiment there is provided a system for forming a container from a re-configurable blank. The system includes a mandrel having an outward facing surface, the blank mandrel being positioned such that in operation a first portion of the outward facing surface of the mandrel is located and maintained proximate a first portion of the blank while the blank is in the first orientation and a rotating apparatus operable such that while the first portion of the blank is maintained in the first orientation, the rotating apparatus is operable to rotate a second portion of the blank from the first orientation, around a second portion of the outward facing surface of the mandrel to form a blank that has a second generally tubular configuration around the outward surface of the mandrel.

Other aspects and features of the present invention will become apparent to those of ordinary skill in the art upon review of the following description of specific embodiments of the invention in conjunction with the accompanying figures.

BRIEF DESCRIPTION OF THE DRAWINGS

In the figures which illustrate by way of example only, embodiments of the present invention.

DETAILED DESCRIPTION

Figure 1:
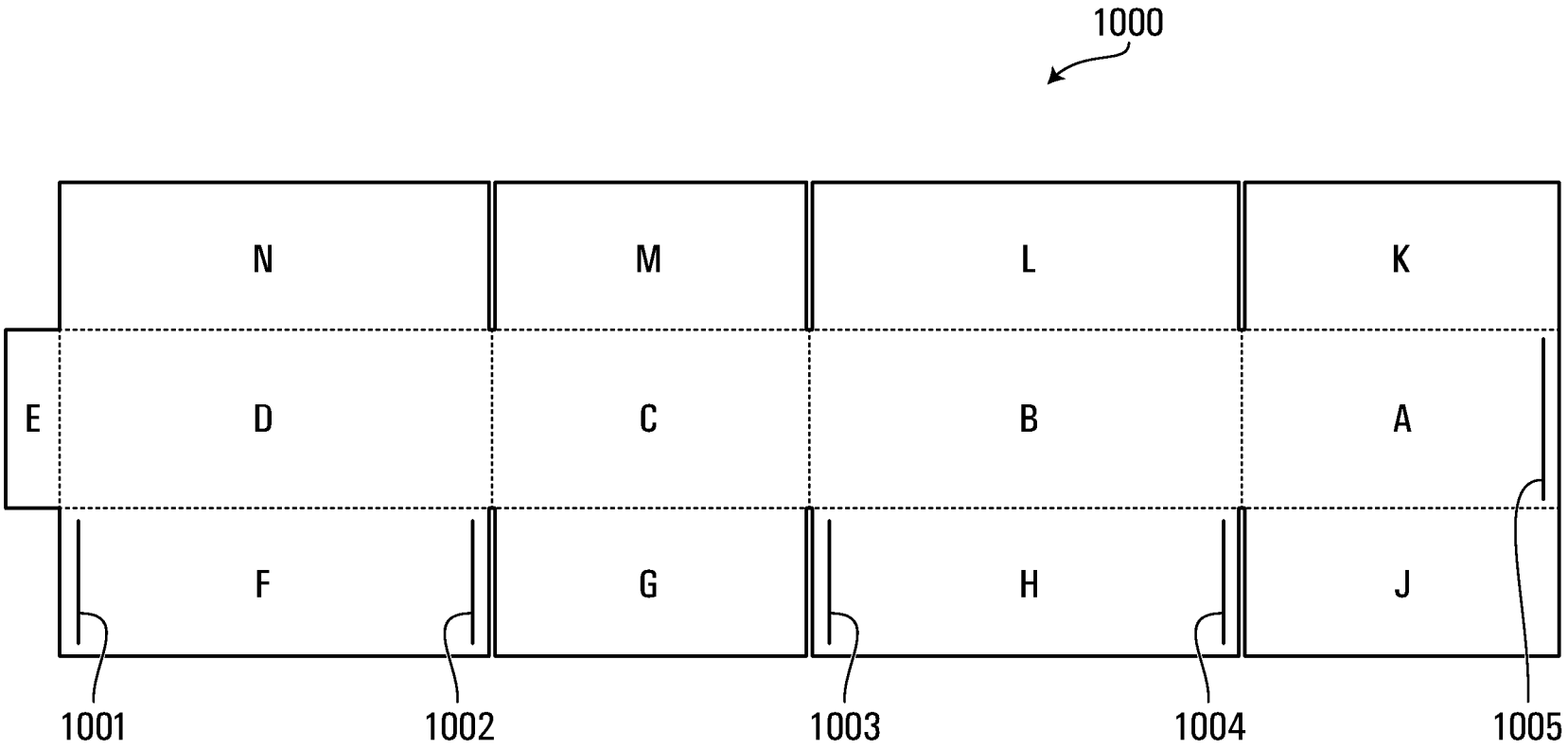
FIG. 1 is a top plan view of an example RSC blank.

With reference to FIG. 1, a flat case blank 1000, such as a case blank that is suitable to form an RSC case is shown. A case blank as contemplated herein may be made from a material and/or be formed in a way that is flexible so that it may be oriented and configured from a generally flat shape to a generally tubular shape positioned around the outer surface of a blank support device referred to herein as a blank support device, as will be described hereinafter. The case blank may thereafter be reconfigured to form a case with an opening to receive one or more items. For example a case blank 1000 may have minor side wall panels A and C and major side wall panels B and D. Minor side wall panel A may be located adjacent to and joined at a vertical side edge along a fold line (all fold lines shown in broken lines in FIG. 1) to a vertical side edge of major side wall panel B. Major side wall panel B may be located adjacent to and joined at an opposite vertical side edge along a fold line to a vertical side edge of minor side wall panel C. Minor side wall panel C may be located adjacent to and joined at an opposite vertical side edge along a fold line to a side edge of major side wall panel D. A side sealing panel E may also be provided adjacent and joined along a fold line to an opposite vertical side edge to major side wall panel D.

Case blank 1000 may also have lower minor panels J and G and lower major panels H and F, joined at transverse side edges along fold lines, to respective minor side wall panels A and C and major side wall panels B and D. Case blank 1000 may also have upper minor panels K and M and upper major panels L and N, joined at opposite transverse side edges along fold lines, to respective minor side wall panels A and C and major side wall panels B and D. However, in other embodiments, case blanks having other panel configurations can be formed into cases ready to be loaded using the methods and apparatuses disclosed hereinafter.

As indicated, the panels may be fixedly connected to and/or integrally formed with, adjacent panels by/along predetermined fold lines. These fold lines may be formed by a weakened area of material and/or the formation of a crease with a crease forming apparatus. The effect of the fold line is such that when one panel such as for example panel C is bent relative to an adjacent panel D, the panels C and D will tend to be pivoted relative to each other along the common fold line.

As will be described hereinafter, the major and minor side wall panels A, B, C and D, and the lower major and minor panels F, G, H and J, may be folded and sealed to form a desired open top case configuration that can be delivered to a case discharge conveyor. The sealing of specific panels together can in various embodiments be made with any suitable connection mechanism (such as for example with application of an adhesive or in some alternate embodiments, a mechanical connection such as for example is provided in so-called "click-lock" case blanks) so as to interconnect panel surfaces, to join or otherwise interconnect, panels to adjacent panels, to hold the case in its desired configuration.

Case blanks 1000 may be made of any suitable material(s) configured and adapted to permit the required folding/bending/displacement of the material to reach the desired configuration yet also meet the particular structural requirements for holding one or more items. Examples of suitable materials are cardboard or creased corrugated fiber board. It should be noted that the blank may be formed of a material which itself is rigid or semi-rigid, and not per se easily foldable but which is divided into separate panels separated by creases or hinge type mechanisms so that the carton can be formed.

Figure 2A:
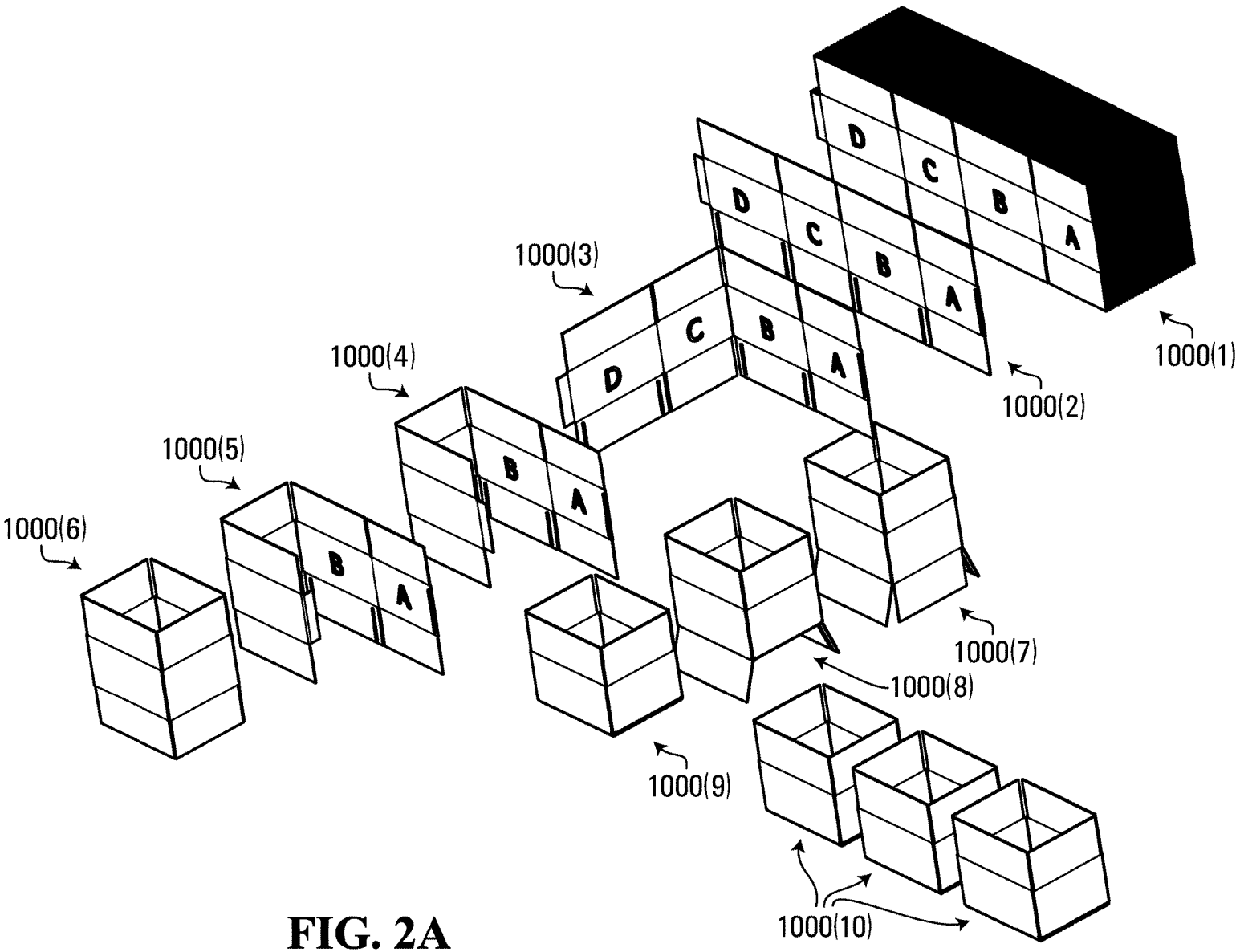
FIG. 2A is schematic view of an example method of forming a case from a case blank, such as the blank of FIG. 1.
Figure 2B:
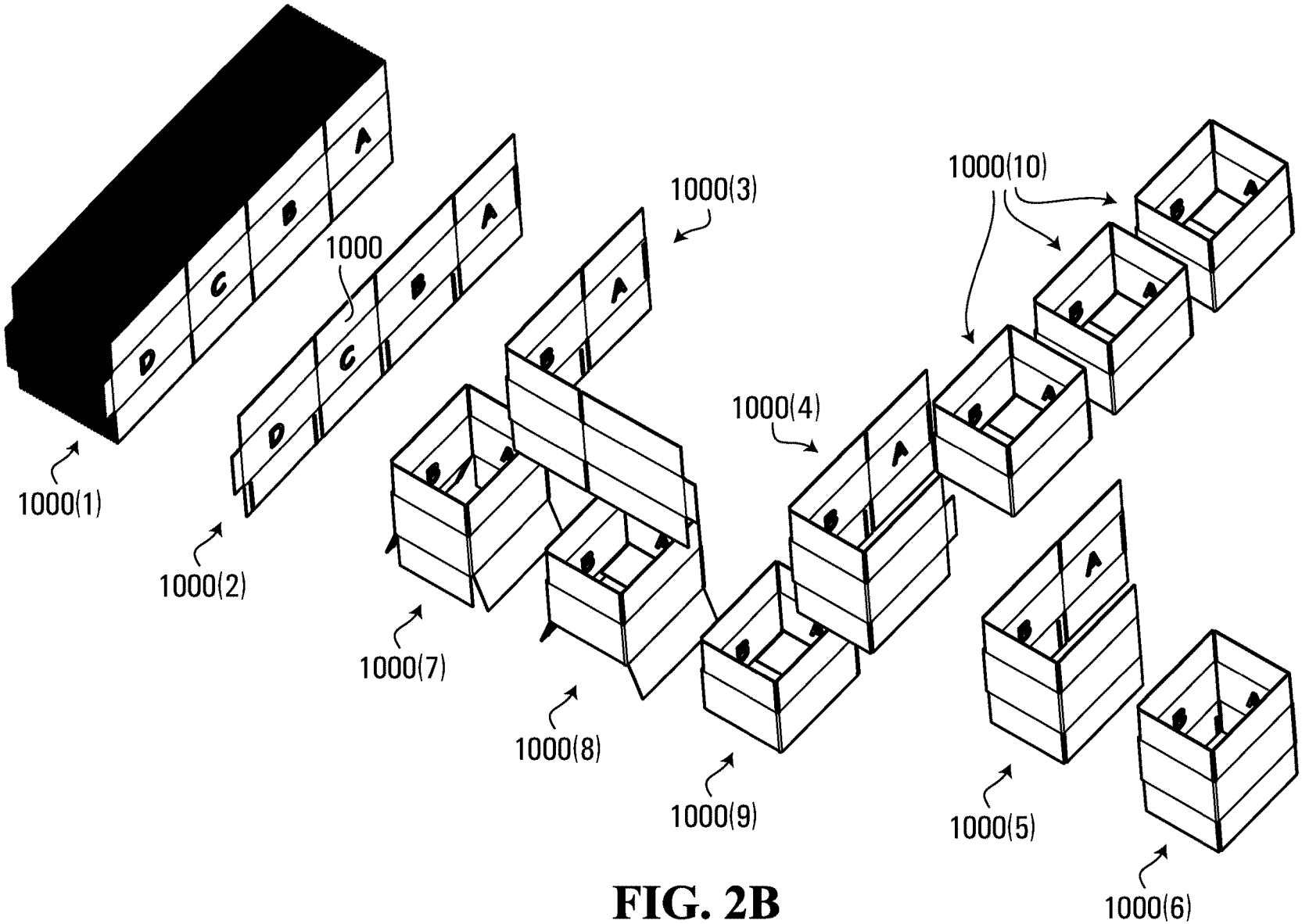
FIG. 2B is another schematic view of the method of FIG. 2A.

With reference now to FIGS. 2A and 2B, an example sequence of steps 1000(1) to 1000(10) are shown of folding and sealing a flat RSC blank 1000 to from an open top RSC case that is suitable for top loading of items/other cases.

A plurality of case blanks may be presented 1000(1) in a stacked arrangement with the blanks each configured in a generally flat and planar configuration. A particular individual case blank 1000 may be identified at/selected from the front of the stack of blanks for processing 1000(2). In a first folding step 1000(3) side wall panel C along with its respective adjacent upper and lower minor panels M and G along with major side wall panel D and its respective adjacent upper and lower major panels N and F, along with sealing panel E, can all be rotated together from the orientation shown at 1000(2), 90 degrees in a counter clockwise direction about the vertically oriented fold line between side wall panels B and C, to the configuration as shown at 1000(3). In the next folding step 1000(4), side wall panel D and its respective adjacent upper and lower major panels N and F, and sealing panel E, are all rotated together counter clockwise 90 degrees about the vertically oriented fold line between side wall panels D and C, to the configuration shown in FIGS. 2A and 2B at 1000(4).

In the next folding step 1000(5), sealing panel E is rotated counter clockwise 90 degrees about the vertically oriented fold line between sealing panel E and side wall panel D to the configuration shown at 1000(5). In the next folding step, minor side wall panel A and its respective adjacent upper and lower minor panels K and J, are all rotated together clockwise 90 degrees about the vertically oriented fold line between side wall panels A and B, to the configuration shown in FIGS. 2A and 2B at 1000(6), and wherein an upper surface of sealing panel E engages with part of the lower surface of side wall panel A. Adhesive or other connection mechanism may be provided, such as adhesive line 1005 (see FIG. 1), for example between opposing surfaces of sealing panel E and side wall panel A, such that sealing panel E may engage and become permanently connected to minor side wall panel A. The result at the end of this step, as depicted at 1000(6), case blank 1000 is formed into a generally rectangular shaped tube. While not shown in FIGS. 2A and 2B, folding steps from case blank orientations depicted at 1000(3) to 1000(6) may be carried out in such manner the panels are wrapped about a centrally positioned blank support device, as is described hereinafter.

The remaining steps to configurations shown from 1000 (7) to 1000(10) as illustrated in FIGS. 2A and 2B represent a sequence of steps that may be utilized to close and seal the lower major and minor panels, F, H and G, J respectively to close and seal the bottom of the case blank 1000 to form an RSC case with an open top.

In the next step, as depicted at 1000(7), the tubular shaped case blank 1000 may be moved vertically downwards to a second vertical location, at which the lower major panels F and H may be rotated outwards, about their respective horizontally oriented fold lines with respective major side panels D and B. The amount of rotation is sufficient to ensure that there will be no interference with the subsequent inward rotation of lower minor panels G and J and no contact is made with adhesive that may be on an inward surfaces of lower major panels F and H, such as respective adhesive lines 1001, 1002 and 1003, 1004 (FIG. 1). By way of example only, the amount of outward rotation of lower minor panels G and J from vertical planar alignment with their respective adjacent lower major side wall panels D and B may be about 45 degrees.

In the next step, as depicted at 1000(8), lower minor panels G and J are rotated inwardly, preferably about 90 degrees, about their respective horizontally oriented fold lines with respective major side wall panels C and A.

In the next step, as depicted at 1000(9), lower major panels F and H may be rotated inwards, about their respective horizontally oriented fold lines with respective major side panels D and B. The amount of rotation is sufficient to ensure that there will be contact between inner surfaces of lower major panels of lower major panels F and H and the outer surfaces of lower minor panels G and J.

Adhesive or other connection mechanism may be provided on the inner surfaces of lower major panels F and H so that these panels engage with, and become fixedly connected to the outward adjacent surfaces of lower minor panels G and J. For example, adhesive lines 1001, 1002, and 1003, 1004 (FIG. 1) may be on the inward surfaces of lower major panels F and H and may make contact with the outward surfaces of lower minor panels G and J and provide for a fixed connection.

The result at the end of step, as depicted at 1000(9), case blank 1000 is formed into a generally cuboid shaped, open top case.

In the final step, as depicted at 1000(10), case blank 1000 may be moved away to another location, and may be subsequently filled with one or more items/other cases and thereafter the upper major panels N and L, may be folded about 90 degrees along with upper minor panels M and K, to close and seal the completed case.

Figure 3:
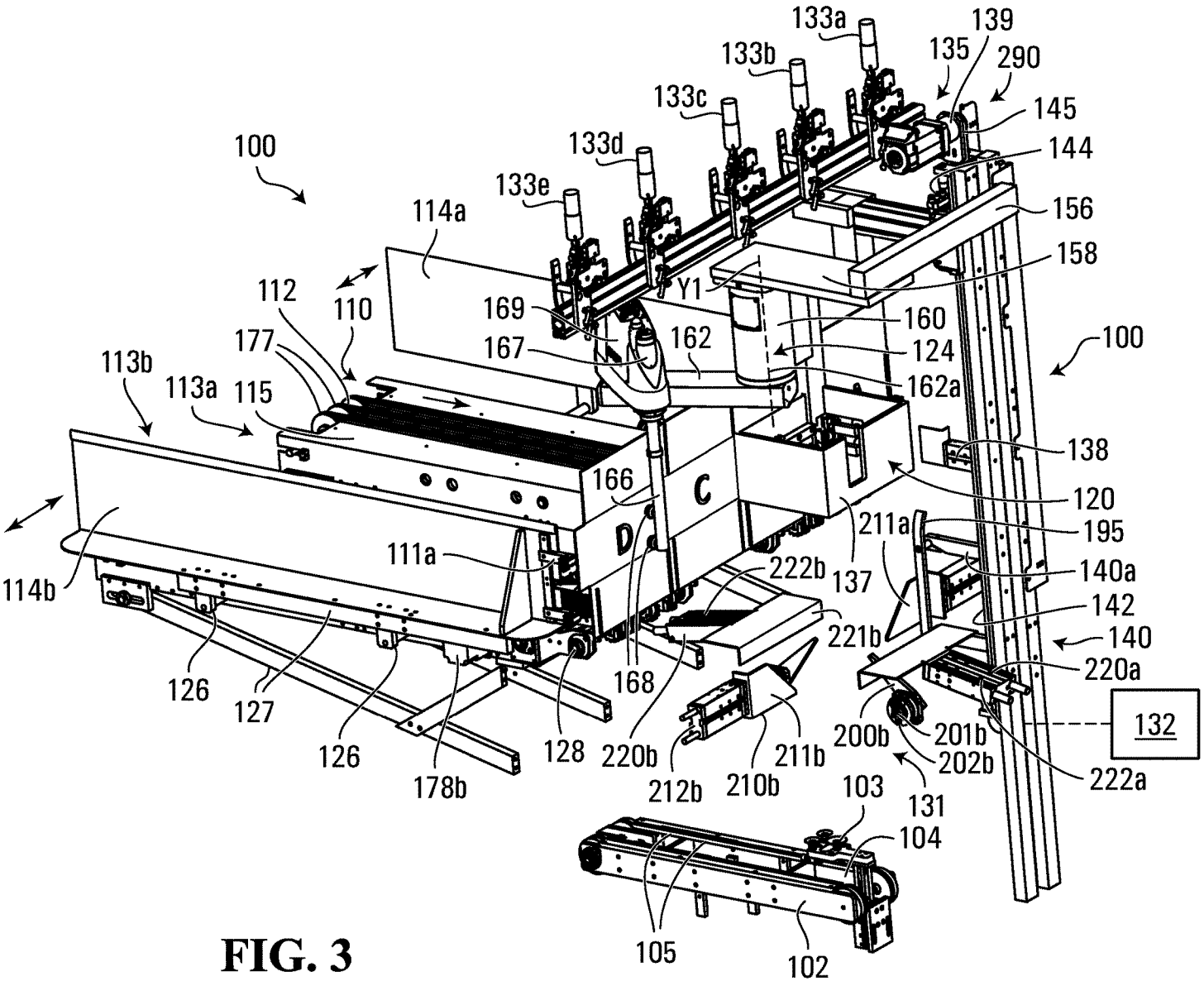
FIG. 3 is a is a top, left front perspective view of a case forming system in a first operational position.
Figure 4:
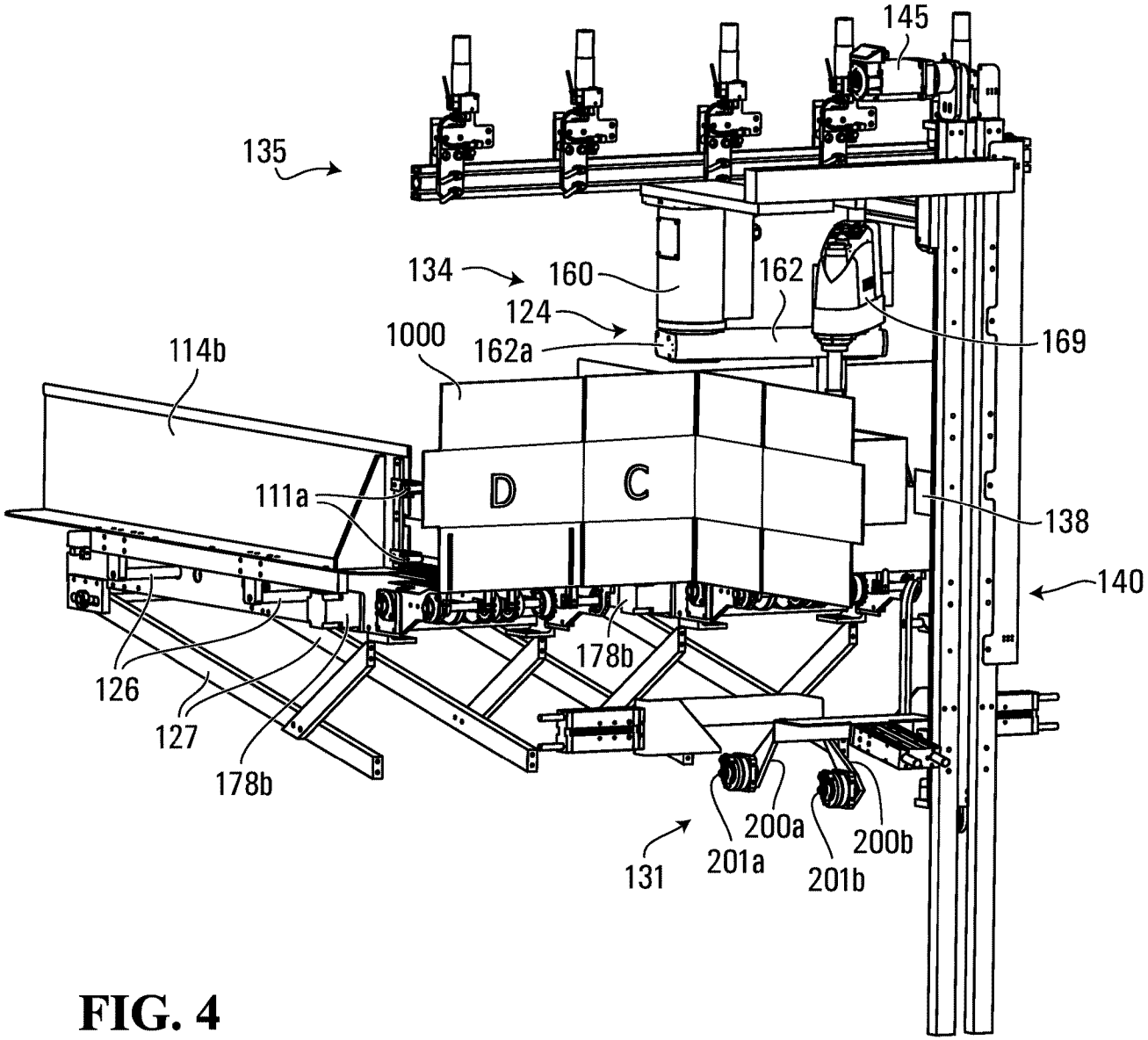
FIG. 4 is a lower, left front perspective view of the case forming system of FIG. 2, in a second operational position.
Figure 5:
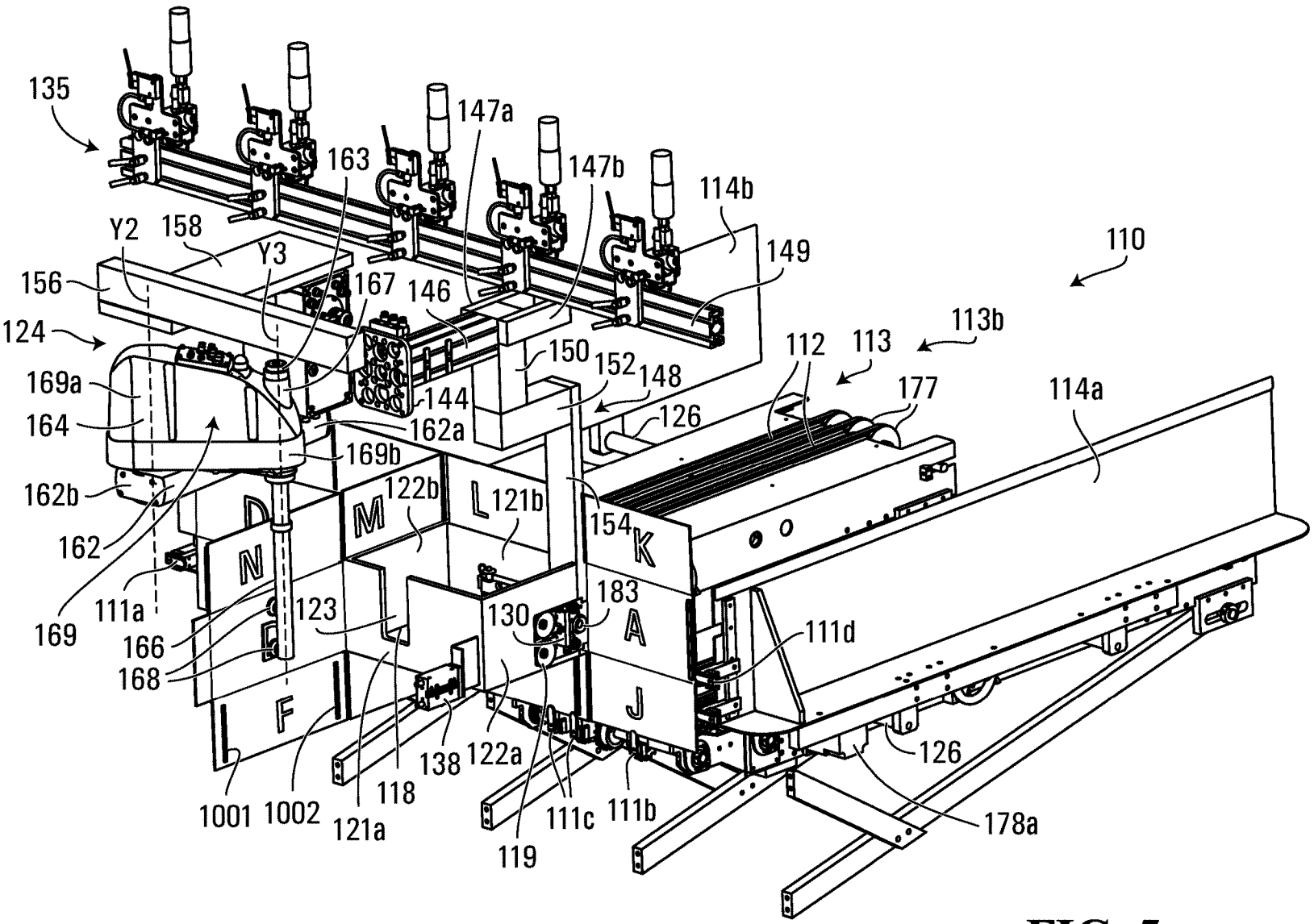
FIG. 5 is an upper, right front perspective view of the system of FIG. 2 in the second operational position of FIG. 4, but with some components omitted for simplicity.

With reference now to FIGS. 3-5, in overview, a case forming system 100 may include a magazine 110 adapted to hold a plurality of case blanks 1000 (only one or two case blanks 1000 are shown for clarity in FIGS. 3-5) in a substantially flat orientation such as is shown in FIGS. 2A and 2B. System 100 may also include a case blank support apparatus (also referred to herein as a mandrel apparatus) 120 and a panel rotating sub-system 134 (designated in FIG. 4). As will become evident from the description that follows, panel rotating sub-system 134 may be configured in some example embodiments of the system to engage a blank on an outward facing surface of the blank as the bank is held in the magazine 100 and rotate the blank 1000 around a case blank support device 137 of case blank support apparatus 120 in such a manner that the blank surface that is engaged becomes an inner surface of a tubular shaped and formed case blank.

Panel rotating sub-system 134 may utilize one or more panel rotating apparatuses in order to rotate one or more panels of a blank such as blank 1000 relative to each other. For example, panel rotating apparatus 134 may include a first panel rotating apparatus 124. Panel rotating sub-system may also include a second panel folding apparatus 130, and may also include a third panel rotating apparatus 131. Panel rotating sub-system 134 may also include a fourth panel rotating apparatus 138. Case forming system 100 may also include an adhesive applicator apparatus 135, a support frame 140 and a vertical mandrel movement apparatus 136 (designated generally in FIG. 8).

Figure 5A:
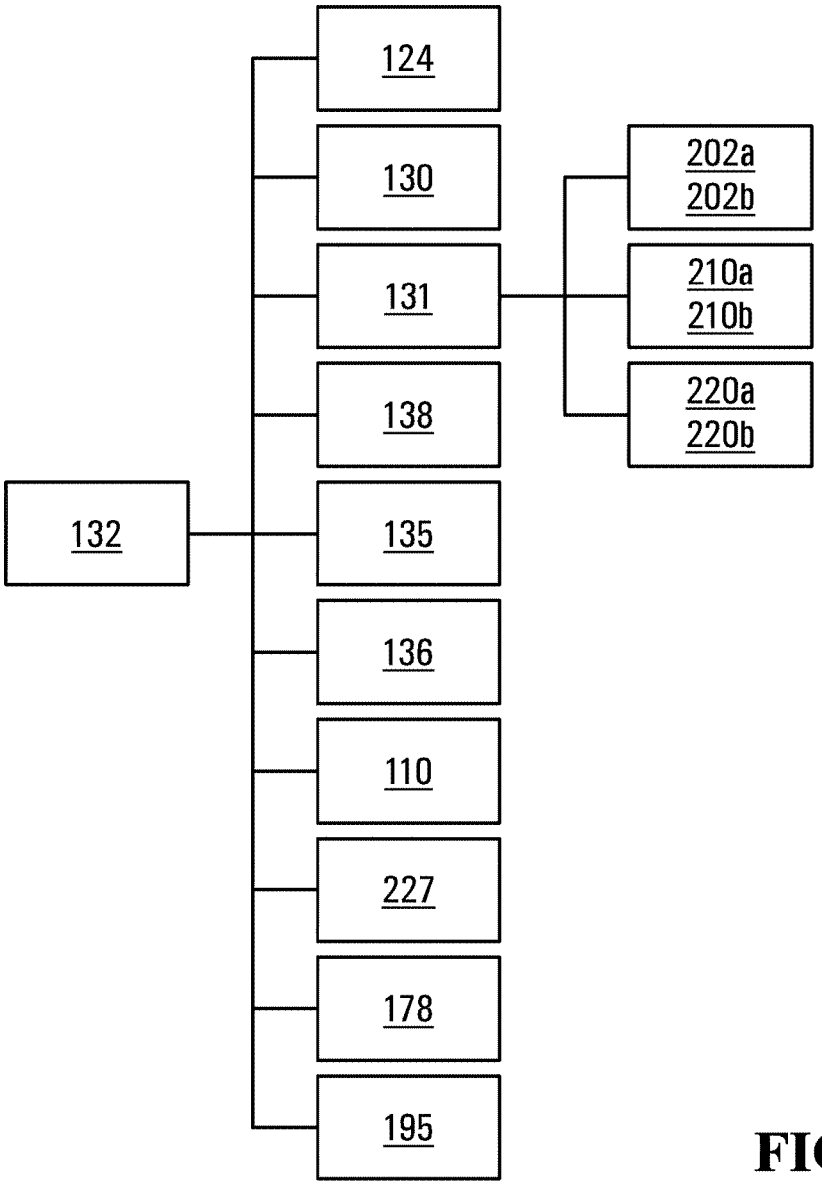
FIG. 5A is a schematic diagram of a control system for the system of FIG. 4.

The operation of the components of carton forming system 100 may be controlled by a controller such as a programmable logic controller ("PLC") 132 (such as for example as shown schematically in FIGS. 3 and 5A). PLC 132 may be in communication with and control all the components of system 100, in a manner such as is depicted schematically in FIG. 5A and may also control other components associated therewith such as conveyor 102. PLC 132 may for example be a model from the Compact Logix PLC family made by Allen-Bradley. Additionally PLC 132 may include a Human-Machine-Interface (HMI) such as the Allen Bradley Panelview 700 plus colour touch screen graphic workstation so that the operation of system 100 can be monitored, started, operated, controlled, stopped, modified for different mandrel/case blank configurations, by an operator using a touch screen panel.

A generally vertically oriented support frame 140 may support vertical blank support device apparatus (mandrel movement apparatus) 136 for vertical upward and downwards movement. It should be noted however, that while system 100 is generally oriented for vertical movement of the mandrel movement apparatus 136, other orientations can be utilized in other embodiments.

Mandrel movement apparatus 136 may include a generally vertically oriented linear rail 142 (FIG. 8) which may support for sliding upward and downward sliding vertical movement a carriage block 144 (FIG. 5). It should be noted that in FIGS. 5, 6 and 7, for simplicity, support frame 140 and linear rail 142 have been omitted. The movement of carriage block 144 on linear rail 142 may be driven by a drive belt (not shown) interconnected to carriage block 144 and supported by vertical support frame 140. The drive belt (not shown) may be interconnected to, and driven by, a servo drive motor 145, mounted at an upper end portion of vertical support frame 140. An encoder (not shown) may be associated with servo drive motor 145 and the encoder and servo drive motor 145 may be in communication with PLC 132. In this way, PLC 132 on receiving signals from the encoder may be able to monitor and control the vertical position of carriage block 144 (and the components interconnected thereto) by appropriately controlling and operating servo motor 145.

Figure 10:
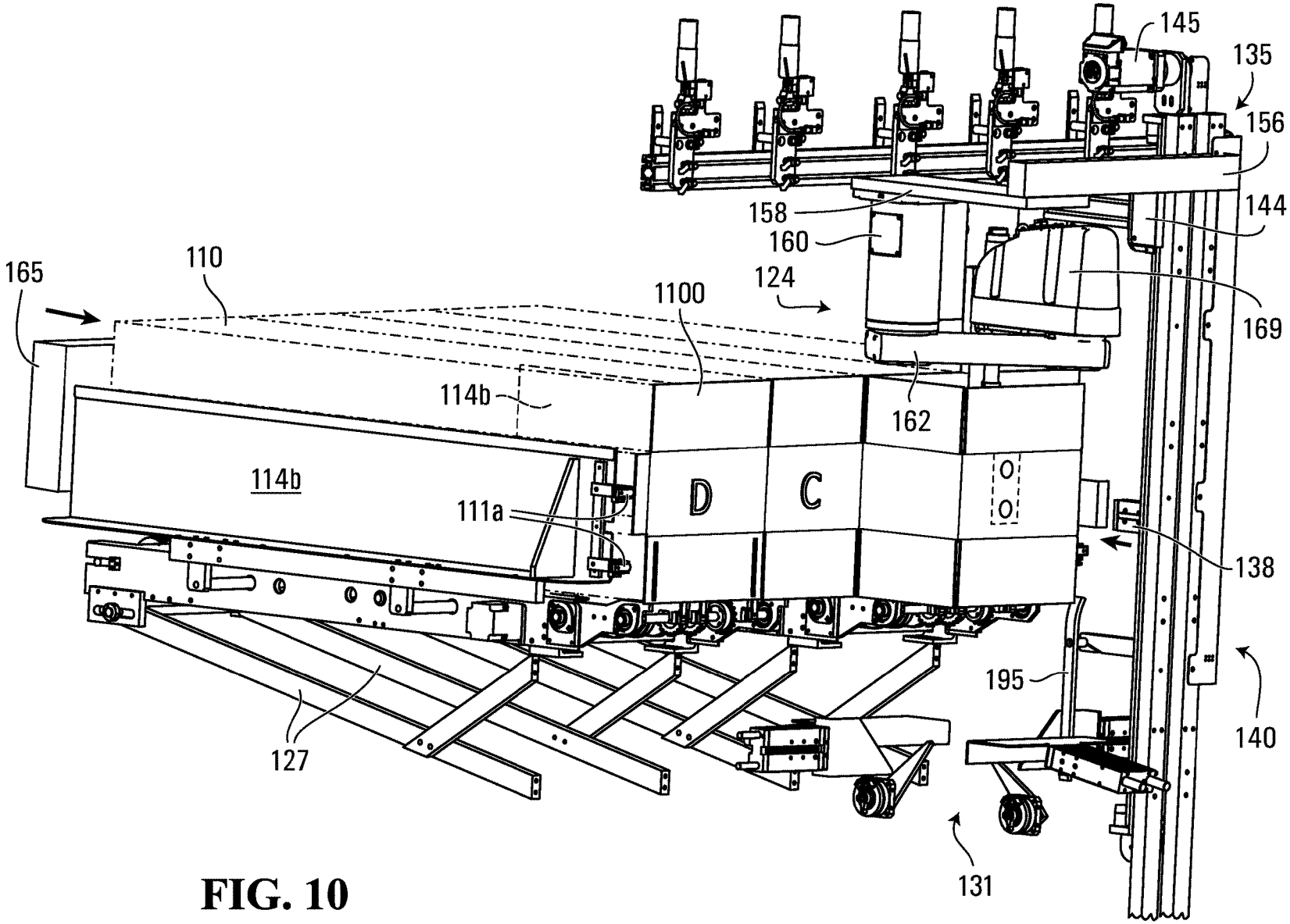
FIG. 10 is an upper, left front perspective view of the system of FIG. 2 in the fourth operational position.

Magazine 110 may be configured to hold a plurality of case blanks 1000 in a stacked, vertically and transversely oriented, flat configuration on their bottom edges (see FIG. 10). Many different types and/or constructions of a suitable magazine 110 might be employed in system 100. Magazine 100 may be configured to hold a plurality of case blanks 1000 that may be held in a longitudinally extending, stacked arrangement. Magazine 110 is adapted to present an outward facing surface of a plurality of case blanks 1000, individually in turn. Magazine 110 may comprise a large number of case blanks 1000 held in a generally vertically and transversely oriented, longitudinally extending, case blank stack by side walls 114*a*, 114*b* (FIG. 3). In this configuration where case blanks 1000 are individually and selectively retrieved in series from the front of a stack of generally flat blanks, the stack of case blanks 1000 in the magazine can be moved forward by longitudinally oriented conveyors 113*a*, 113*b* each having a first set of longitudinally oriented conveyor belts 112 driven by a motor which is also controlled by PLC 132. The purpose of moving the stack of blanks 1000 forward is so that the outward facing surface of major panel B, of the most forward case blank 1000 in the stack, is positioned and held close to or against an outer generally adjacent surface of the mandrel 137. This enables first panel rotating apparatus 124 (FIG. 3) and second panel rotating apparatus 130 (FIG. 5), to be able to engage the other exposed outward facing surfaces of panels of the forward most case blank 1000 in the stack held in magazine 110, as described further hereinafter. Additionally, a back pressure device 165 (only shown schematically in FIGS. 8 and 10) may be provided that can apply a back pressure against the case blank stack in a longitudinal direction toward the front of the magazine, of a magnitude and direction sufficient to keep the stack upright and prevent it from falling longitudinally backwards as the case blank stack on conveyors 113*a*, 113*b* is indexed longitudinally forward to maintain the next case blank 1100 at the front of the stack securely in a pick-up position.

Selected panels of the forward most blank may be pulled away from holding clips associated with magazine 110 by first panel rotating apparatus 124 and second panel rotating apparatus 130 from retention by magazine 110 then rotated (wrapped) around mandrel 137 of mandrel apparatus 120. As case blanks 1000 are taken from magazine 110 and formed, PLC 132 may cause the conveyor 112 of magazine 110 to move the entire stack forward sequentially so that the most forward case blank 1000 has its the outward facing surface of major panel B positioned against or very close to adjacent outer rear vertically and transversely oriented surface of mandrel 137. A sensor (not shown) in communication with PLC 132 may be provided to monitor the level of case blanks 1000 in magazine 110 during operation of case forming system 110. Magazine 110 can be loaded with additional flat case blanks 1000 at the rear of the magazine.

Magazine 110 may have a magazine frame generally designated 127. Magazine 110 may include a conveyor system to move flat case blanks sequentially to a pick-up position. A wide variety of conveyor systems or other case blank movement systems may be employed. By way of example, conveyor system may include a pair of spaced conveyors 113*a*, 113*b* mounted to frame 127, each conveyor 113*a*, 113*b* having a generally horizontal floor plate 115. Conveyors 113*a*, 113*b*, may be longitudinally spaced from each other, and be oriented generally longitudinally, and generally parallel to each other. Each conveyor 113*a*, 113*b*, may be operated to move longitudinally together to move case blanks 1100 in a stack of blanks forward in the magazine, while being maintained in a generally transverse and vertical orientation.

Figure 8:
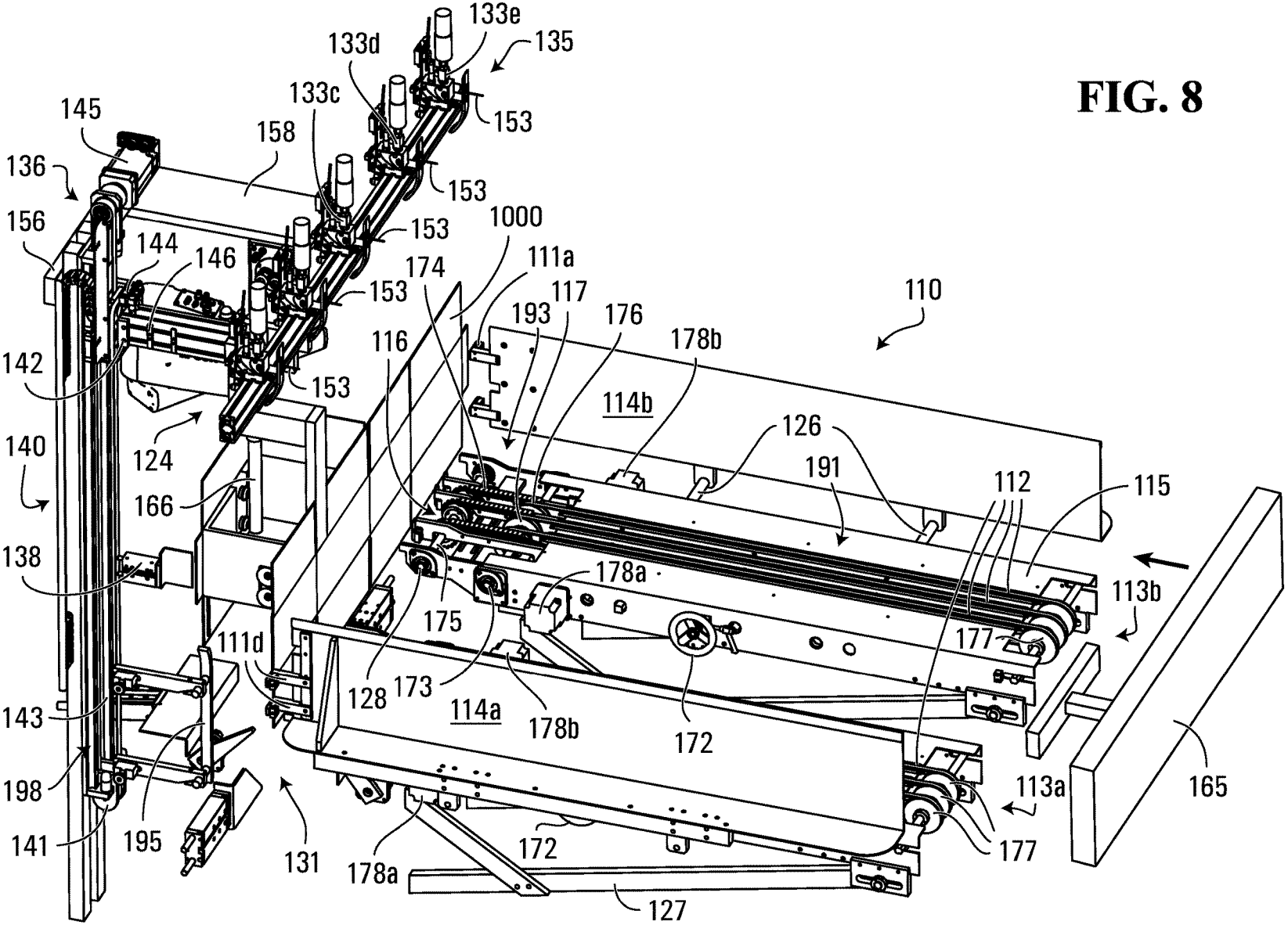
FIG. 8 is an upper, right rear perspective view of the system of FIG. 2 in the third operational position.
Figure 19:
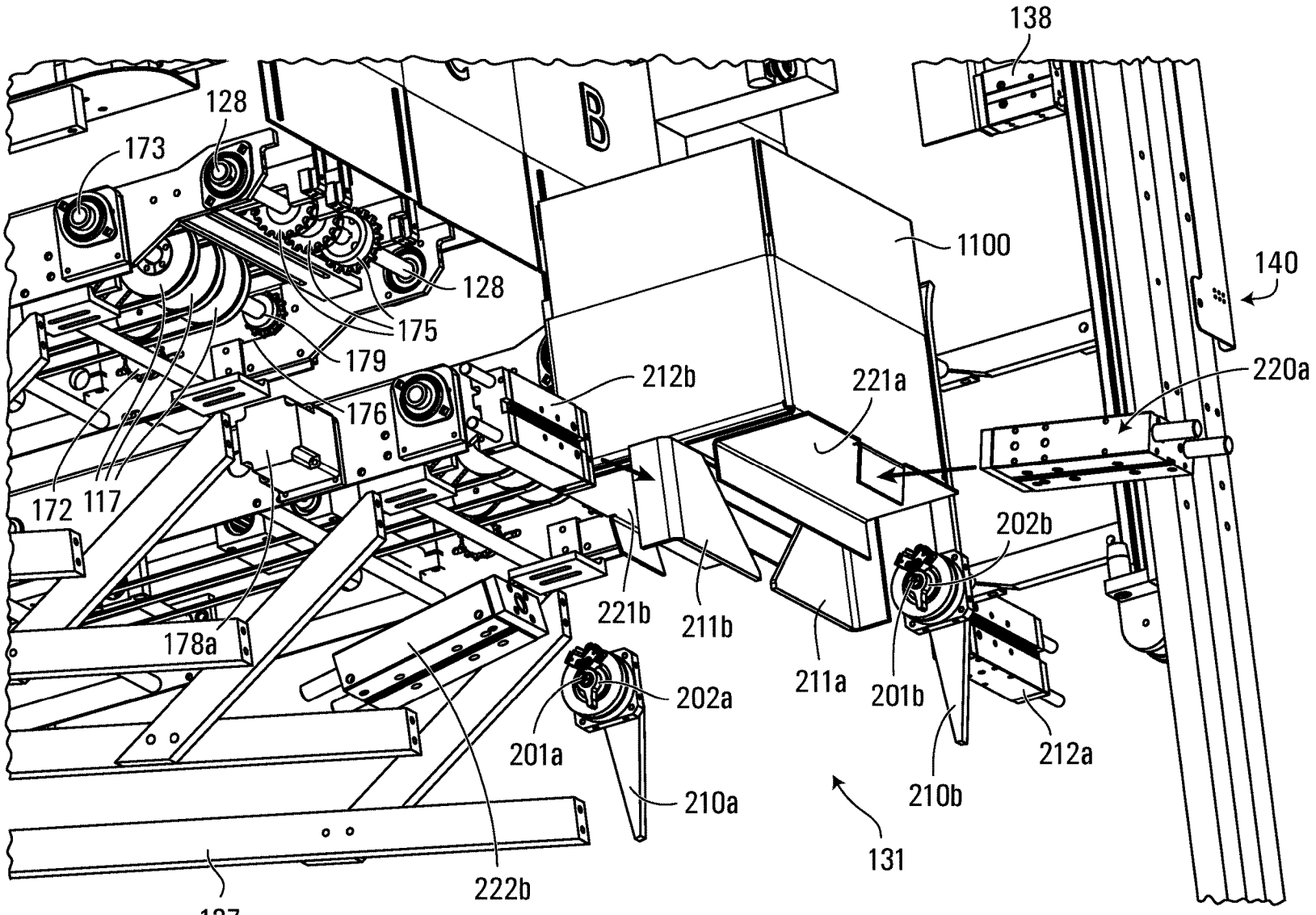
FIG. 19 is an enlarged view of portion of the system as shown in FIG. 18, in the eighth operational position.

Each conveyor 113*a*, 113*b*, may in some embodiments be divided into a rear conveyor portion 191 (FIG. 8) and a forward conveyor portion 193 (FIG. 8). Rear conveyor portion 191 may have a plurality of continuous conveyor belts 112. Continuous belts 112 may be oriented longitudinally parallel to each other and be supported for longitudinal movement at opposite ends by opposed sets of drive pulleys 117 and idler wheels 177. Belts 112 of the rear portions of each conveyor 113*a*, 113*b* may be driven by drive pulleys 117 (FIGS. 8 and 19). Drive pulleys 117 may be interconnected to a drive motor 178*b* (that may be a DC motor operated by PLC 132) through a drive mechanism comprising drive gears 172 (FIG. 19) and drive chains 176 (only partially shown in FIG. 19) connected to driven wheels 179 that are fixed to drive shaft 173. Thus drive shaft 173 may be driven by drive motor 178*b* that is in communication with, and controlled by PLC 132. An encoder may be provided to monitor and control the position of the drive belts 112.

Each forward conveyor portion 193 (FIG. 8) of conveyors 113*a,* 113*b* may utilize conveyor chains 174 which may also move/intermittently index blanks to the pick-up position of the magazine as described herein. A similar drive mechanism as the rear conveyor portions 191 may be provided for forward conveyor portion 193 on each conveyor. For example a motor 178*a* such as a DC motor in communication with PLC 132 may be inter connected to driven wheels 175 (FIG. 19) which may be fixedly attached to drive shaft 128. Driven wheels 175 may be inter-connected with driven conveyor chains 174 (FIG. 8) which are supported also at opposite end by wheels. Thus by controlled operation of motor 178*a,* conveyor chains 174 may move blanks supported thereon and transferred from rear conveyor portion 191, to the pick-up position on front conveyor portion 193.

Blanks 1000 in the stack supported on belts 112 in conveyors 113*a,* 113*b,* may be moved forward by belts 112 and then be transferred to conveyor chains 174. Conveyor chains 174 may move together longitudinally to move a forward group of blanks into the pick-up position. A back pressure device 165 (shown only schematically in FIG. 8) may be provided to keep a low level of pressure acting in a forward direction on the rear of the stack of case blanks (see FIG. 10). This can prevent some or all of the blanks in the stack from falling backwards as they are indexed forward.

Electronic sensors (not shown) in communication with PLC 132 may be positioned to monitor the stack of blanks and ensure that a blank 1000 at the front of the stack of blanks is properly positioned at the pick-up position.

Conveyor belts 112 and conveyor chains 174 of both conveyors 113*a,* 113*b* may be oriented longitudinally and parallel to each other and the belts of each conveyor 113*a,* 113*b* may be synchronized to move intermittently together at the same speed driven by drive motors 178*a,* 178*b.* The top run portions of conveyor belts 112 of conveyors 113*a,* 113*b* may be supported on the upper surface of floor plates 115 of magazine 110 and the bottom edges of the case blanks 1000 in the stack of case blanks may rest on top of the upper runs of the drive belts 112. Similarly conveyor chains 174 may be oriented longitudinally and parallel to each other and may be synchronized to move intermittently together at the same speed driven by drive motor 178*a.* The top run portions of conveyor belts 112 of conveyors 113*a,* 113*b* may be supported on the upper surface of floor plates 115 of magazine 110 and the bottom edges of the case blanks 1000 in the stack of case blanks may rest on top of the upper runs of the drive belts 112.

Conveyors 113*a,* 113*b* may thus be operable to move a vertically and transversely oriented stack of flat case blanks 1000 sequentially longitudinally forward under the control of PLC 132, so that single case blanks 1000 may be sequentially placed in the pick-up position to be retrieved in series from the stack for processing by first panel rotating apparatus 124.

The stack of case blanks 1000 may be supported at vertically oriented side edges by longitudinally and vertically oriented side wall plates 114*a,* 114*b* that may be spaced apart from each other and oriented generally parallel to each other. One or both of side wall plates 114*a,* 114*b* may be mounted on transversely oriented and movable rods 126 that are supported on magazine frame 127. Actuation of rods 126 may be made by any suitable mechanism such as by way of example only, servo drive motors with appropriate drive shafts and gear mechanisms or a hand operated gear and crank shaft mechanism. Side wall plates 114*a,* 114*b* serve to guide the case blanks within magazine 110 and can be accurately adjusted to be in close proximity to or contact with the particular case blank size that is being handled at a particular time. This adjustability of the relative transverse spacing of side walls 114*a,* 114 allows for case blanks of different configurations to be easily held in magazine 110 for processing as described herein.

Clip mechanisms 111*a-d* (FIGS. 4 and 5) may be provided to releasably hold each case blank 1000 that is at the front of the stack within magazine 110, and thus hold the stack in place. When first panel rotating mechanism 124 and second panel rotating mechanism 130 selectively engage panels D/F and A respectively, as described hereinafter, clip mechanisms 111*a* (FIG. 4), and 111*b* (FIG. 5) and 111*d* allow for the engaged panels E/D/F/N and A/K/J of the front case blanks 1000 in the stack to be pulled away from the same corresponding panels on the case blank immediately behind the front case blank in the stack held in the magazine. Also, clip mechanisms 111*c* (FIG. 5) will hold panels H, B and L, in magazine 110 while the other panels are being wrapped around the mandrel 137, but will then allow for the release of panels H, B and L to allow the remaining portion of case blank 1000 to be removed from being held by magazine and moved vertically downward once the case blank 1000 at the front of the stack is engaged by second panel rotating apparatus 130 and mandrel 137 moves vertically downwards, all as described further hereinafter.

First panel rotating apparatus 124 may be one of numerous types of robotic systems, but a particularly useful and efficient type of robotic system that may be employed is a Selective Compliance Assembly Robot Arm (referred to as a "SCARA") device. By way of example, first panel rotating apparatus 124 may be a SCARA robot made by Epson Robots, Motoman or Fanuc. First panel rotating apparatus 124 may be capable of intermittent motion, as will be evident from this description.

With particular reference to FIGS. 3-6, first panel rotating apparatus 124 may be secured to a fixed, longitudinally oriented robot support member 158 proximate a first end thereof. An opposite end of longitudinal robot support member 158 may be secured to an end portion of a fixed, transversely oriented robot support member 156. The opposite end portion of transverse robot support member 156 may be fixedly mounted to vertical support frame 140.

First panel rotating apparatus 124 may include a first rotational drive unit 160 having one upper end fixedly mounted to longitudinal robot support member 158. Extending from an opposite lower end of first rotation drive unit 160 is a first rotational drive that may comprise a drive shaft (not shown) that is operable for rotation clockwise and anti-clockwise about a first vertical axis of rotation Y1 (FIG. 3). The drive shaft of first rotation drive unit 160 is operably connected to a first end portion 162*a* (FIG. 4) of a first articulating arm 162. Thus, when rotational drive unit 160, under the control of PLC 132, causes the drive shaft of first rotation drive unit 160 to rotate, first articulating arm 162 is able to pivot clockwise or anti-clockwise relative to the drive shaft about vertical axis Y1, depending upon the direction of rotation of the drive shaft.

A second rotational drive unit 169 may be mounted at or proximate a second opposite end portion 162*b* (FIG. 5) of articulating arm 162. Rotational drive unit 169 may include a second rotational drive 164 (FIG. 5) that has a drive shaft (not shown) that is operable for rotation clockwise and anti-clockwise about a second vertical axis of rotation Y2 (FIG. 5) under the control of PLC 132. The drive shaft of rotational drive 164 may be located proximate a first end portion 169a of rotational drive unit 169. The drive shaft of rotational drive 164 is fixedly connected to opposite end portion 162*b* of first articulating arm 162.

When rotational drive unit 169, under the control of PLC 132, causes the drive shaft of rotational drive 164 to rotate relative to rotational drive unit 169 about axis Y2 (FIG. 5), and thus rotational drive 164 along with rotational drive unit 169 can rotate clockwise and anti-clockwise relative to first articulating arm 162 about the drive shaft of rotational drive 164 and thus about vertical axis Y2.

Rotational drive unit 169 may also have an opposite end portion 169b at which may be another vertical drive shaft 163 (FIG. 5) which is operable for clockwise and counter-clockwise rotation by a third rotational drive 167, under the control of PLC 132, about vertical axis Y3. Mounted to drive shaft 163 of second rotational drive 164 is an end effector rod 166 formed in a generally tubular cylinder and having suction cups 168.

Air suction cups 168 may be interconnected through hoses passing through cavities in end effector 166, second rotational drive 164, articulating arm 162, first rotational drive 160 and robot support members 158, 156 and vertical support frame 140 to a source of vacuum by providing for an air channel through the aforesaid components. The supply of vacuum to suction cups 168 may be provided by a pressurized air distribution unit generally designated 227 (FIG. 5A). Air distribution unit 227 may include a plurality of valves that may be operated by PLC 132 and may also include local vacuum generator apparatuses that may be in close proximity to, or integrated as part of, suction cups 168. In other embodiments, a vacuum pump mounted externally may generate vacuum externally and then vacuum can be supplied through the aforementioned air channels. If local vacuum generators are utilized, pressurized air may be delivered from an external source through air distribution unit 227 to the vacuum generators. The local vacuum generators may then convert the pressurized air to vacuum that can then be delivered to suction cups 168.

Figure 6:
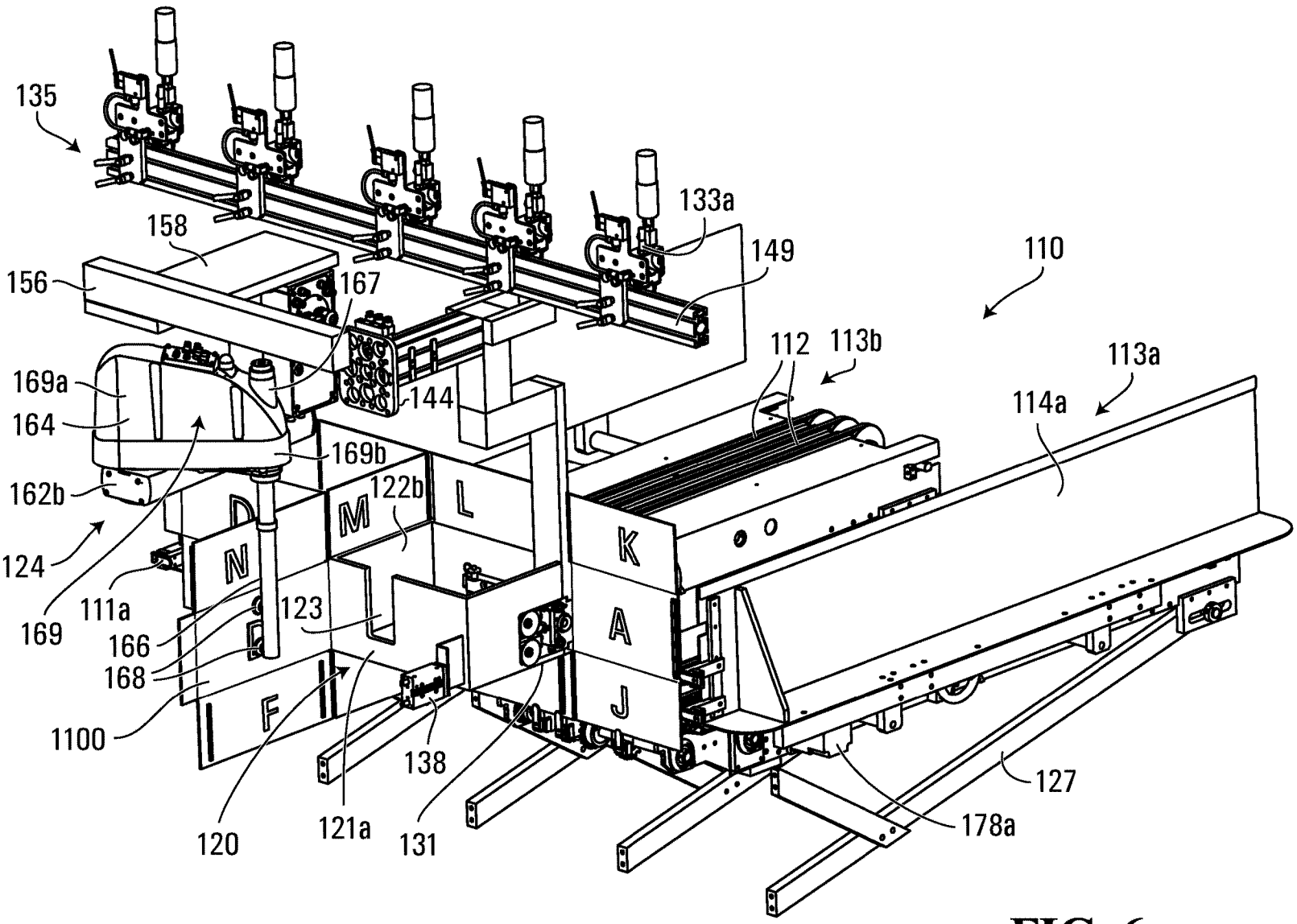
FIG. 6 is a view of the system of FIG. 4 similar to FIG. 5.
Figure 7:
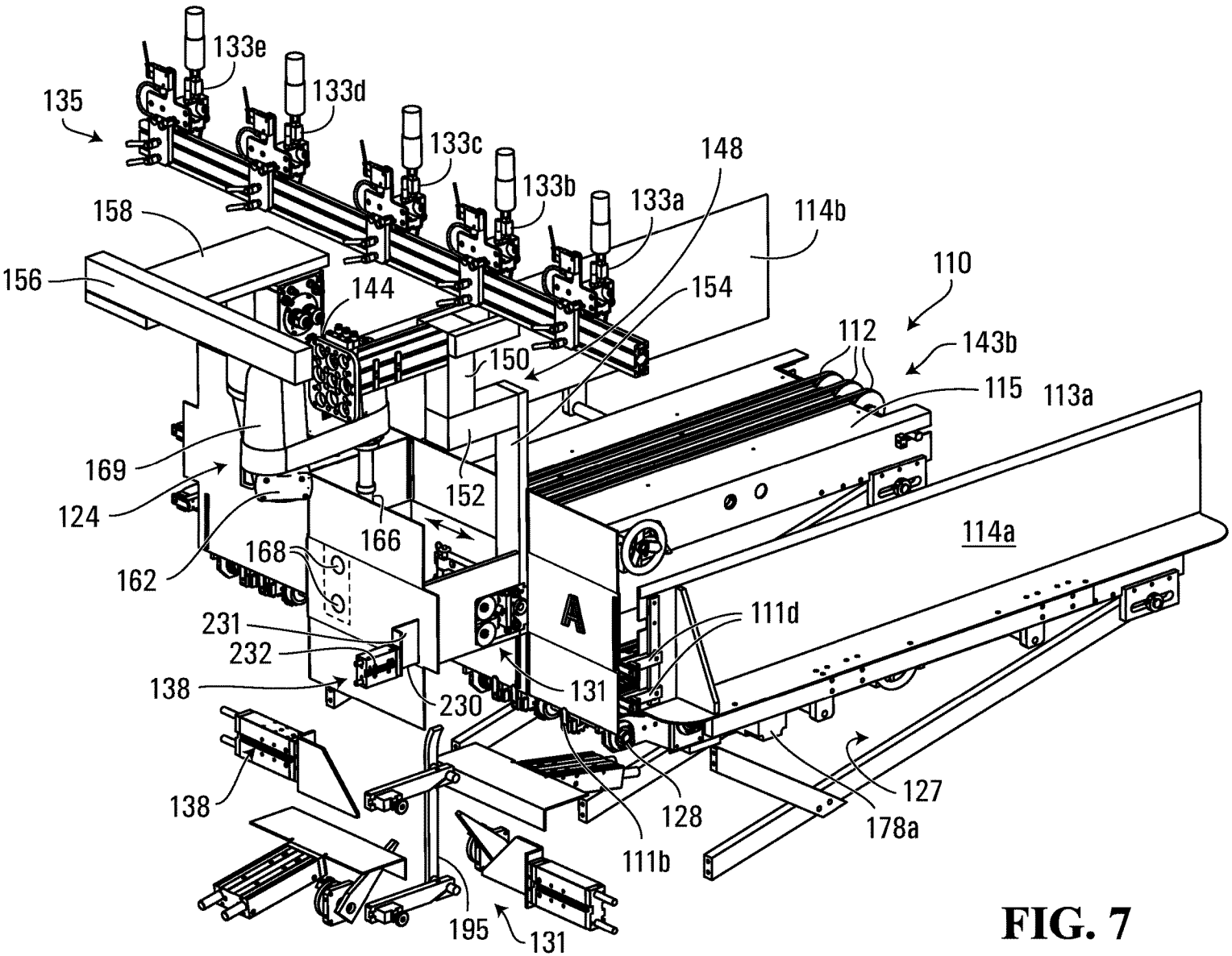
FIG. 7 is an upper, right front perspective view of the system of FIG. 2 in a third operational position, but also with some components omitted for simplicity.

The air suction force that may be developed at the outer surfaces of suction cups 168 will be sufficient so that when activated they can engage and hold panel D, and rotate panels D (along with panels F, N, E and M, C and G) of a case blank 1000 from (i) the position shown in FIG. 3 to (ii) the position shown in FIGS. 5 and 6, and thereafter (iii) to the position shown in FIGS. 7 and 8 and then (iv) after releasing a first engaged blank 1000, eventually return to the position shown in FIG. 3 to engage a next case blank 1000 positioned at the pick-up position in magazine 110. The vacuum generated at suctions cups 168 can be activated and de-activated by PLC 132 through operation of air distribution unit 227.

First rotating apparatus 124 may be readily adjustable for different types/configurations of mandrel apparatuses 120, including mandrels 137, for forming different types/configurations of case blanks 1000 into cases by suitable programming of PLC 132 appropriately to provide for appropriate movements of the suctions cups 168 through movement of the first rotational drive 160 and second rotational drive 164 and third rotational drive 167. Thus by an interchange of mandrel 137 to provide for alternate configurations of the mandrel side wall and bottom walls, PLC 132 and its operation of first rotating apparatus 124 may be appropriately programmed and thus different sized and configurations of blanks may be processed.

Mandrel apparatus 120 may have several components including a mandrel 137 (FIG. 3) and a mandrel support apparatus generally designated 148 (FIGS. 5 and 7). Mandrel 137 may be easily removable from mandrel support apparatus 148, so that a mandrel of one configuration may be easily replaced with a mandrel of another configuration. With particular reference to FIGS. 5-6 and FIGS. 23-25, mandrel 137 may comprise a pair of opposed, spaced, vertically and transversely oriented, spaced, major side walls 121*a*, 121*b* interconnected with a pair of opposed, spaced, vertically and longitudinally oriented, spaced, minor side walls 122*a*, 122*b*. A generally horizontally and transversely oriented bottom wall 118 is interconnected to major and minor side walls 121*a*, 121*b*, 122, 122*b* to form a generally cuboid, open top, box shape. Mandrel 12 may be generally configured in a variety of different sizes and shapes, each selected for the particular type of case blank 1000 that are to be formed into cases.

The dimensions of the outer surfaces of mandrel 137 may be selected so that the specific case blank 1000 that it is desired to fold has, during the forming process, fold lines that are located substantially at or along the four corner vertical side edges and the four corner horizontal bottom edges of mandrel 137. Such a selection may improve the performance of case forming system 100 in creating a formed case that is ready for loading with items. Mandrel 137, and surrounding components in system 100, may be configured to permit for the easy interchange of mandrels 137 so that case forming system 100 can be readily adapted to forming differently sized/shaped cases from differently configured case blanks 1000.

Front mandrel side wall 121*a* may be provided with a vertical slot 123 that may be configured to permit part of end effector 166 and suction cups 168 to move from the position shown in FIGS. 5 and 6, and pass through slot 123 to the position shown in FIGS. 7 and 8. By allowing the end effector 166 to pass through vertical slot 123, end effector 166 and suction cups 168 may engage the outer surface of the major side panel D of case blank 1000 when it is held in magazine 110 and then may wrap the case blank around the mandrel 137 such that the surface being held becomes an inner surface of the tubular formed case blank and major side panel D may be held substantially flat against the outside surface of major side wall 121*a* of mandrel 137, as shown.

Figure 23:
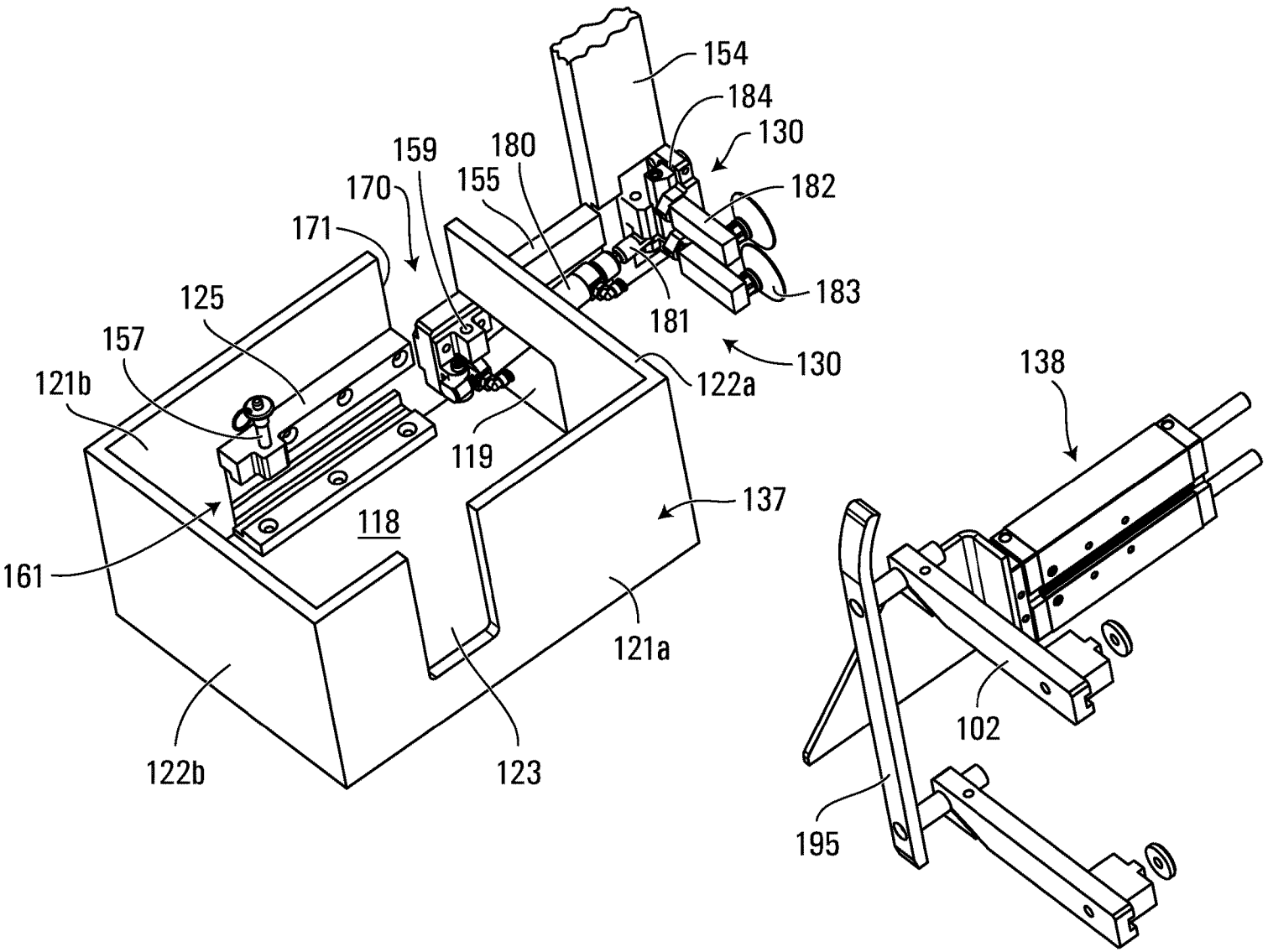
FIG. 23 is a perspective view of some components of the system of FIG. 2 shown in isolation.
Figure 24:
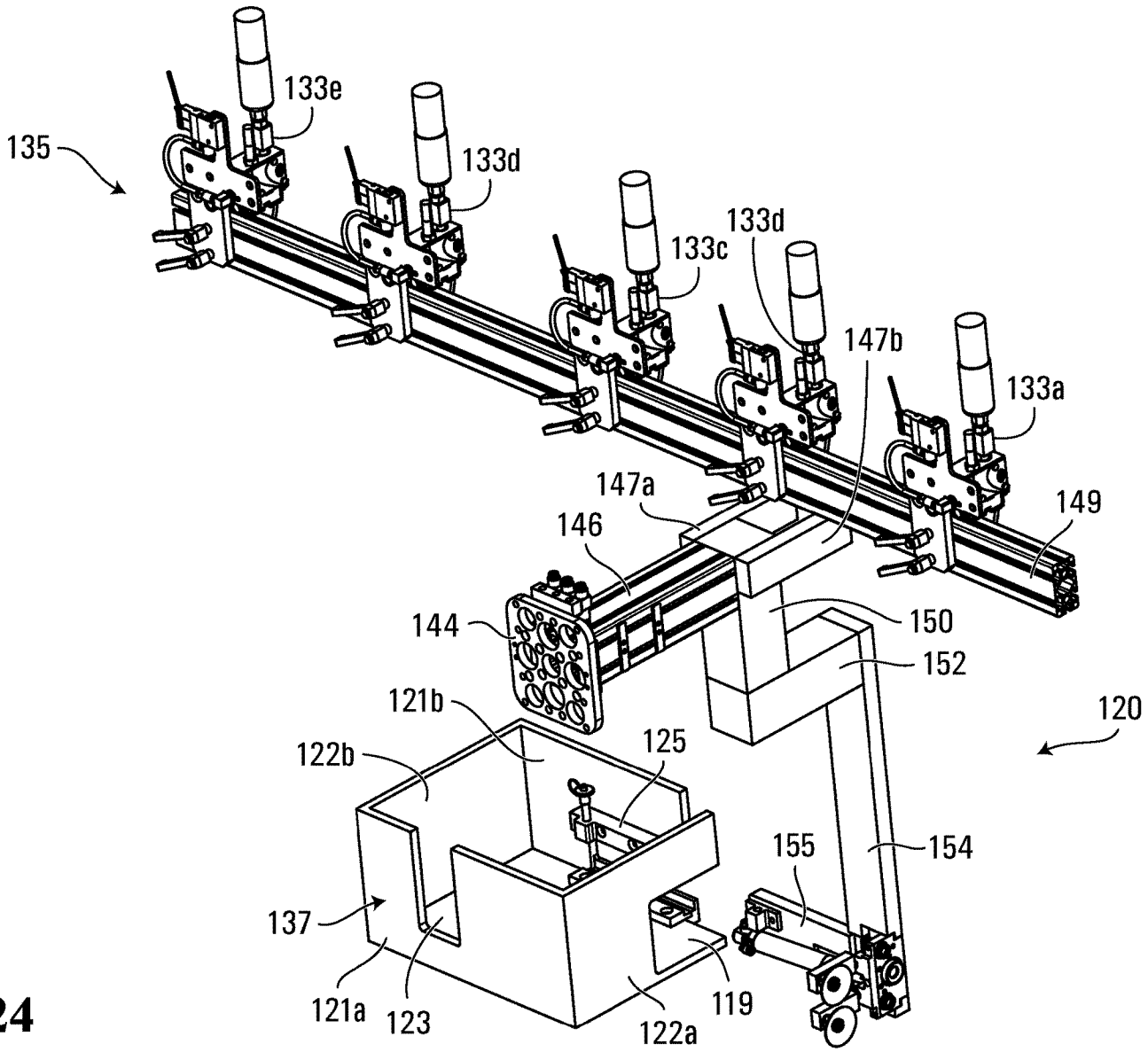
FIG. 24 is a perspective view of some other combination of components of the system of FIG. 2 shown in isolation.
Figure 25:
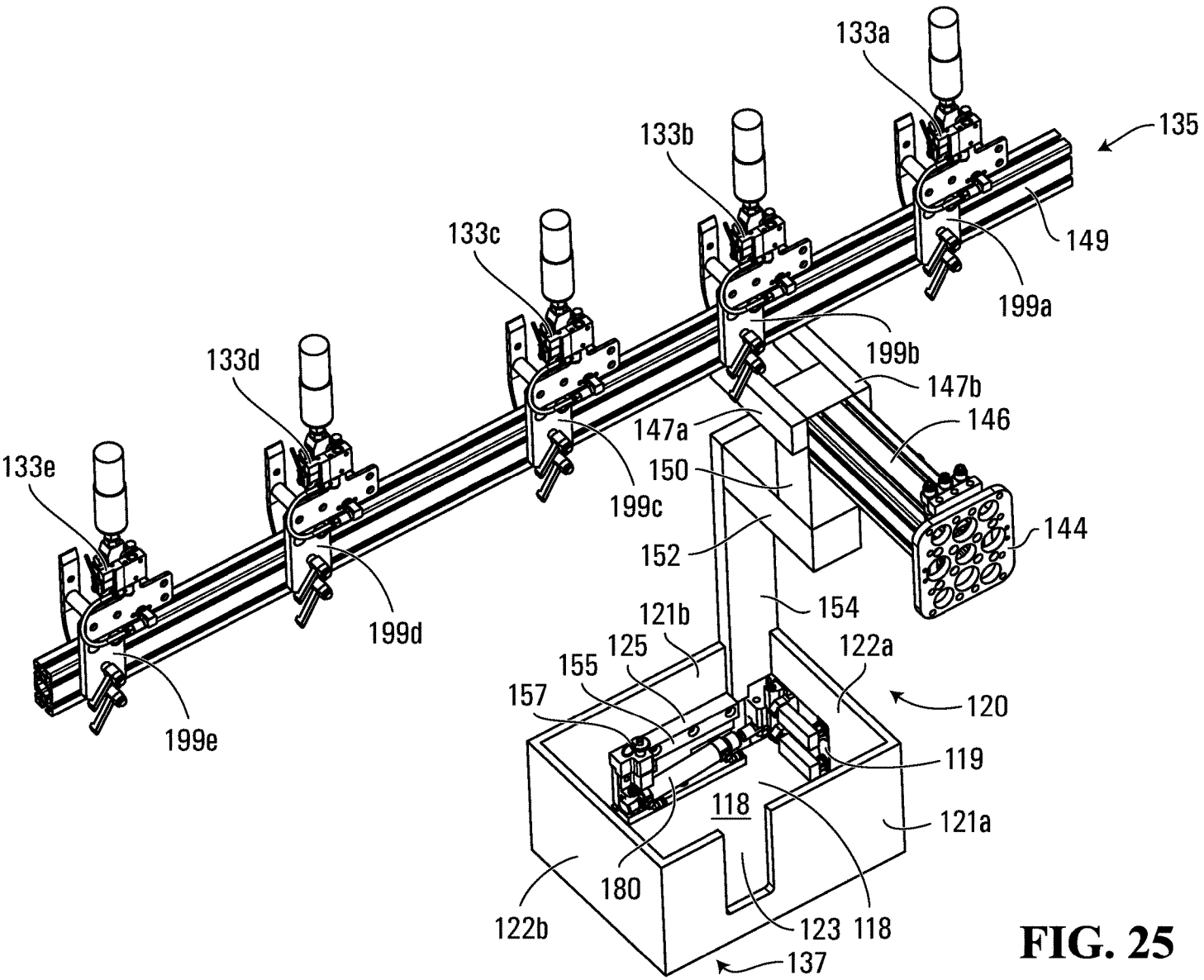
FIG. 25 is another perspective view of some combination of components of the system of FIG. 2 shown in isolation.

With particular reference to FIGS. 23-25, rear mandrel side wall 121*b* may not extend transversely the full length of bottom wall 118 and may have a vertical end edge 171 that defines an opening 170. Mounted to an inward surface of rear side wall 121*b* may be a releasable mandrel mounting bracket unit 125. Mandrel mounting unit 125 may be configured to releasably connect a transversely extending mandrel mounting plate 155 to mandrel rear side wall 121*b*, such as having mounting plate 155 be received into slot 161 in mounting bracket unit 125, with the plate being releasably held in the slot by a screw of the mounting bracket unit being removably receivable in a threaded aperture 159 of the mounting plate 155. It will be noted that by simple transverse movement of mandrel 137 relative to mounting plate 155 one mandrel 137 may be replaced by another mandrel 137 of a different configuration.

Horizontally and vertically oriented mounting plate 155 can be fixedly connected to an end of vertical mandrel support member 154. A lower portion of mandrel support member 154 may also serves to complete the rear side wall of mandrel 137, when mandrel mounting plate 155 is received into mounting bracket unit 125.

Mounted to an inner surface of mandrel mounting plate 155 is second panel rotating apparatus 130. With particular reference to FIGS. 23 and 24, second panel rotating apparatus 130 may include a double acting pneumatic cylinder device 180 which may for example be one of several different types made by Festo.

Pneumatic cylinder 180 may be supplied with pressurized air controlled by valves (not shown) operated by PLC 132. Pneumatic cylinder 180 may have a piston arm 181 that has an end pivotally connected to a suction cup arm 182. Suction cup arm 182 may be provided with suction cups 183. Air suction cups 183 may be interconnected through hoses passing through cavities (not shown) in suction cup support arm 182, first vertical support member 154, longitudinally oriented mandrel support member 152, second vertical mandrel support member 150 and longitudinally oriented and carriage support arm 146 and carriage 144 to a source of vacuum by providing for one or more air channels carrying pressurized air through the aforesaid components. The supply vacuum to suction cups 183 may be controlled by pressurized air distribution unit generally designated 227 (FIG. 5A). Air distribution unit 227 may include a plurality of valves that may be operated by PLC 132 and may also include local vacuum generator apparatuses that may be in close proximity to, or integrate as part of, suction cups 168. In other embodiments, a vacuum pump may generate vacuum externally and then vacuum can be supplied through the aforementioned air channels. If local vacuum generators are utilized in close proximity to vacuum cups 183, pressurized air may be delivered from an external source through air distribution unit 227 to the vacuum generators. The local vacuum generators will then convert the pressurized air to vacuum that can then be delivered to suction cups 183.

Figure 11:
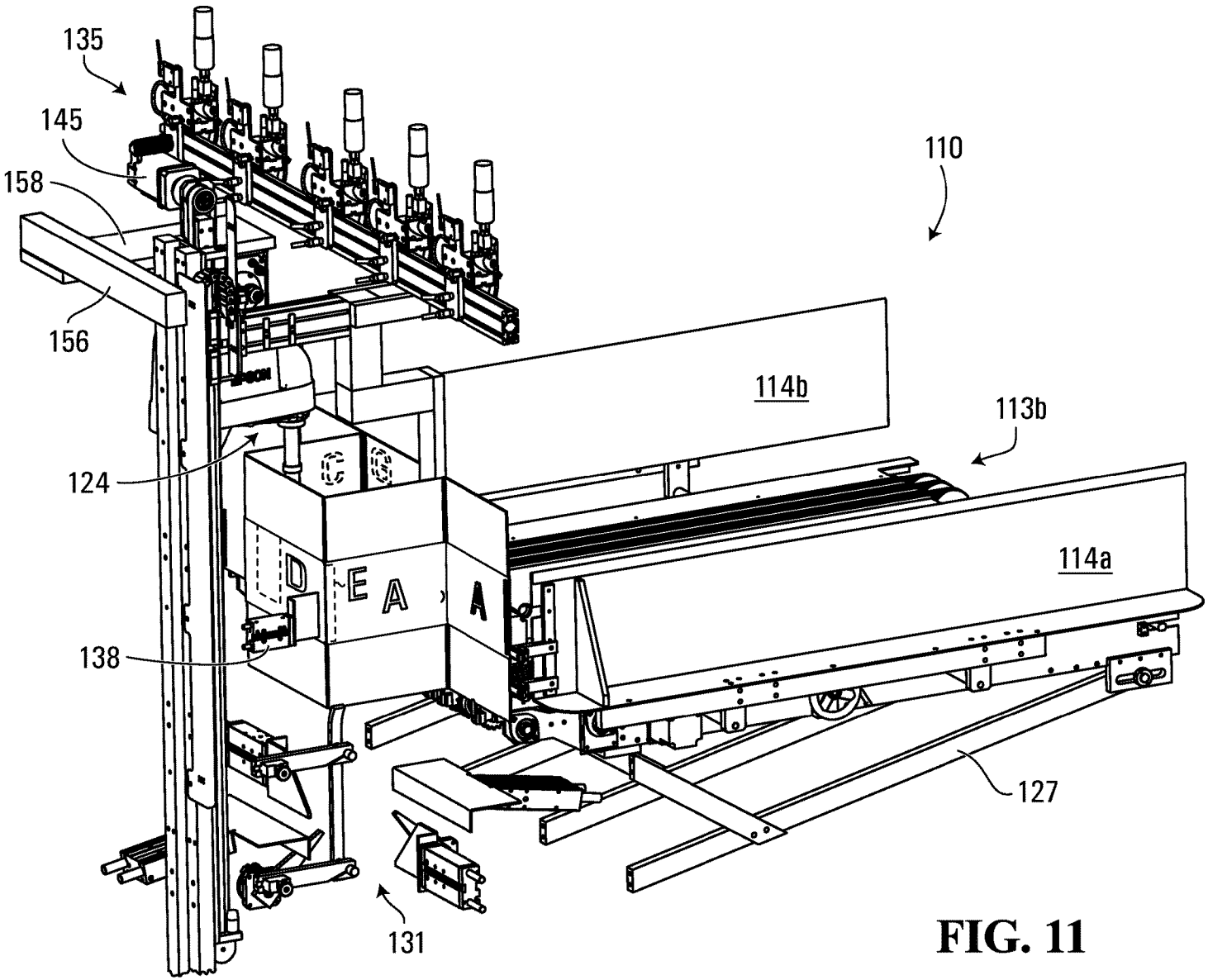
FIG. 11 is an upper, right front perspective view of the system of FIG. 2 in a fifth operational position.

The air suction force that may be developed at the outer surfaces of suction cups 183 will be sufficient so that when activated they can engage and hold panel A, and rotate panels K, A and J of a case blank 1000 past clip mechanisms 111*b* and 111*d*, from the position shown in FIGS. 5-9 to initially the positon shown in FIG. 11, and then, once the case blank 1000 is released, eventually return to the position shown in FIG. 5. The vacuum generated at suctions cups 183 can be activated and de-activated by PLC 132 through operation of unit 227.

When PLC 132 causes pneumatic cylinder 180 to extend piston arm 181, such cup arm 182 with suction cups 183 can rotate about a pivot device 184 through a longitudinally and vertically extending opening 119 in mandrel side wall 122*a* (see for example FIG. 9) and can then suction cups 183 can engage an outward facing surface of a panel A of case blank 1000.

It may be appreciated that the end effector 166 engages an outward facing surface of a case blank 1000 held in a pick-up position in the magazine 110. However, by allowing end effector 166 with suction cups 168 to pass into a recess in the wall, and in this embodiment shown, through vertical slot 123 in mandrel 137, and allowing suction cup arm 182 to pass through opening 119 in mandrel 137, and then move their respective suction cups to appropriate positions at least partially within the respective slot 123 and opening 119, enables the first panel rotating apparatus 124 and second panel rotating apparatus 130 to in effect wrap the case blank around the outer surfaces of 122*a*-122*d* of mandrel 127 by engaging only what become the inward facing vertical surfaces of the tubular case blank formed from case blank 1000 (ie. the case blank 1000 is wrapped around the mandrel by engaging what become inward facing surfaces of the tubular shaped case blank 1000.

Horizontally and vertically oriented mounting plate 155 may be fixedly connected at an outer end to a lower end portion of vertical mandrel support member 154.

An opposite, upper end of vertical mandrel support member 154 may be fixedly connected to a first end of a longitudinally oriented mandrel support member 152. An opposite second end of longitudinally oriented mandrel support member 152 may be fixedly connected to a first end of a second vertical mandrel support member 150. A second opposite end of second vertical mandrel support member 150 is fixedly attached to a first end of longitudinally oriented and extending carriage arm 146. Proximate the connection location of mandrel support member 150 and carriage arm 146 may be mounted to opposite outer surfaces of vertical mandrel support member 150, a pair of spaced and opposed, longitudinally oriented support blocks 147*a*, 147*b* (see FIG. 25).

Mandrel side wall 121*b*, with its mounting plate 125 can facilitate the support of mandrel 137 on mandrel support frame 148 that includes mounting block plate 155, first vertical support member 154, longitudinally oriented mandrel support member 152, second vertical mandrel support member 150 with longitudinally oriented support blocks 147*a*, 147*b*, and carriage arm 146.

With reference to FIGS. 5 and 24, as noted above, vertical mandrel support member 150 is fixedly attached at is upper end portion to a first end portion of longitudinally oriented and extending carriage arm 146. The opposite end portion of longitudinally oriented and extending carriage arm 146 is fixedly connected to carriage block 144. Carriage block 144 is attached for sliding vertical upward and downward movement on a vertically oriented linear rail 142. Linear rail 142 may for example be a linear rail device of many types made by Bosch Rexroth AG, and provides a vertical movement apparatus 136 for mandrel apparatus 120 and the mandrel supporting members.

Linear rail 142 may be mounted to vertical support frame 140. Linear rail 142 may have a carriage drive mechanism 198 (FIGS. 8 and 2) which is operable under the control of PLC 132 to move the carriage 144 and thus also mandrel 137 vertically upwards and downwards within a range of movement as required for completing the case forming operations described herein.

First vertical support member 154, longitudinally oriented mandrel support member 152, second vertical mandrel support member 150 and longitudinally oriented and carriage support arm 146 and carriage 144 may be appropriately configured to permit electrical and communication cables and pressurized air/vacuum air hoses to pass through from an upper end to a lower end where operational components of mandrel apparatus 120 are located. In this way, electrical power/communication cable and air hoses can deliver power, electrical signals and pressurized air/vacuum to the mandrel 137 and second panel rotating apparatus 130 which is mounted on mandrel 137.

It will also be appreciated that in first panel rotation apparatus 124 and second panel rotating apparatus 130, suction cups are used to apply a force to hold and move panels of a case blank 1000. However alternative engagement mechanisms to suction cups could be employed in other embodiments to engage, hold and rotate panels of case blanks 1000.

Figure 20:
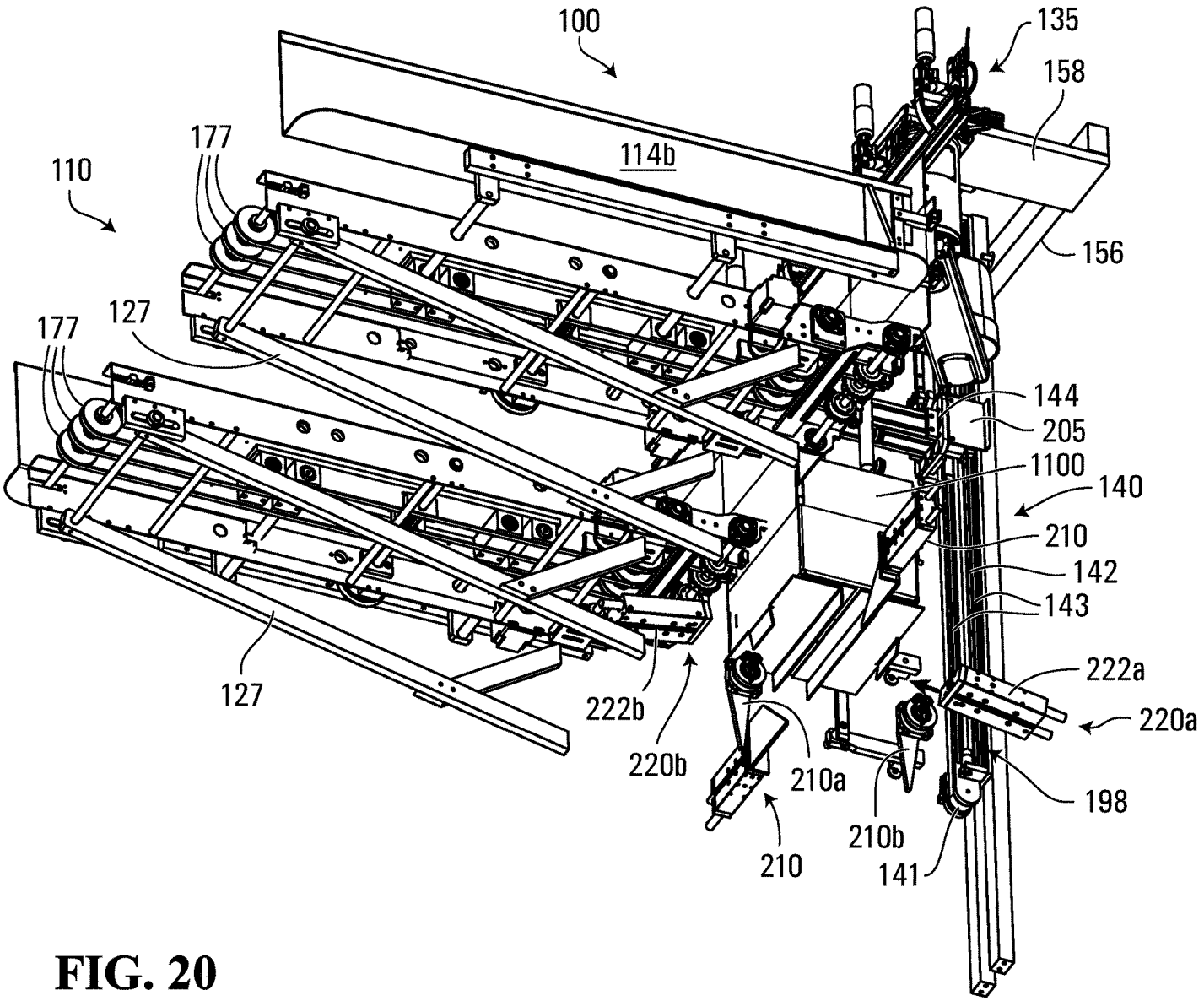
FIG. 20 is a lower, left rear perspective view of the system of FIG. 2 in the eighth operational position.
Figure 21:
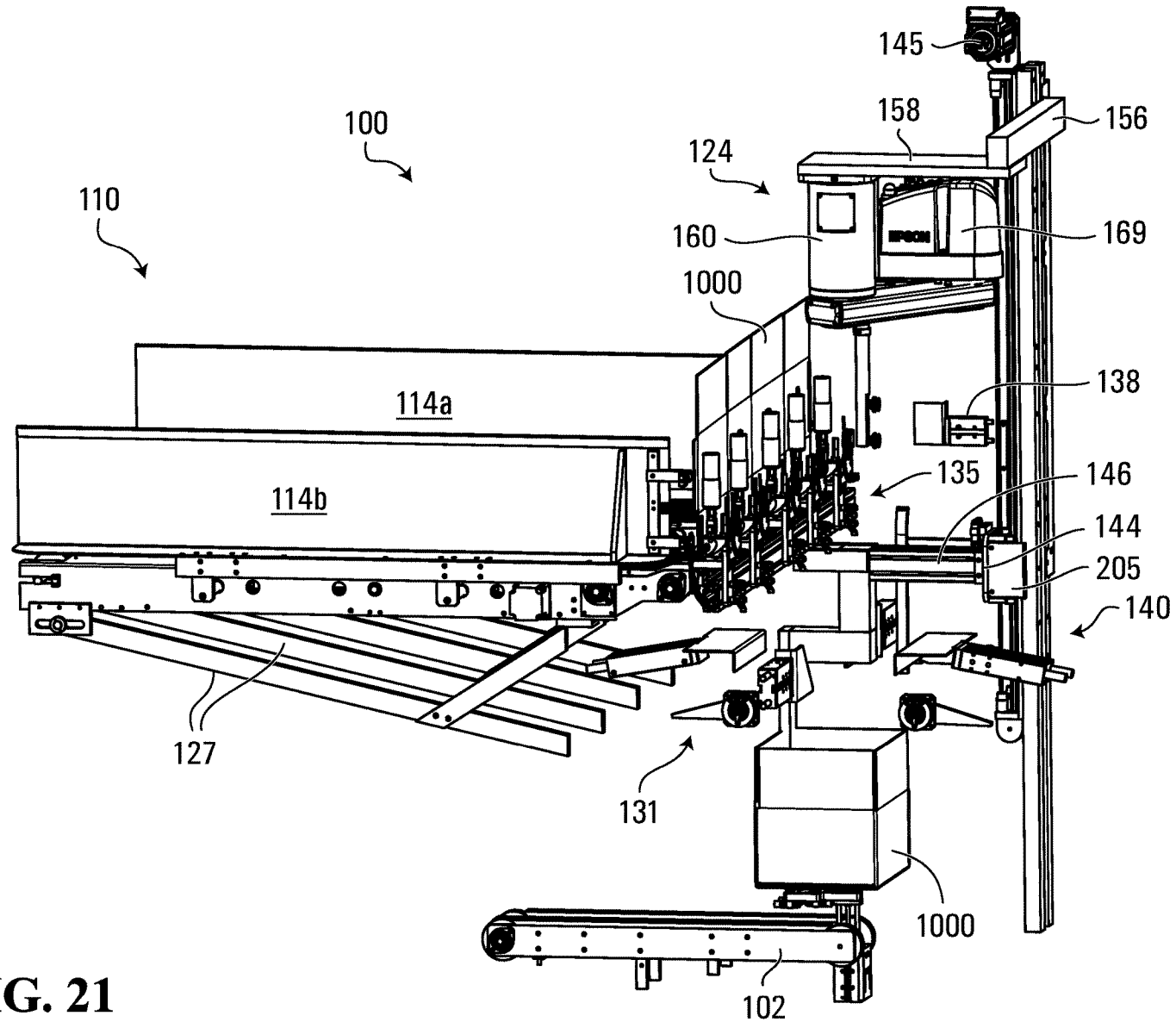
FIG. 21 is an upper, left side perspective view of the system of FIG. 2 in a ninth operational position.

With particular reference now to FIGS. 8 and 20, linear rail 142 may include carriage drive mechanism 198 that is operable to drive carriage 144 vertically upwards and downwards on line rail 142. Carriage drive mechanism 198 may include a continuous vertically oriented drive belt 143 that extends between an idler wheel 141 and a drive wheel 139. Drive wheel 139 may be driven in both rotational directions and at varying speeds by the drive shaft of a servo drive motor 145. The operation of drive motor 145 may be controlled by PLC 132 in combination with a position sensing apparatus such as an encoder (not shown) associated with drive motor 145 so that PLC 132 can determine when and how to operate drive motor 145 to appropriately position the drive belts 143*a,* 143*b* and thus move carriage 144 upwards and downwards, consequently also moving mandrel 137 and adhesive applicators 133*a-e* upwards and downwards. Drive motor 145 may be mounted at an upper end portion of support frame 140. Carriage 144 may be interconnected to drive belt 143 with a connection mechanism that may include opposed side connector plates 205 (FIGS. 20 and 21).

Figure 9:
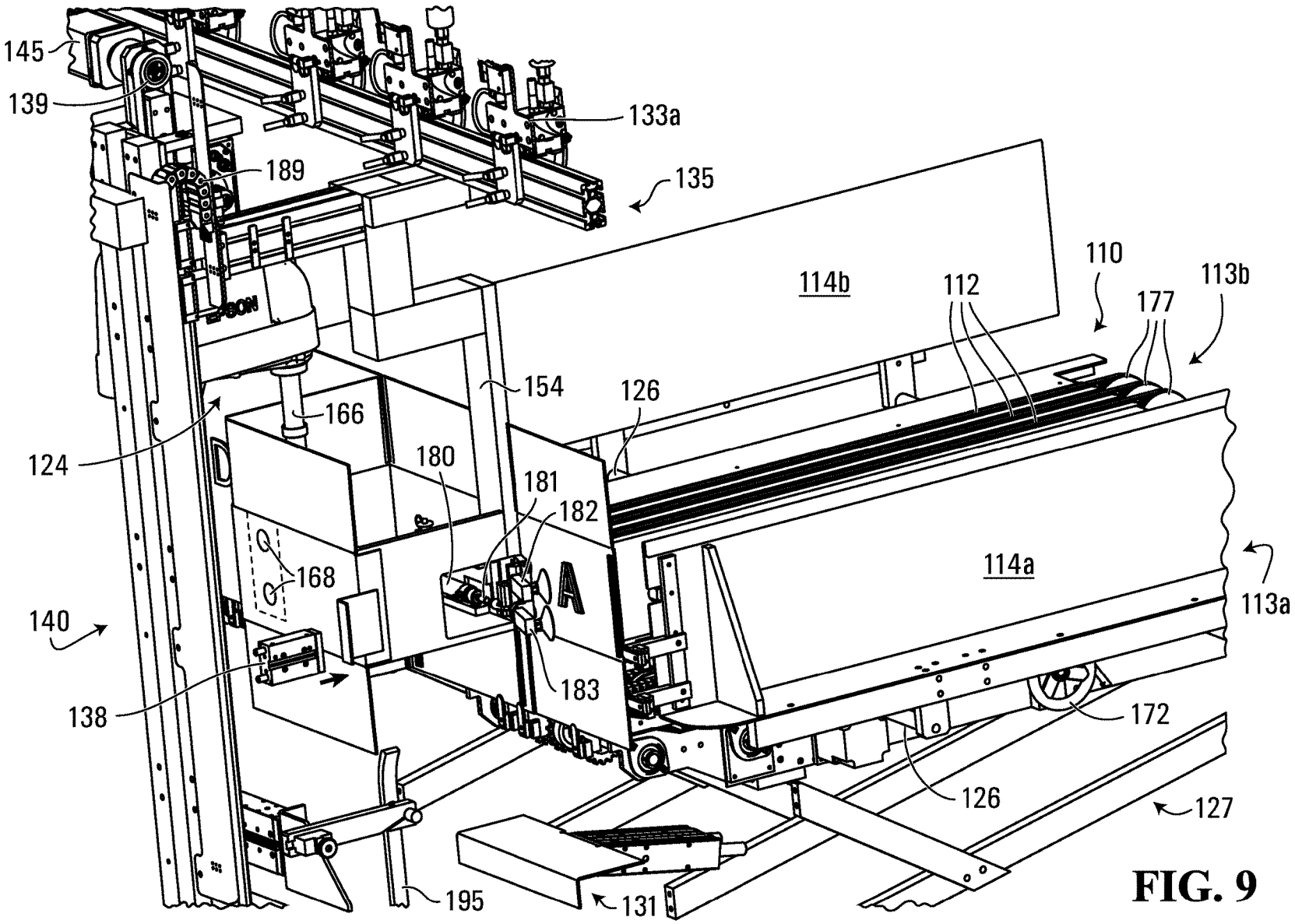
FIG. 9 is an upper, right front perspective view of the system of FIG. 2 in a fourth operational position.

Also associated with vertical moving apparatus 136 may be a caterpillar device 189 (FIG. 9). Caterpillar 189 has a hollow cavity extending along its length. Within the cavity of caterpillar 189 hoses carrying pressurized air/vacuum and electrical/communication wires can be housed. Caterpillar 189 allows such hoses and wires to move vertically as the mandrel support components and thus mandrel 137 are moved vertically by vertical moving apparatus 136. The hoses and wires may extend from external sources to enter at an inlet of caterpillar 189 mounted to vertical support frame 140 and emerging at an outlet on carriage arm 146. Upon leaving the outlet of caterpillar 189, the hoses and wires may pass into the internal cavity of carriage arm 146 (see FIG. 9). An example of a suitable caterpillar device that could be employed is the E-Chain Cable Carrier System made by Igus Inc.

Also mounted for vertical upwards and downwards movement with mandrel apparatus 120 is an adhesive applicator apparatus 135. Adhesive applicator apparatus 135 may include a transversely oriented support beam 149 to which may be mounted a plurality of adhesive applicators 133*a* to 133*e* (FIG. 3). Adhesive applicators 133*a-e* may be provided with nozzles 153 (FIG. 8) Individual adhesive applicators 133*a* to 133*e* can be appropriately positioned transversely along support beam 149 such that adhesive applicators 133*a-e* can provide a suitable adhesive pattern to the outward facing surface of a case blank 1000 and certain panels thereof, held at the front of magazine 110 in the pick-up position. The operation of each adhesive applicator 133*a-e* may be controlled by PLC 132 by for example suitable wire connections that pass through caterpillar 189 and other components of mandrel apparatus 120. Applicators 133*a-e* can apply a suitable adhesive to various panel surfaces of a bank 1000 held in magazine 110 so that when the panels are folded as described herein, the panels and flaps can be held in the desired carton configuration.

An example of a suitable adhesive applicator apparatus 135 that can be employed is the model ProBlue 4 hot melt application system made by Nordson Inc. which includes adhesive tank, nozzles/guns and hoses as well as solid state temperature control for the tank, guns and hoses. The operation of adhesive applicator apparatus 134 may be monitored and controlled by PLC 132.

Various types of adhesives may be employed in case forming system 100. A particular class of adhesives that may be suitable are adhesives in the class of "Hot Melt Adhesives" (referred to as a "HMA"). HMAs may be a thermoplastic adhesive/glue which may be heated in an applicator such as applicators 133*a-e* by respective heating elements and then expelled from the applicators while hot and tacky onto surfaces which are to be adhered to other surfaces. Depending upon the particular formulation of the HMA selected, the adhesive may for example remain tacky and capable of bonding two surfaces together for, from perhaps a second or a few seconds, to up to a minute or more. In case forming system 110, an HMA may be applied to the outward facing surfaces of panels of a blank 100 (such as shown in FIG. 1) while held in magazine 100 by applicators 133*a-e,* to form adhesive lines such as adhesive lines 1001, 1002, 1003, 1004 and 1005.

One particular type of HMAs are pressure sensitive HMAs which may remain tacky and capable to bonding two surfaces together until pressure is applied to the HMA, such as when the HMA is compressed between two surfaces of two panels of a blank 1000 as the two panels are brought together. Such pressure sensitive HMAs may remain tacky and capable of bonding two surfaces together for a long period of time, and potentially for an infinite amount of time, until pressure is applied to the HMA.

An example of a suitable adhesive that could be employed on a case blank 1000 made of cardboard is Cool-Lok adhesive made by Nacan Products Limited or a suitable pressure sensitive HMA made by Henkel.

Adhesive applicators 133*a-e* can for example be positioned transversely along support beam 149, and their operation controlled by PLC 132 to provide apply a suitable adhesive to various panel surfaces, such as vertical adhesive lines 1001, 1002 on lower major panel F, vertical adhesive lines 1003, 1004 on lower major panel H and adhesive line 1005 on minor side wall panel A (FIG. 1). This can be done as the adhesive applicators 133*a-e* are moving upwardly on support beam 149 during an upward stroke of the mandrel apparatus 120 including mandrel 137.

The transverse positions of adhesive applicators 133*a-e* may be individually selected and adjusted by use of a releasable adjustment mechanisms 199*a-e* which releasably secures the applicators 133*a-e* to support beam 149, at positions suitable dependent upon which particular type/configuration of case blank 1000 that is being processed (see for example FIG. 25). This adjustable positioning of adhesive applicators 133*a-e* is another part of the features of case forming system 100 that enables case forming system 100 to be easily modified when changing over from handling one type/configuration of case blank to another type/configuration of case blank.

Applicator support beam 149 may be fixedly mounted to support blocks 147*a,* 147*b* (FIG. 5) and thus applicator support beam 149 and adhesive applicators 133*a-e* may move and stroke vertically upwards and downwards along with carriage 144 and mandrel movement apparatus 136 within a range of intermittent movement as required for completing the case forming operations and process described herein. It will be appreciated that by interconnecting adhesive applicator apparatus 135, including applicator support beam 149 carrying adhesive applicators 133*a-e,* to the carriage 144, the adhesive applicator apparatus 135 may be moved in reciprocating motion vertically upwards and downwards in space with the mandrel apparatus 120 and mandrel 137. Both portions of adhesive applicator apparatus 135 and at least portions of mandrel apparatus 120 will occupy some of the same spatial region in the vicinity of the front of the magazine 110 and the pick-up location of case blanks 1000 located in the magazine 110 at the front of the stack. This enables the adhesive applicator apparatus 135 to apply adhesive to the outward facing surface of the blank at the pick-up position during upward vertical movement, while the case blank 1000 at the front of the stack is being held in the magazine, and prior to the mandrel apparatus 120 being brought into an engagement position with the case blank being located at the pick-up location.

The next component of system 100 to be described in detail is third panel rotating apparatus 131 which is configured to cause the appropriate lower panels F, G, H, J (FIG. 1) to be folded and sealed to provide a closed bottom and thus form an open top case configuration that is suitable for delivery to a case conveyor 102 (FIG. 3). Third panel rotating apparatus 131 is operable (a) to rotate outwards lower major panels F and H about their respective fold lines with respective major side panels D and B. The amount of rotation is sufficient to ensure that there will be no interference with the subsequent inward rotation of lower minor panels G and J and no contact is made with adhesive that may be on an inward surfaces of lower major panels F and H, such as respective adhesive lines 1001, 1002 and 1003, 1004 (FIG. 1). In an example embodiment the amount of outward rotation of lower minor panels G and J from vertical planar alignment with their respective adjacent lower major side wall panels D and B, may be about 45 degrees from the vertical.

Third panel rotating apparatus 131 may also be operable to (b) rotate lower minor panels G and J inwardly, preferably about 90 degrees to a generally horizontal orientation, about their respective fold lines with respective major side wall panels C and A; and (c) rotate lower major panels F and H inwards, about their respective fold lines with respective major side panels D and B, an amount of rotation is sufficient to ensure that there will be contact between inner surfaces of lower major panels of lower major panels F and H and the outer surfaces of lower minor panels G and J. Third panel rotating apparatus 131 may also be operable to apply compression to lower major panels F and H against the bottom wall 188 of mandrel 137 to ensure that a fixed adhesive connection is formed between inner surfaces of lower major panels of lower major panels F and H and the outer surfaces of lower minor panels G and J.

Figure 13:
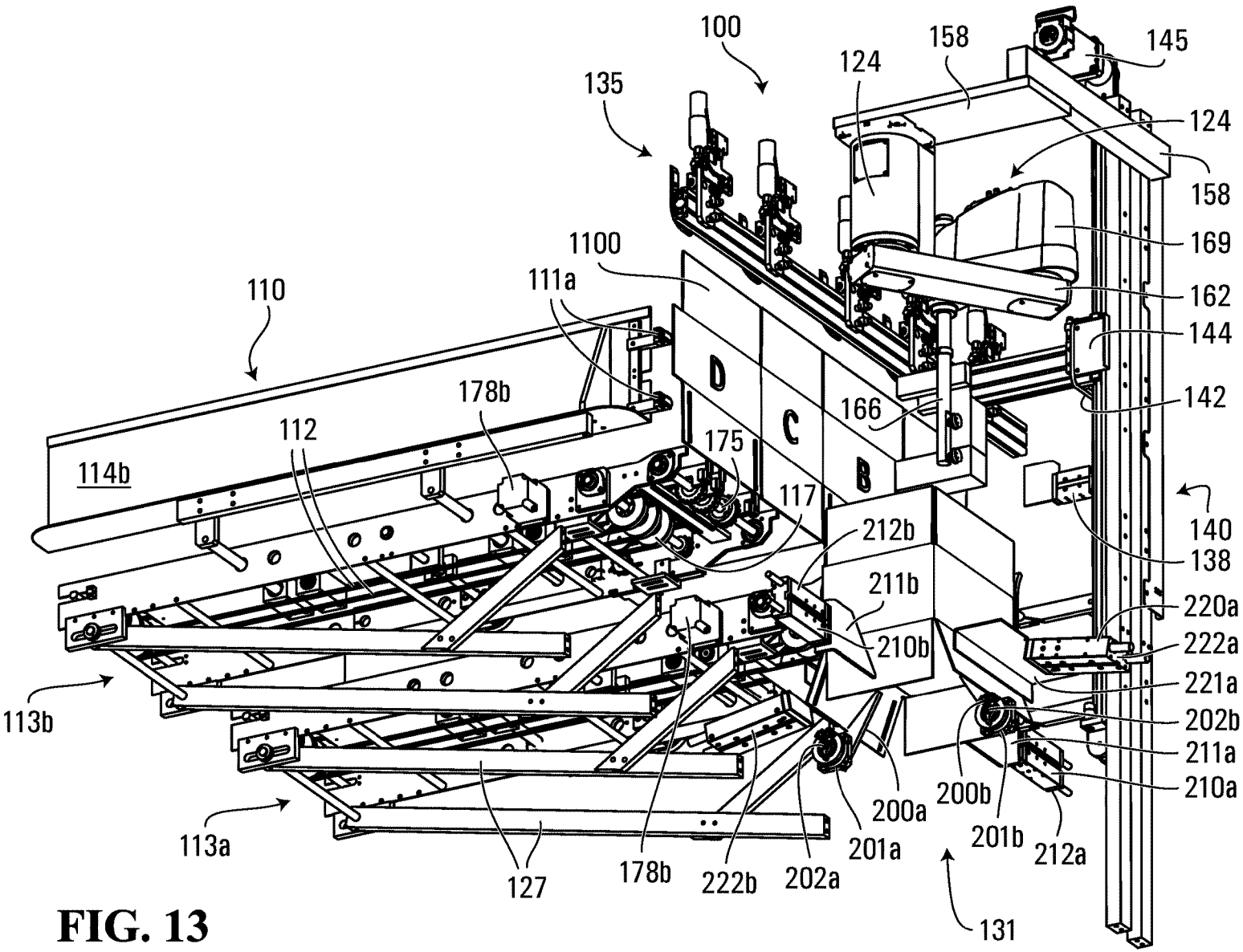
FIG. 13 is an lower, left front perspective view of the system of FIG. 2 in a sixth operational position.
Figure 14:
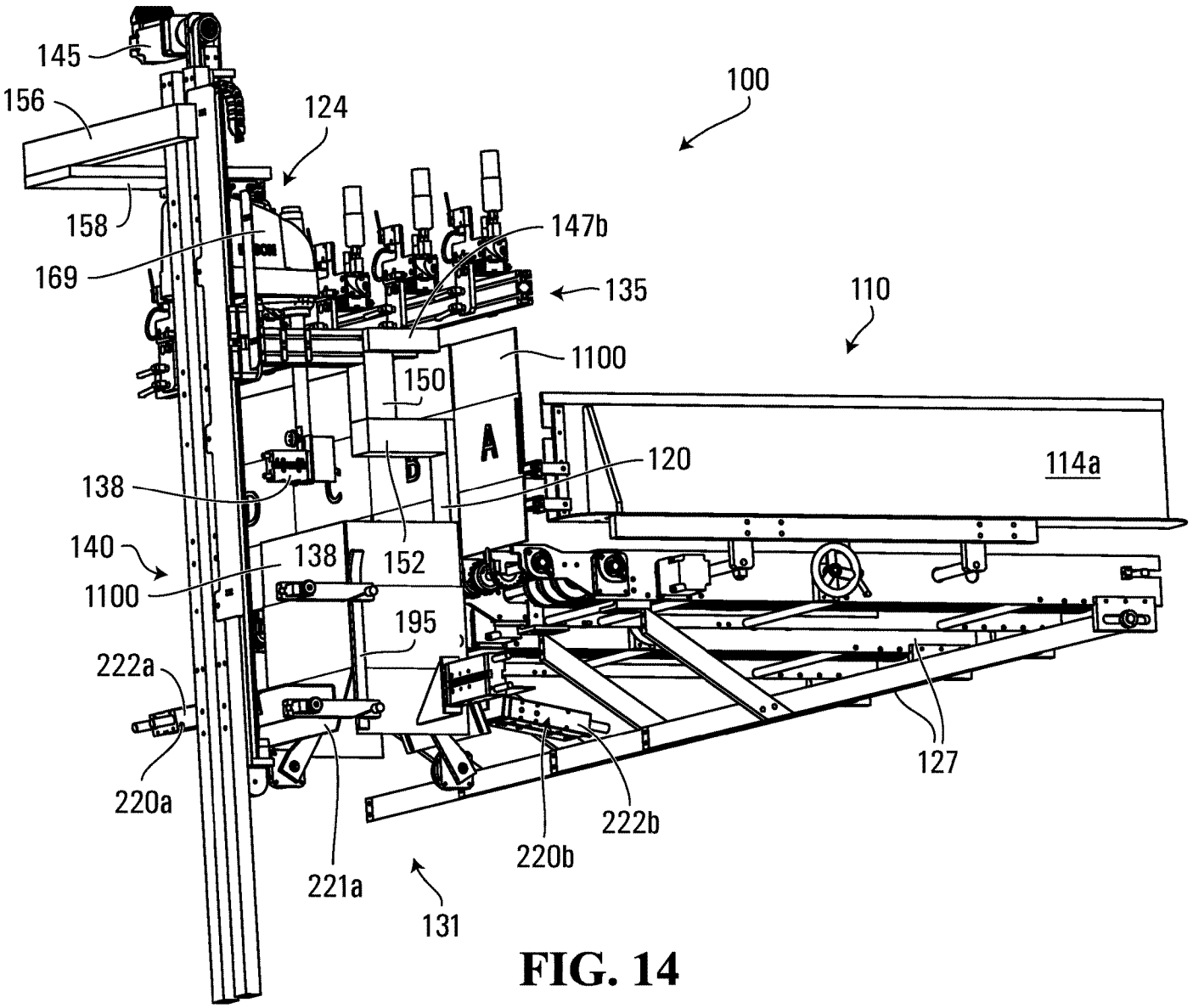
FIG. 14 is a lower, right front perspective view of the system of FIG. 2 in a the sixth operational position.
Figure 15:
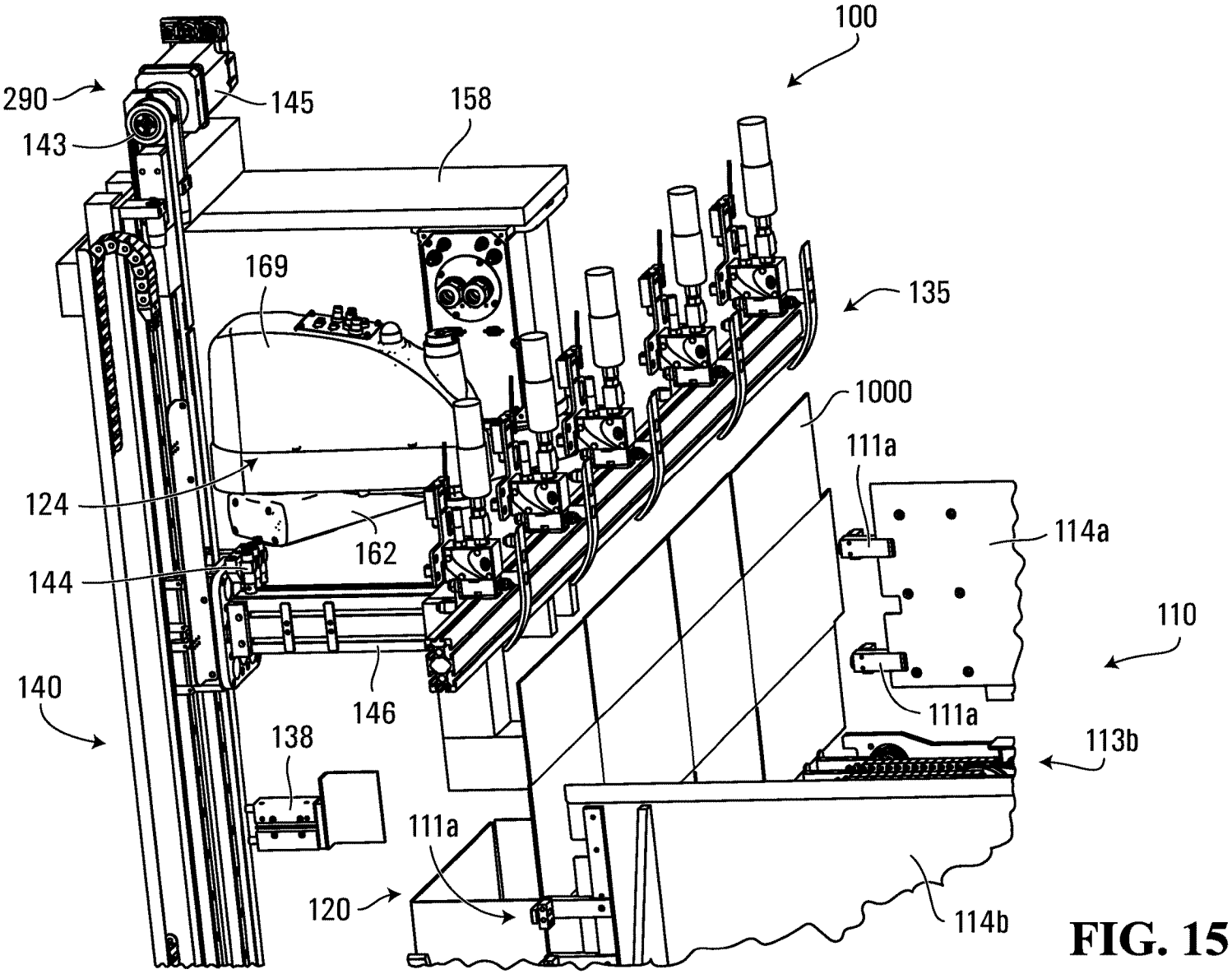
FIG. 15 is an upper, right front perspective view of an upper portion of the system of FIG. 2 in the sixth operational position.

With particular reference to FIGS. 13 and 14, third panel rotating apparatus 131 may include opposed longitudinally oriented pivoting fingers 200*a*, 200*b*, that may pivot within a desired range outwards and inwards about respective pivots 201*a*, 201*b* about transversely oriented pivot axes. The pivoting movement of fingers 200*a*, 200*b* may be caused by actuator motors 202*a*, 202*b* controlled in operation by PLC 132.

Operation of fingers 200*a*, 200*b* can rotate outwards lower major panels F and H about their respective fold lines with respective major side panels D and B.

Third panel rotating apparatus 131 may also include opposed transversely oriented plough devices 210*a*, 210*b*, that have plough plates 211*a*, 211*b* that may be moved transversely in intermittent, reciprocating movement by actuating double acting pneumatic cylinders 212*a*, 212*a*, with movable piston arms, within a desired range outwards and inwards. The transverse movement of plough devices 210*a*, 210*b* may be controlled by valves in air distribution unit 227 (not shown) that selectively deliver pressurized air through hoses (not shown) to double acting pneumatic cylinders 212*a*, 212*b*, under the control of PLC 132.

Third panel rotating apparatus 131 may also include opposed longitudinally oriented plough devices 220*a*, 220*b*, that have plough plates 221*a*, 221*b* that may be moved transversely in intermittent, reciprocating movement by double acting pneumatic cylinders 222*a*, 222*a*, with movable piston arms, within a desired range outwards and inwards. The transverse reciprocating intermittent movement of plough devices 220*a*, 220*b* may be controlled by valves (not shown) that selectively deliver pressurized air through hoses (not shown) to pneumatic cylinders 222*a*, 222*b*, that may be supplied by pressurized air controlled by valves in air distribution unit 227, under the control of PLC 132.

The aforementioned components of third panel rotating apparatus 131 may be mounted to a frame (not shown for simplicity). In some embodiments, the horizontal longitudinal/transverse positions and possibly also their vertical positions may be adjustable on the frame to enable the components of third panel rotating apparatus 131 to accommodate different sized/configured mandrel apparatuses 120 and corresponding different size and configuration of case blanks and their lower panels F, G, H, J. The adjustment may be made by hand or by servo motors operating moving support components under control of PLC 132. However, it is preferred if third panel rotating apparatus is configured so that it can accommodate the processing of several different size/configurations of mandrels and case blanks without having to adjust the positions of their components, to be more easily able to facilitate change-over from one mandrel/case blank size and configuration to another.

The next component of system 100 to be described in detail is fourth panel rotating apparatus 138. Fourth panel rotating apparatus 138 can co-operate with first panel operating apparatus 134 and second panel operating apparatus 130 to form a tubular shaped blank. Fourth panel rotating apparatus 138 is operable to rotate inwards 90 degrees, sealing panel E of case blank 1000 relative to major side wall panel D, from the position shown in FIG. 7 to the position shown in FIG. 9. Fourth panel rotating apparatus 138 may be mounted to a supporting frame component (not shown) and include a plough device 230 having plough plate 231 that may be moved longitudinally in intermittent, reciprocating movement by a double acting pneumatic cylinder 232, with a movable piston arm, within a desired range outwards and inwards. The longitudinal reciprocating intermittent movement of plough device 220 may be controlled by valves (not shown) in air distribution unit 227 that deliver pressurized air through hoses (not shown) to pneumatic cylinder 232 under the control of PLC 132.

Pneumatic cylinders 211*a*, 212*b*, 222*a*, 222*b*, and 232 may each be a conventional pneumatic reciprocating cylinder with piston arms that are operable to move in a reciprocal movement between fully extended positions and fully retracted position. This reciprocating motion can be achieved in known ways such as for example, by using a double acting cylinder, which can for example, channel compressed air to two different chambers which in turn provides interchanging forward and backward acting forces on the piston arms of the cylinders. Pneumatic cylinders 211*a*, 212*b*, 222*a*, 222*b*, and 232 may for example be one of many different types made by Festo.

Compressed air may be delivered to pneumatic cylinders 211*a*, 212*b*, 222*a*, 222*b*, and 232 by hoses (not shown) in communication with a source of pressurized air through air distribution unit 227. To channel the compressed air appropriately, valves (not shown) in distribution unit 227 (FIG. 5) can be driven between open and closed positions by solenoids responsive to signals from PLC 132. The valves could be located proximate the pneumatic cylinders 211*a*, 212*b*, 222*a*, 222*b*, and 232 or be disposed elsewhere. Electrical communication lines carrying signals to and from PLC 132 could also be provided to operate the valves.

It should also be noted that during the downward vertical movement of a case blank 1000 secured to mandrel 137, a compression rail 195 supported on part 140*a* of vertical support frame 140 (FIG. 3) is configured and positioned to apply pressure to the panels A and E pushing against the outward surface of side wall 122*a* of mandrel 137, to ensure appropriate sealing of panels A and E with the adhesive.

In some embodiments, the longitudinal/transverse position and possibly also the vertical position of compression rail 195 may be adjustable on the frame 140 to enable the components of third panel rotating apparatus 131 to accommodate different sized/configured mandrel apparatuses 120 and corresponding different size and configuration of case blanks and their lower panels F, G, H, J. The adjustment may be made by hand or by servo motors operating moving support components under control of PLC 132.

Figure 22:
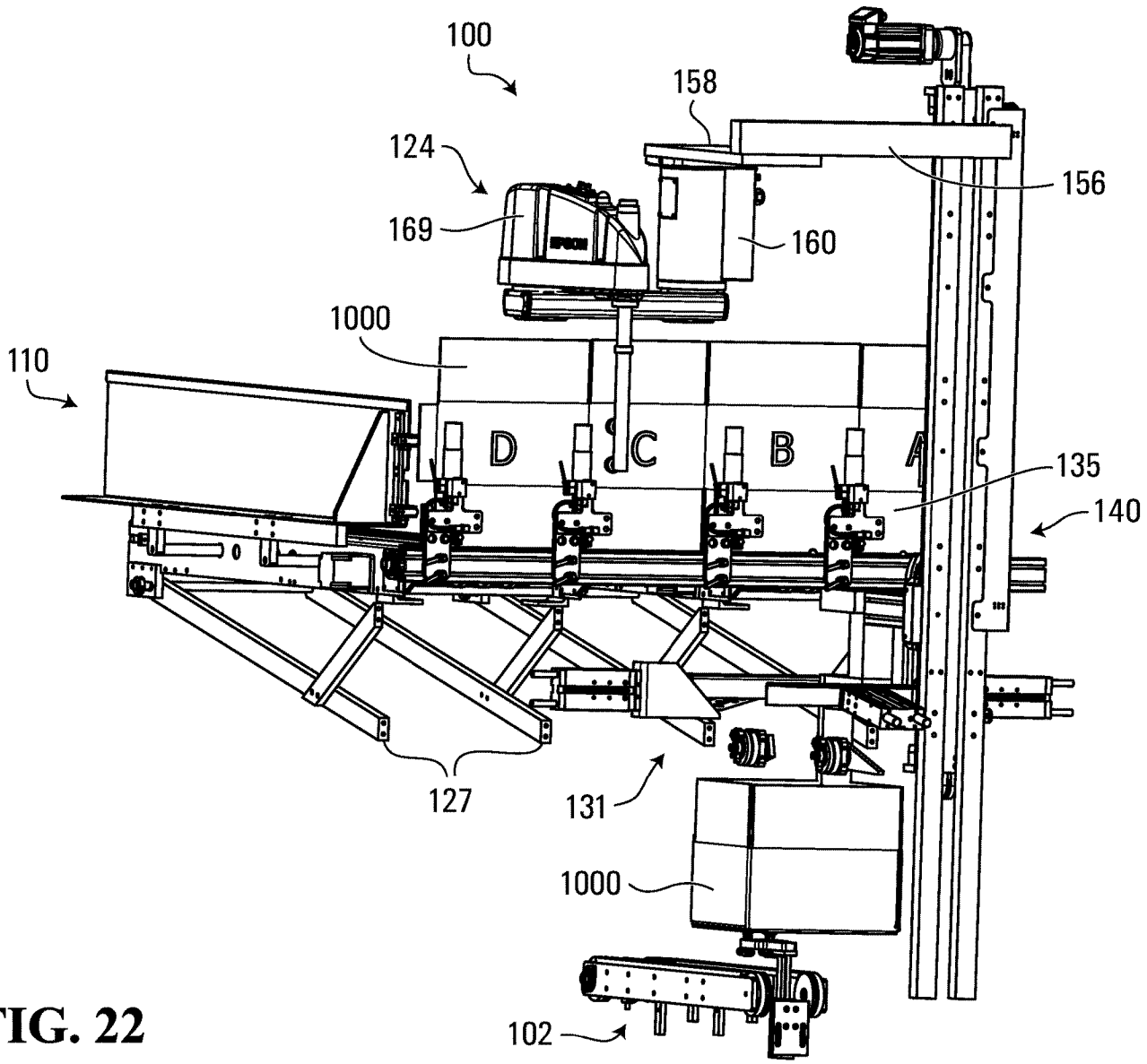
FIG. 22 is an upper, left front perspective view of the system of FIG. 2 in a ninth operational position.

With reference to FIGS. 3, 21 and 22, case discharge conveyor 102 (for simplicity not shown in the other Figures) may be provided with spaced continuous conveyor belts 105 driven in a conventional manner by a drive motor under control of PLC 132 and configured to support and move open topped cases formed from case blanks 1000 by case forming system 100. A lift platform 104 may have upward facing suction cups 103. Lift platform 104 may be employed to assist in "handing off" a formed case from mandrel 137 to case conveyor 102. The lift platform 104 may be vertically movable upwards and downwards and along with suction cups 103 and corresponding suction cup valves (not shown) be controlled by valves and PLC 132. Lift platform 104 may move suctions cups 103 to engage and hold the blank (which has become a formed case) in position during disengagement of the mandrel 137 from the formed case. Then lift platform 104 may be lowered to position the formed case onto the case conveyor for discharge for filling, packing and top sealing. Suction cups 103 may be deactivated allowing case conveyor 102 to move the formed case from case forming system 100.

Various components of system 100 such as mandrel apparatus 120 including mandrel 137 and the various support members 155, 154, 152 and 150; first, second, third and fourth panel rotating apparatuses; robot support members 156 and 158; and support frame 140, may all be made of any suitable materials such as for example aluminium or steel.

Also a least some of the various components of system 100 mandrel support members 155, 154, 152 and 150 may be integrally formed or interconnected to each other by known techniques. For example if the components are made of a suitable metal or plastic, welding techniques can be employed. Also, the use of screws and/or nut and bolts may be employed.

The operation of system 100 will now be described in detail. A plurality of case blanks 1000 may be presented in a vertically and transversely oriented stacked arrangement and held in magazine 110. Magazine 110 may be operated such that the front generally vertically and transversely oriented surface of panel B of the forward-most blank 1000 will be at a pick-up location that will be just in contact with, or be a very short distance spaced from (e.g. within ¼ inch), the inward surface of rear wall 121*b* of mandrel 137 when the mandrel is appropriately vertically positioned.

The start position of mandrel 137 will typically be a vertically downward position, where the adhesive ejection nozzles 153 (FIG. 8) of adhesive applicators 133*a-e* are also below the level of the bottom edge of case blank 1000 held in magazine 110). Then, under control of PLC 132, vertical movement apparatus 136 can cause mandrel apparatus 120 with adhesive applicator apparatus 135 connected thereto, to move vertically upwards an appropriate amount at an appropriate velocity. In doing so, ejection nozzles 153 of adhesive applicators 133*a-e* can be operated by PLC 132 over a suitable range of upward movement , to apply adhesive to respective panels A, H and F. PLC 132 is able to activate adhesive applicators 133*a-e* at a suitable vertical location because of signals received from the encoder associated with servo drive motor 145. Adhesive applicators 133*a-e* will then apply adhesive lines 1001, 1002, 1003, 1004 and 1005 as shown in FIG. 1, to the outward facing surface of the front case blank 1000 in magazine 110, while the front case blank is in the pick-up position.

Next, under control of PLC 132, magazine 110 and first panel rotating apparatus 124 may co-operate so that suction cups 168 engage and hold the outward facing surface of major side wall panel D, and pull panels N, D and F from clip mechanism 111*a*, while clip mechanisms 111*c* holding panels G/C/M and J, B/L in the pick-up position in the magazine, and clip mechanisms 111*b*, 111*d* hold panels J/A/K also in the pick-up positon in the magazine.

First panel rotating apparatus 124 can then start to rotate major side wall panel D along with panels E, N, F and also pull panels M, C and G from retaining clips 111*c* to also rotate them, 90 degrees in a counter clockwise direction about the vertical fold line between side wall panels B and C, to the configuration shown in FIG. 5, where minor side wall panel C is held against the outer surface of mandrel side wall 122*b* (see also step 1000(3) in FIGS. 2A and 2B).

In the next folding step, PLC 132 causes first panel rotating apparatus 124 to rotate side wall panel D and its respective adjacent upper and lower major panels N and F, and connected sealing panel E, together counter clockwise 90 degrees about the vertical fold line between side wall panels D and C, to the configuration shown in FIG. 7, where major side wall panel D is held against the outer surface of mandrel side wall 121*a*, as end effector 166 with suction cups 168 pass through slot 123 (see also step 1000(4) in FIGS. 2A and 2B).

In the next folding step, PLC 132 causes plough plate 231 of fourth panel rotating apparatus 138 to extend causing sealing panel E to be rotated counter clockwise 90 degrees about the vertical fold line between sealing panel E and side wall panel D to the configuration shown in FIG. 9 (see also step 1000(5) in FIGS. 2A and 2B).

In the next folding step, PLC 132 causes second panel rotating apparatus 130 to be activated by activating pneumatic cylinder 180 to extend piston arm 181 so that suction cups 183 can engage and hold the outward facing surface of side wall panel A. PLC 132 can then cause pneumatic cylinder 180 to retract piston arm 181, causing suction cup arm 182 to rotate about its pivot 184, thus causing side wall panel A, along with and its respective adjacent upper and lower minor panels K and J, to be all rotated together clockwise 90 degrees about the fold line between side wall panels A and B, to the configuration shown in FIG. 11. But as panel A is approaching the position shown in FIG. 11, where a large portion of minor side wall panel A is held against the outer surface of mandrel side wall 122*a*, PLC 132 causes plough plate 231 of fourth panel rotating apparatus 138 to retract allowing an outward facing surface of sealing panel E to engage with an edge portion of the inward facing surface of minor side wall panel A, and wherein the surface of sealing panel E becomes connected to side wall panel A as a result of adhesive line 1005 bonding the two panels together. Thus sealing panel E in combination with adhesive line 1005 provides a connection mechanism for connecting the free vertical side edge portions of blank 1000. However, in other example embodiments, other connection mechanisms may be provided to connect the free vertical side edge portions to secure the blank in a generally tubular configuration.

Figure 12:
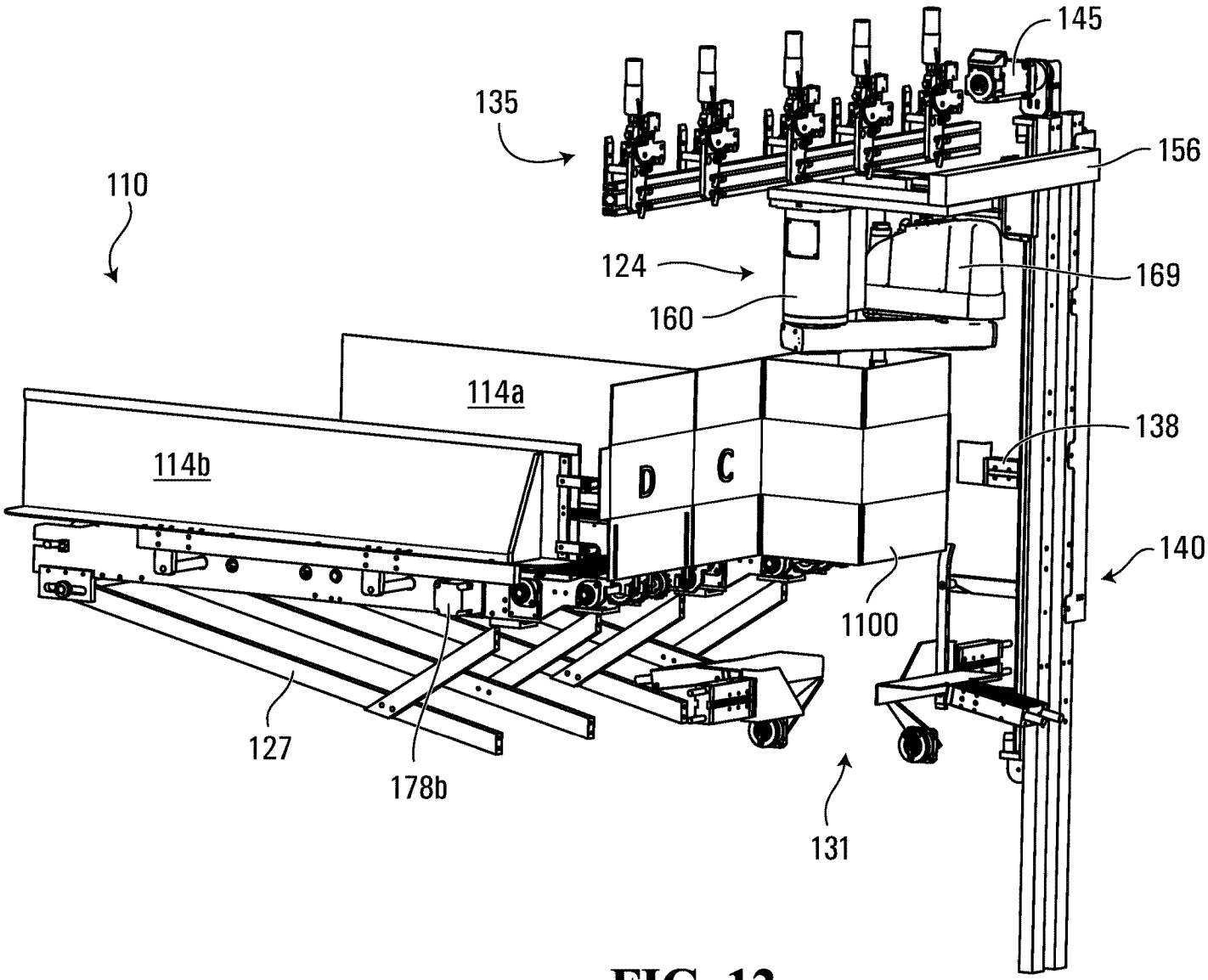
FIG. 12 is an upper, left front perspective view of the system of FIG. 2 in the fifth operational position.

The result at the end of this step is that blank 1000 is formed into a generally rectangular tubular shape, such that panels A-E have been wrapped about a centrally positioned mandrel 137 as shown in FIG. 12 (see also step 1000(6) in FIGS. 2A and 2B). The case blank 1000 is being held on the mandrel by suction cups 183 of second rotating apparatus 130 and suction cups 168 on end effector 168 which are engaged on what have become the inner surfaces of the tubular shaped case blank. The result is a very efficient sequence of movements to extract a flatly configured blank held in magazine 110 and form it into a tubular shaped blank.

The remaining steps carried out by case forming system 100 as illustrated in FIGS. 13 to 23 show a sequence of steps that may be utilized to close and seal the lower major and minor panels F, H, and G, J to close and seal the bottom of the case blank 1000 to form an RSC case with an open top and deposit the formed case onto case discharge conveyor 102. However, alternate bottom panel closing systems may be employed in other embodiments.

In the next step of carton forming system 100 as disclosed, PLC 132 de-activates suction cups 168 so that only suction cups 183 hold case blank 1000 on mandrel 137. Thereafter, PLC 132 will activate vertical mandrel movement apparatus 136 and in particular servo motor 145 to move carriage 144 and thus mandrel 137 vertically downward with case blank 1000 secured thereto, to a lower panel folding and sealing position shown in FIG. 13 (see also step 1000(7) in FIGS. 2A and 2B). Clip mechanisms 111*c* (FIG. 5) holding panels H, B and L, in magazine 110 will allow for the release of panels H, B and L to allow the remaining portion of case blank 1000 to be removed from being held by magazine 110 and moved vertically downward once the case blank 1000 at the front of the stack is engaged by second panel rotating apparatus 130 and mandrel 137 moves vertically downwards. Additionally, PLC 132 will cause the suction force at suction cups 168 on effector 166 of first rotating panel apparatus 124 to be curtailed, thus allowing the case blank 1000 formed around mandrel 137 to move vertically away from suction cups 168. The tubular formed case blank 1000 may be held in contact for movement with mandrel 137 by surface friction forces between the blank and the exterior surface of mandrel 137 and by the operation of suction force exerted by suction cups 183 of second panel folding apparatus 130.

At the vertical position of mandrel 137 shown in FIG. 13, PLC 132 activates motors 202*a*, 202*b* to rotate fingers 200*a*, 200*b* outwards, so that they engage respective lower major panels F and H may be rotated outwards, about their respective fold lines with respective major side panels D and B. The amount of rotation is sufficient to ensure that there will be no interference with the subsequent inward rotation of lower minor panels G and J and no contact is made with adhesive that is on inward surfaces of lower major panels F and H, such as respective adhesive lines 1001, 1002 and 1003, 1004 (FIG. 1).

Figure 16:
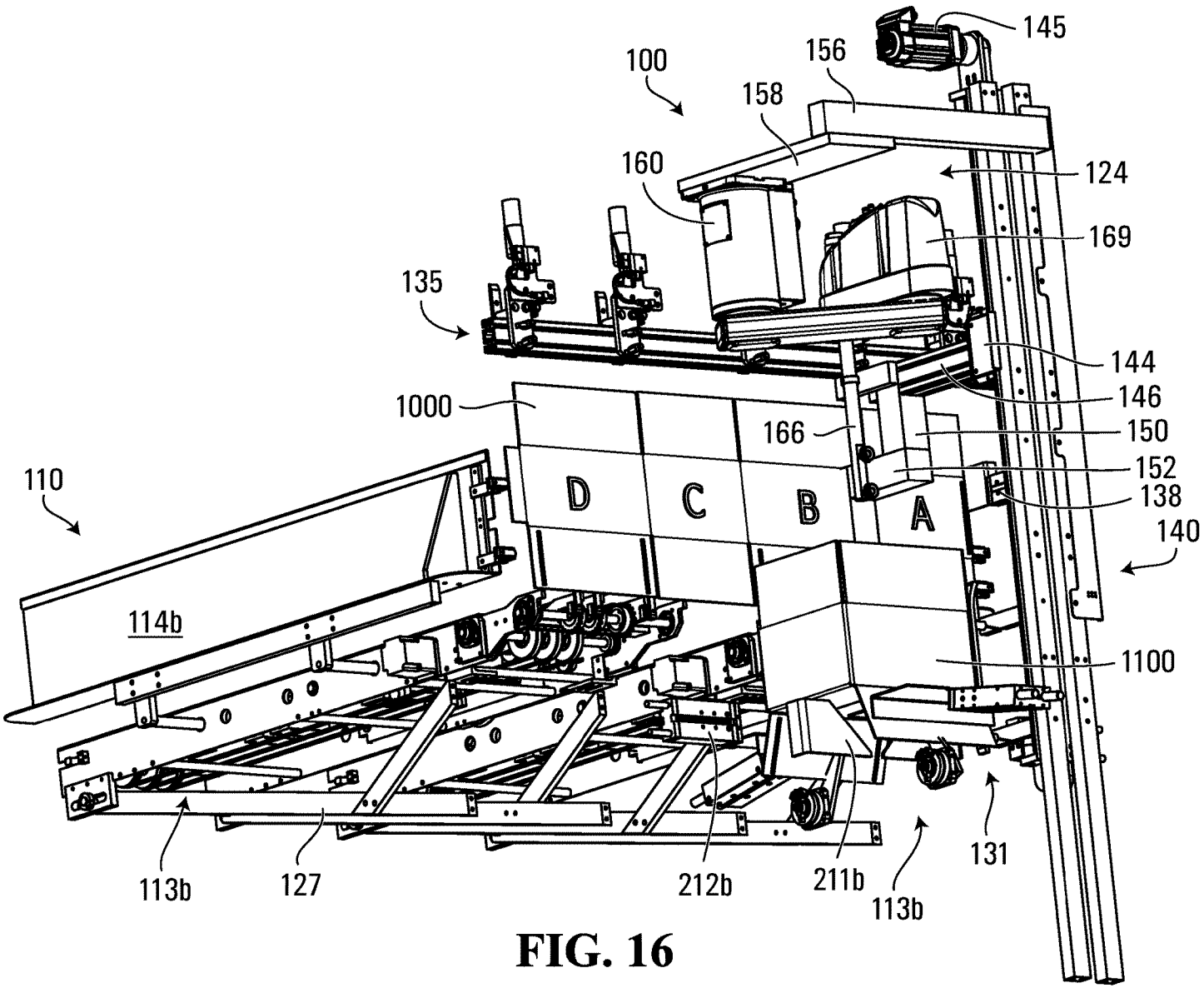
FIG. 16 is an lower, left front perspective view of the system of FIG. 2 in a seventh operational position.
Figure 17:
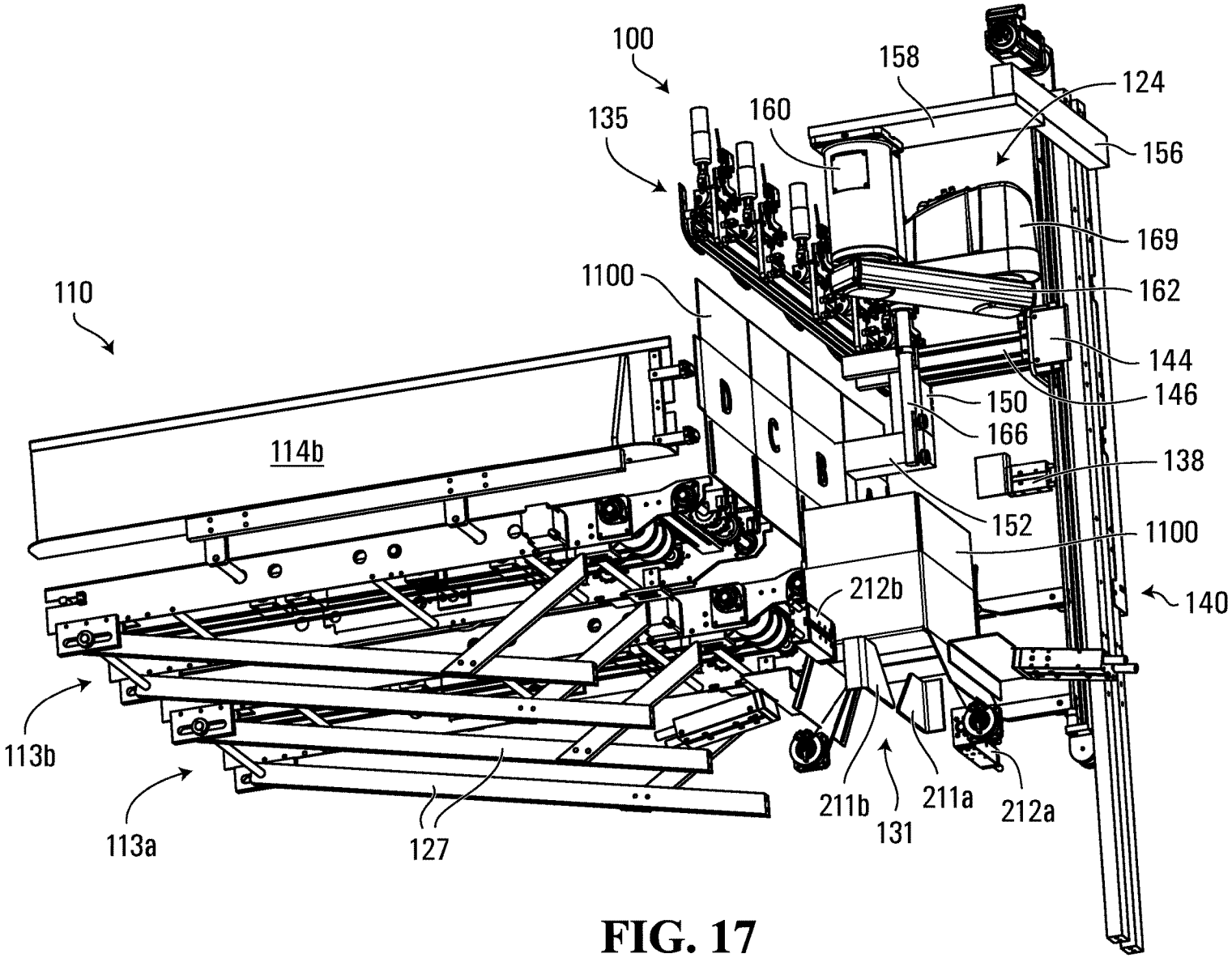
FIG. 17 is a lower, left side perspective view of the system of FIG. 2 in the seventh operational position.

Next, with reference to FIGS. 16 and 17, PLC 132 activates pneumatic cylinders 212*a*, 212*b* to cause plough plates 211*a*, 211*b* to be extended transversely inwards to rotate lower minor panels G and J respectively inwards, preferably about 90 degrees, about their respective fold lines with respective major side wall panels C and A.

Figure 18:
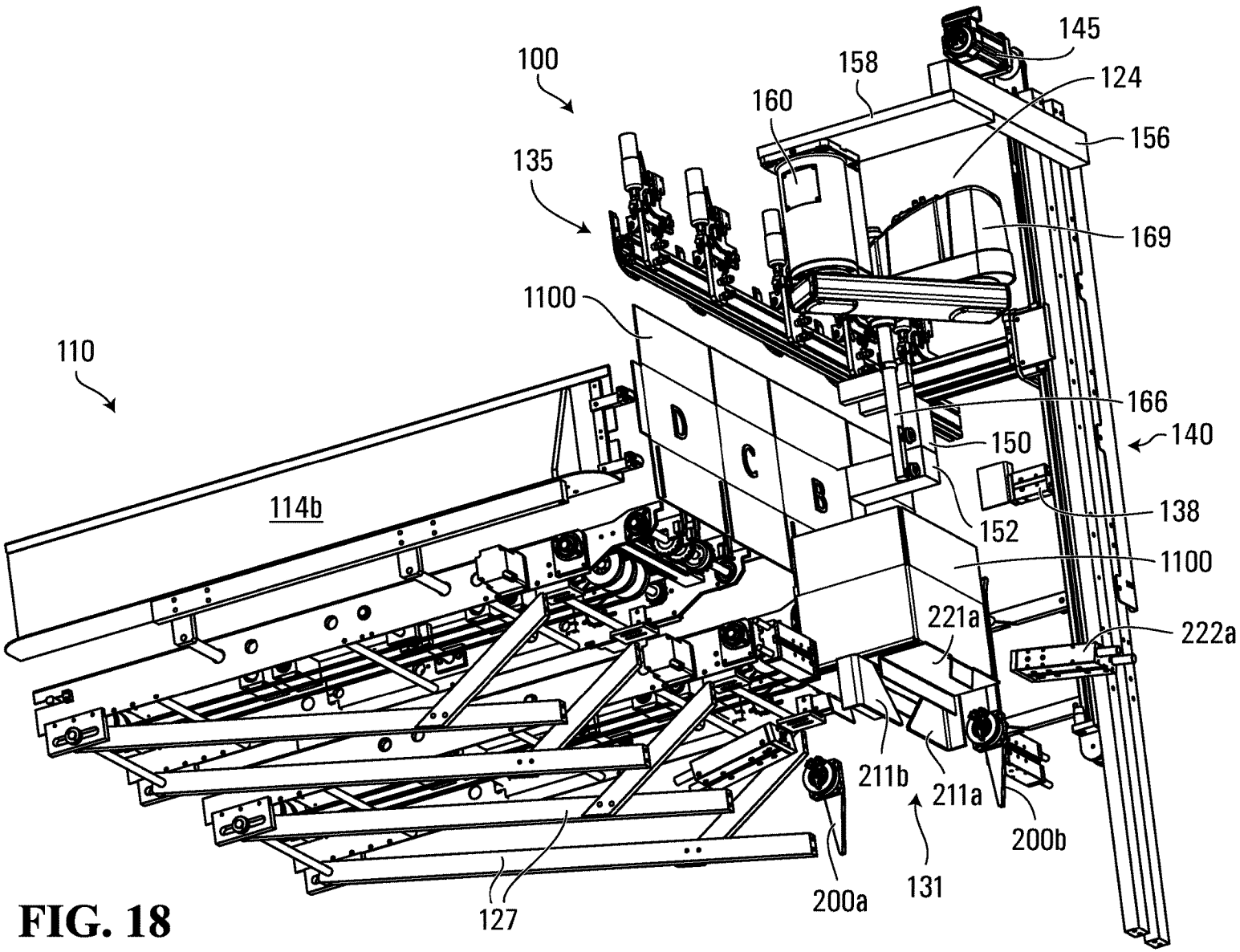
FIG. 18 is a lower, left front perspective view of the system of FIG. 2 in an eighth operational position.

Next with reference to FIG. 18, PLC 132 activates motors 202*a*, 202*b* to rotate fingers 200*a*, 200*b* inwards it a vertically downward position, so that they no longer engage with lower major panels F and H, so that lower major panels F and H may be rotated inwards, about their respective fold lines with respective major side panels D and B. The amount of rotation of fingers 200*a*, 200*b* is sufficient to ensure that there will be no interference with the subsequent inward rotation of lower major panels F and H.

Also as shown in FIG. 18 and in FIG. 19, next PLC 132 will cause pneumatic cylinders 222*a*, 222*b* to be operated to cause plough plates 221*a*, 221*b* to be extended transversely inwards to rotate lower major panels F and H respectively inwards, preferably about 90 degrees, about their respective fold lines with respective major side wall panels D and B. The amount of rotation is sufficient to ensure that there will be contact between inner surfaces of lower major panels of lower major panels F and H and the outer surfaces of lower minor panels G and J such that the lines of adhesive 1001, 1002 on the inward surface of panel F, and lines of adhesive 1003, 1004 on inward surface of panel H will cause panels F to fixedly connect with both panels G and J, and cause panel H to fixedly connect with both panels G and J such that blank 1000 is formed into a generally rectangular shaped, open top case (see also step 1000(9) in FIGS. 2A and 2B). There is a sufficient gap present between lower major panels F and H when they are rotated to permit the plough plates 211*a*, 211*b* to remain in position to hold panels J and G in a suitable orientation for engagement with panels F and H.

Next with reference to FIG. 20, PLC 132 activates pneumatic cylinders 212*a*, 212*b* to cause plough plates 211*a*, 211*b* to retract transversely outwards. Next PLC 132 activates activating cylinder 222*a*, 222*b* to cause plough plates 221*a*, 221*b* to be retracted transversely outwards as shown in FIG. 21.

Lift platform 104 may be operated along with upward facing suction cups 103 to assist in "handing off" a formed case from mandrel 137 to case conveyor 102. The lift platform 104 may be vertically movable upwards and along with suction cups 103 and corresponding suction cup valves (not shown) be controlled by valves and PLC 132 may be operated to engage the bottom of the case. PLC 132 may also cause suction cups 183 to be deactivated, thus releasing the case from engagement with mandrel 137. Mandrel 137 may then be moved upwards back to the start position. Lift platform 104 may move suctions cups 103 to engage and hold the blank (which has become a formed case) in position during disengagement of the mandrel 137 from the formed case. Then lift platform 104 may be lowered to position the formed case onto the case conveyor for discharge for filling, packing and top sealing. Suction cups 103 may then be deactivated allowing case conveyor 102 to move the formed case from case forming system 100.

The formed, open top case, may be moved away to another location, and may subsequently be filled with one or more items/other cases and thereafter the upper major panels N and L, may be folded along with upper minor panels M and K, to close and seal the completed case.

The foregoing cycle can be repeated multiple times to form multiple cases. It is anticipated that cartons may be formed at a rate of in the range of about 10 to about 50 cases per minute depending on the overall dimensions of the case and the size of the machine but other rates of operation are also possible and contemplated. In general, the smaller the case blank that is being processed, the faster will be the case forming rates.

As discussed above, when it is desired to change the type/configuration of case to be formed, using a different type/configuration of case blank 1000, case forming system 100 can be quite easily modified. For example, one mandrel 137 can be replaced by a differently configured mandrel. PLC 132 may be pre-programmed to make adjustments to the operation of other components in particular to the operation of the first, third and fourth panel rotating apparatuses and the position of compression rail 195. Additionally, it may in some circumstances be necessary to adjust the positioning and movements of some components of third panel rotating apparatus 131 such as fingers 200*a*, 200*b*; plough devices 210*a*, 210*b*, and their plough plates 211*a*, 211*b*; and plough devices 220*a*, 220*b*, and their plough plates 221*a*, 221*b*.

Many variations of the embodiments described above are possible. For example, now with reference to FIG. 26 another alternate form of case blank 2000 that may be configured and formed in any similar way to case blank 1000, except that case blank 2000 has panel E adjoined to the outer edge of minor side wall panel A, instead of to major side wall panel D. Also, a line adhesive 2005 is formed on a surface of panel D instead of on sealing panel E.

Figure 27:
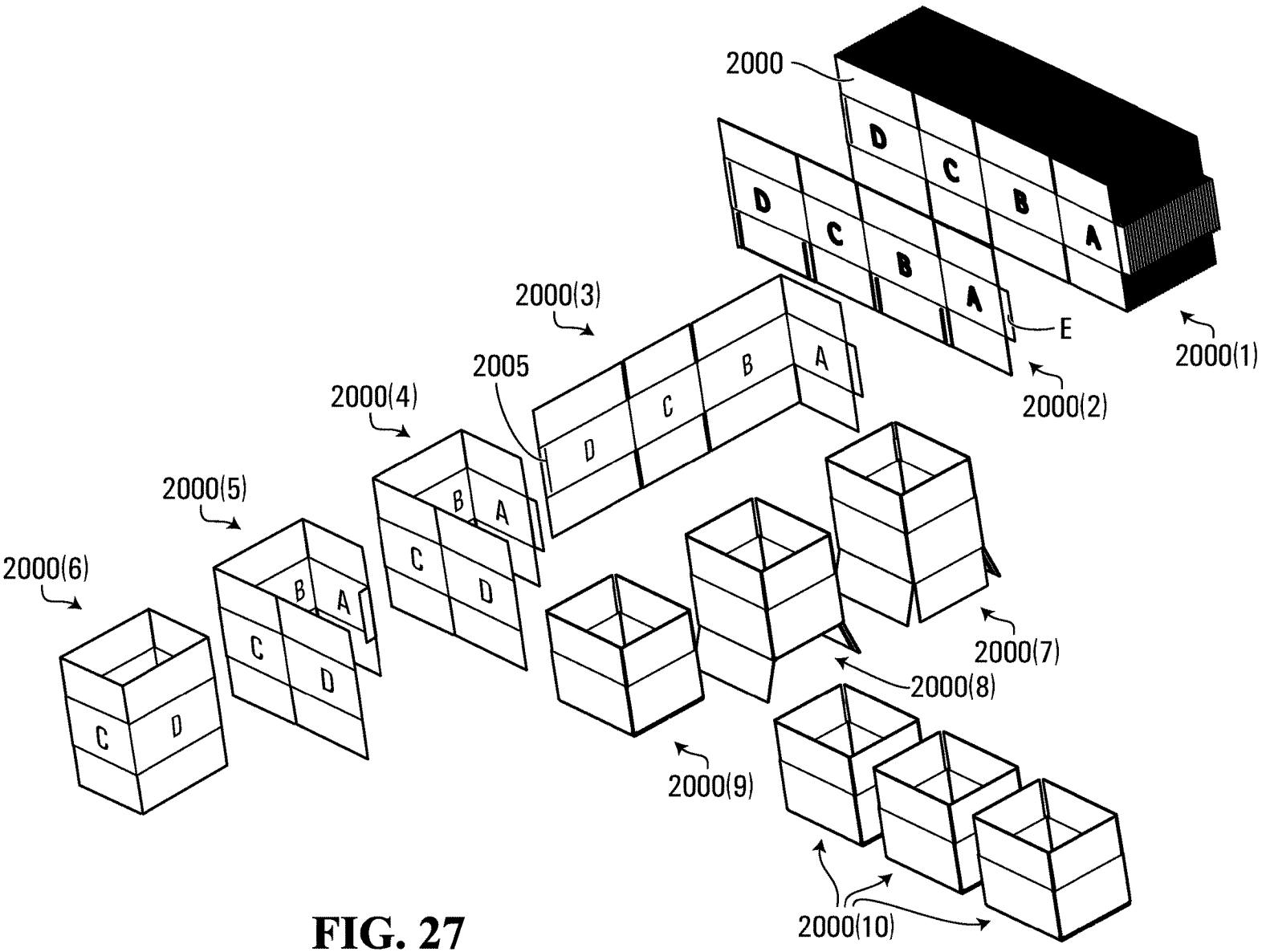
FIG. 27 is schematic view of an alternate example method of forming a case from a case blank.

With reference now to FIG. 27, an example sequence of steps 2000(1) to 2000(10) are shown of folding and sealing a flat blank 2000 to from an open top case that is suitable for top loading of items/other cases.

A plurality of case blanks 2000 may be presented in a stacked arrangement with the blanks each configured in a generally flat and planar configuration [step 2000(1)]. A particular individual case blank 2000 may be identified at/selected from the front of the stack of blanks for processing [step 2000(2)]. In a first folding step 2000(3) side wall panel B along with its respective adjacent upper and lower minor panels L and H, along with minor side wall panel C and its respective adjacent upper and lower minor panels M and G, along with major side wall panel D and its respective adjacent upper and lower major panels N and F, can all be rotated from the orientation shown at 2000(2), so that panel B is rotated 90 degrees in a counter clockwise direction about the vertically oriented fold line between side wall panels A and B, to the configuration as shown at step 2000(3). In the next folding step 2000(4), minor side wall panel C and its respective adjacent upper and lower minor panels M and G, along with major side wall panel D and its respective adjacent upper and lower major panels N and F, are all rotated counter clockwise so that panel C is rotated 90 degrees about the vertically oriented fold line between side wall panels B and C, to the configuration shown in FIG. 27 at step 2000(4).

In folding step 2000(5), sealing panel E is rotated clockwise 90 degrees about the vertically oriented fold line between panel E and panel A. This step can be done in any time prior to the next step 2000(6). In the next step 2000(6) major side wall panel D and its respective adjacent upper and lower major panels N and F are rotated counter clockwise 90 degrees about the vertically oriented fold line between side wall panel C and side wall panel D to the configuration shown at 2000(5). In this folding step the adhesive line 2005 on the inner surface of panel D will engage with the outward facing surface of sealing panel E such that sealing panel E may engage and become permanently connected to major side wall panel D. The result at the end of this step, as depicted at 2000(6), case blank 2000 is formed into a generally rectangular shaped tube. While not shown in FIG. 27, folding steps from case blank orientations depicted at 2000(3) to 2000(6) may be carried out in such manner the panels are wrapped about a centrally positioned mandrel, as is described hereinafter.

The remaining steps to configurations shown from 2000 (7) to 2000(10) may be substantially the same as the steps 1000(7) to 1000(10) as illustrated in FIGS. 2A and 2B and represent a sequence of steps that may be utilized to close and seal the lower major and minor panels, F, H and G, J respectively to close and seal the bottom of the case blank 2000 to form an RSC case with an open top.

Now with reference to FIGS. 28-32, a case system 2100 is disclosed which may be substantially the same as case forming system 100 except as varied as shown in schematic illustrations in FIGS. 28-32 with reference to the following description. In overview, a first panel rotating apparatus 2134 is positioned relative to a stack of blanks (stack not shown) like blanks 2000 held in a magazine 2110 (like magazine 110), with the mandrel 2137 when positioned at a pick-up positon to pick-up the front blank in the stack, being located transversely and vertically in front of panel A of case blank 2000. In this way, first panel rotating apparatus 2134 is able to wrap each of panels B, C and D around corresponding side walls of mandrel 2137, and engage with sealing panel E, which may be rotated clockwise 90 degrees about the vertical fold line with panel E. Thus by use of just a first panel rotating system 2134 and a second panel rotating apparatus 2138, a generally flat case blank 2000 held in magazine 2100 can be formed into a tubular shaped blank around mandrel 2137. Thereafter bottom panels can be closed with another panel rotating apparatus which may be like third panel rotating apparatus 131, as described above in relation to system 100, to form an open top, case from case blank 2000. In some other embodiments only a single panel rotating apparatus may be required to wrap the blank around a mandrel.

Figure 26:
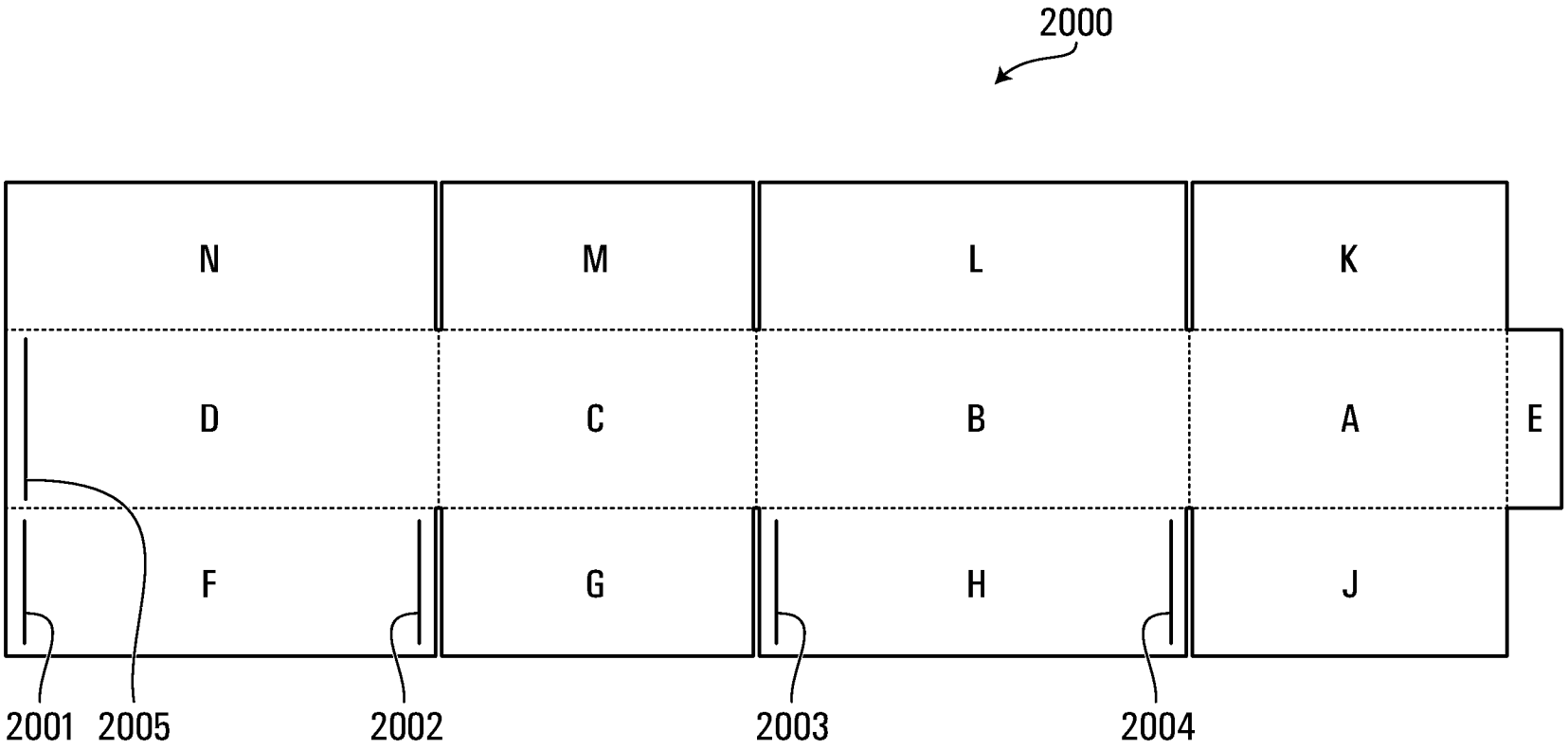
FIG. 26 is a top plan view of an alternate blank.
Figure 28:
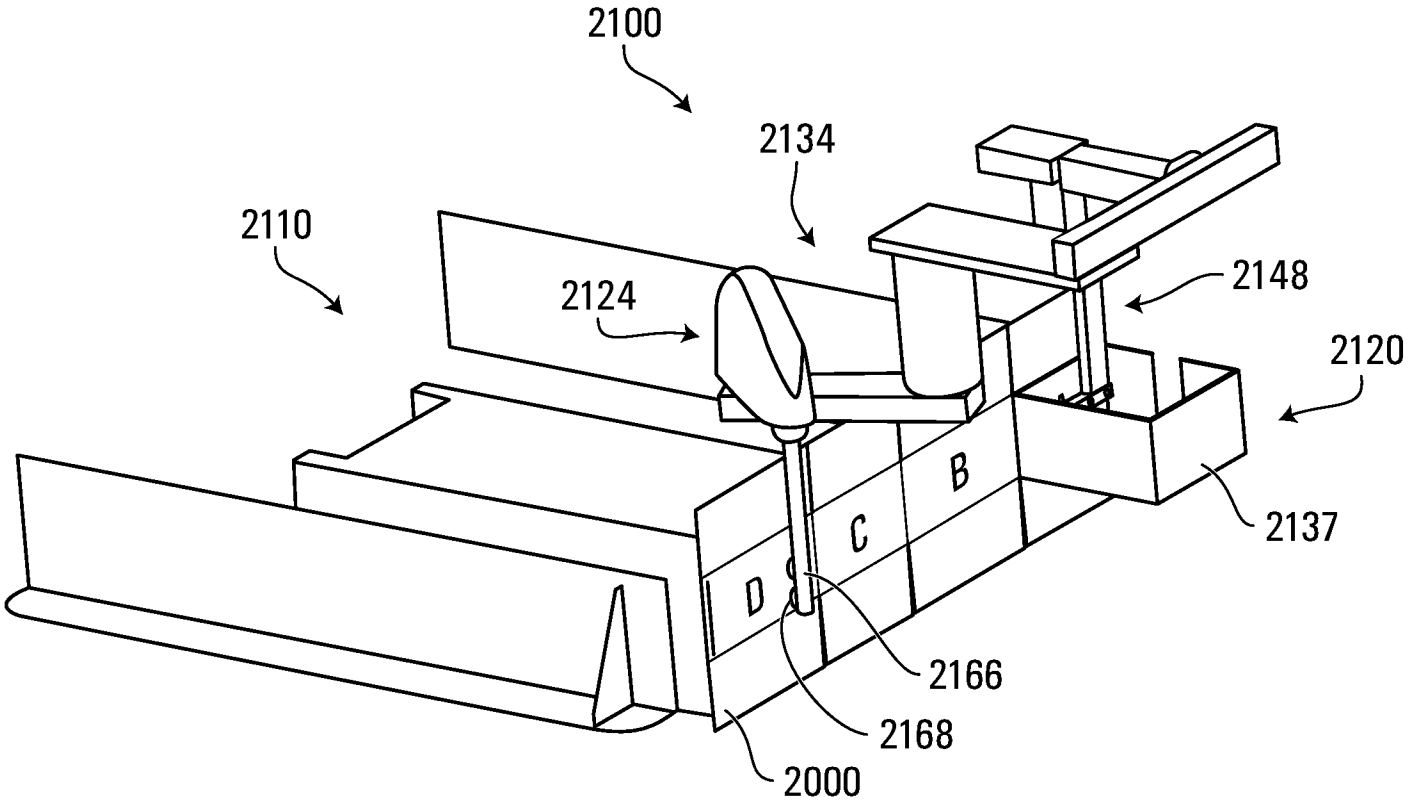
FIG. 28 is an upper, left front perspective schematic view of an alternate case forming system in a first operational position.
Figure 29:
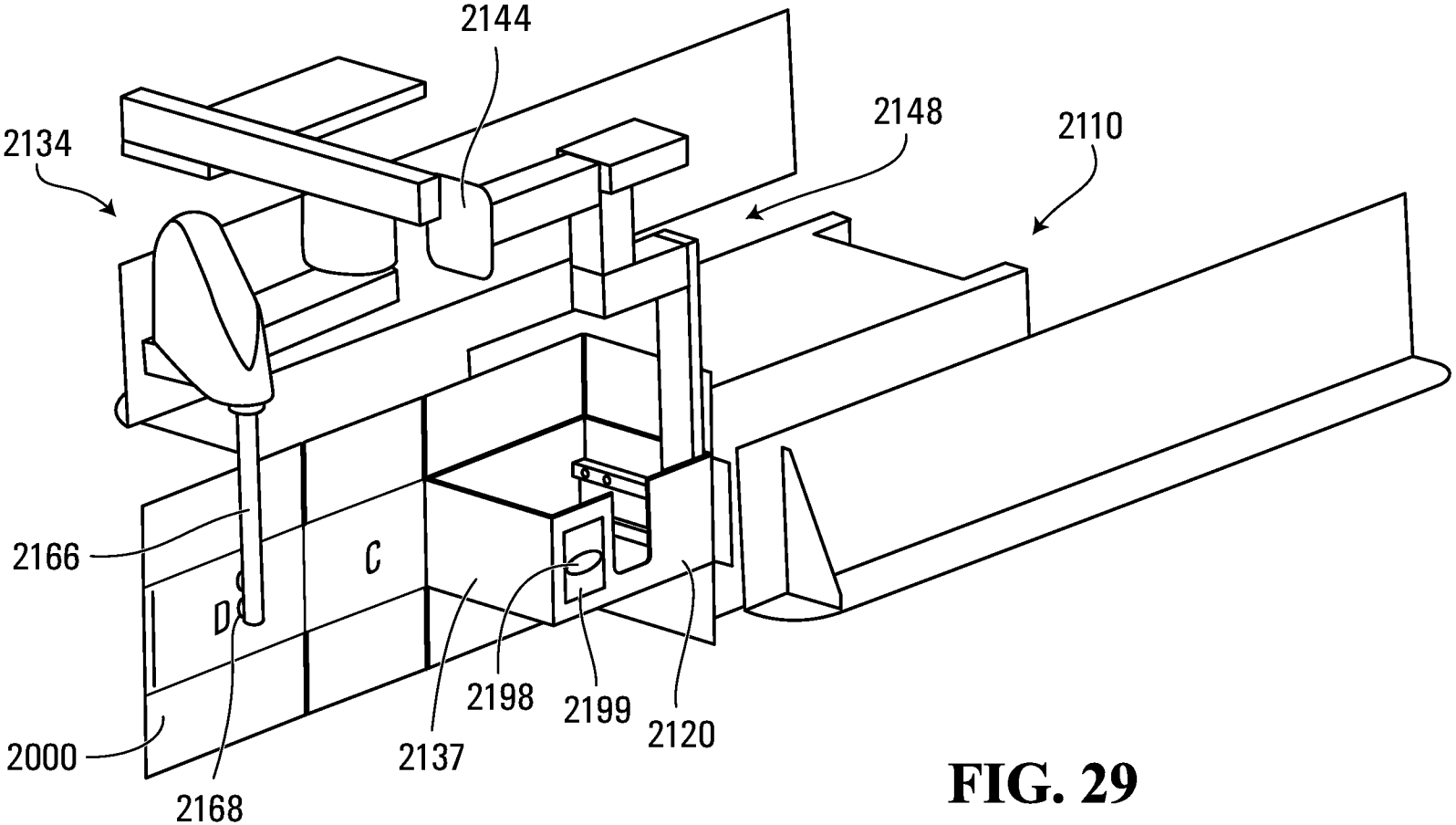
FIG. 29 is an upper, right front perspective view of the case forming system of FIG. 28, in a second operational position.

System 2100 may include a magazine 2110 like magazine 110 adapted to hold a plurality of case blanks 2000 in a substantially flat orientation such as is shown in FIG. 28 (only one case blank 2000 is shown for clarity). Case blanks 2000 may generally be like blanks 1000, except with respect to an alternative positioning of sealing panel E, as shown in FIG. 26. System 2000 may also include a mandrel apparatus 2120 (including a mandrel 2137) and a panel rotating sub-system 2134 (designated in FIG. 4).

Panel rotating sub-system 2134 may include a first panel rotating apparatus 2124 which may be generally like panel rotating apparatus 124. A controller (not shown) like PLC 132 may be programmed to provide a different sequence of movement for first panel rotating apparatus 2124 compared to the sequence of movement of first panel rotating apparatus 124 described above in system 100. Panel rotating sub-system 2134 may also include a second panel folding apparatus 2138 that is like panel folding apparatus 138, but arranged and oriented to move in a longitudinally opposite direction to panel folding apparatus 138, so it can fold panel E in a clockwise direction 90 degrees relative to panel A of blank 2000, as described further hereinafter. System 2100 may also include a third panel rotating apparatus (not shown) that may function like third panel rotating apparatus 131, to close the lower panels F, G, H and J, in a manner similar to that described above.

Case forming system 2100 may also include a mandrel apparatus 2120 similar to mandrel apparatus 120 with a mandrel 2137, and an adhesive applicator apparatus 2135 (only shown in FIG. 32 for simplicity) that may be substantially the same as adhesive applicator apparatus 135 and include adhesive applicators 2133*a-e* with nozzles that are mounted on transversely oriented support beam 2149. Mandrel apparatus 2120 may be interconnected to adhesive applicator apparatus 2135 and operable for vertical up and down movement together, like that described above in case forming system 100. Case forming system 2100 may also include a vertical support frame and a vertical mandrel movement apparatus also like those described above in relation to case forming system 100. The operation of the components of carton forming system 2100 may be controlled by a controller like PLC 132.

A generally vertically oriented support frame (not shown) that may be like support frame 140, may support a vertical mandrel movement apparatus (also not shown) like mandrel movement apparatus 136. Mandrel movement apparatus may include a generally vertically oriented linear rail (not shown) like linear rail 142 but which may support for sliding upward and downward sliding vertical movement a carriage block 2144 (FIG. 29) which may be like carriage block 144. The movement of carriage block 2144 on linear rail may vertically aligned with panel A of a case blank 2000 held in magazine 2110 and may be driven by a drive belt (not shown) interconnected to carriage block 144 and supported by vertical support frame, like with case forming system 100.

Figure 32:
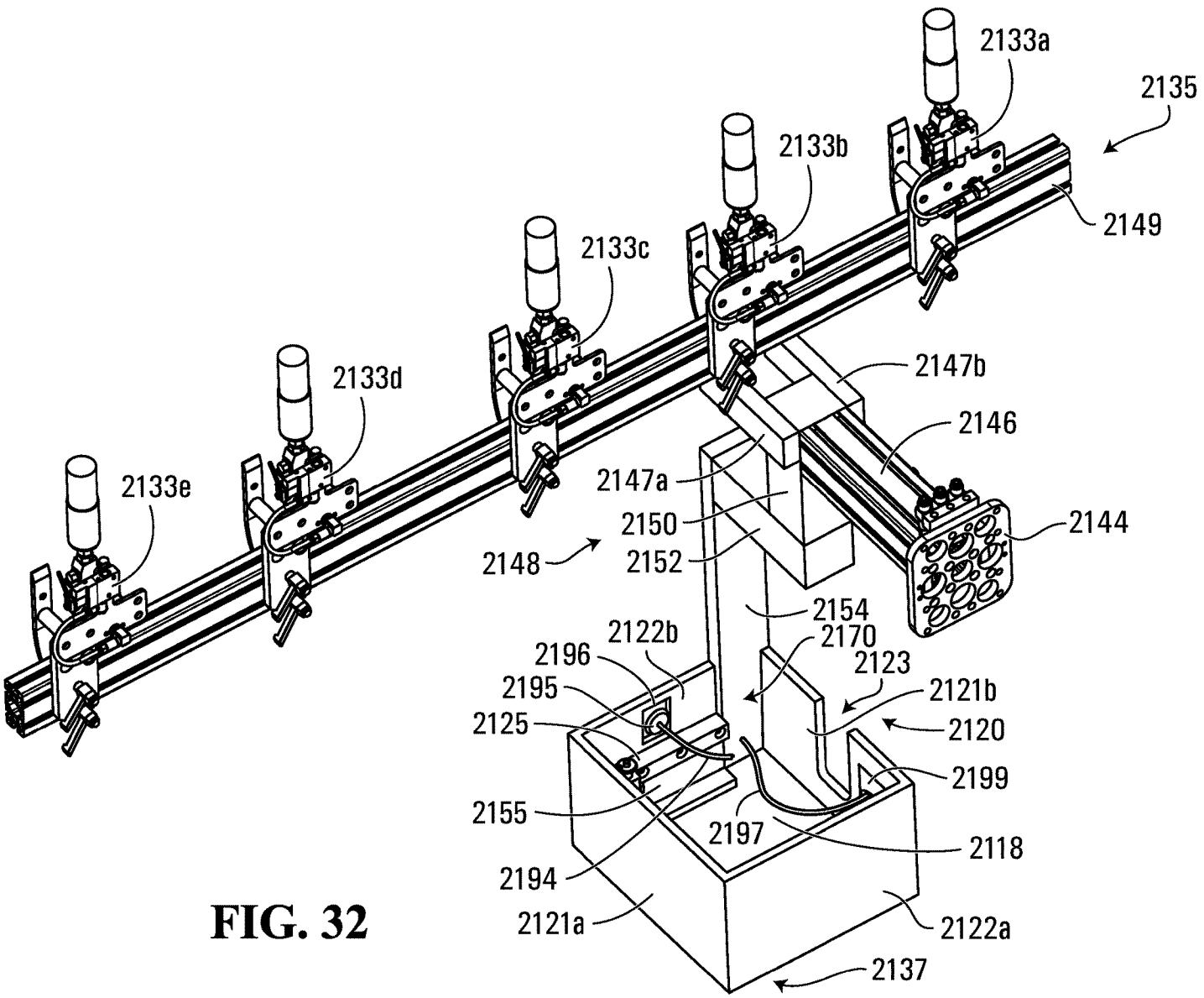
FIG. 32 is an upper, perspective view of some components of the case forming system of FIG. 28 shown in isolation.

With reference to FIG. 32, mandrel apparatus 2120 may have several components including a mandrel 2137 and a mandrel support apparatus generally designated 148. Mandrel 2137 may be easily removable from mandrel support apparatus 2148, so that a mandrel of one configuration may be easily replaced with a mandrel of another configuration. Mandrel 2137 may comprise a pair of opposed, spaced, vertically and transversely oriented, spaced, major side walls 2121*a*, 2121*b* interconnected with a pair of opposed, spaced, vertically and longitudinally oriented, spaced minor side walls 122*a*, 122*b*. A generally horizontally and transversely oriented bottom wall 2118 is interconnected to major and minor side walls 2121*a*, 2121*b*, 2122, 2122*b* to form a generally cuboid, open top, box shape. Mandrel 12 may be generally configured in a variety of different sizes and shapes, each selected for the particular type of case blank 2000 that are to be formed into cases.

The dimensions of the outer surfaces of mandrel 2137 may be selected so that the specific case blank 2000 that it is desired to fold has, during the forming process, fold lines that are located substantially at or along the four corner vertical side edges and the four corner horizontal bottom edges of mandrel 2137. Mandrel 2137, and surrounding components in system 2100, may be configured to permit for the easy interchange of mandrels 2137 so that case forming system 2100 can be readily adapted to forming differently sized/shaped cases from differently configured case blanks 2000.

Figure 31:
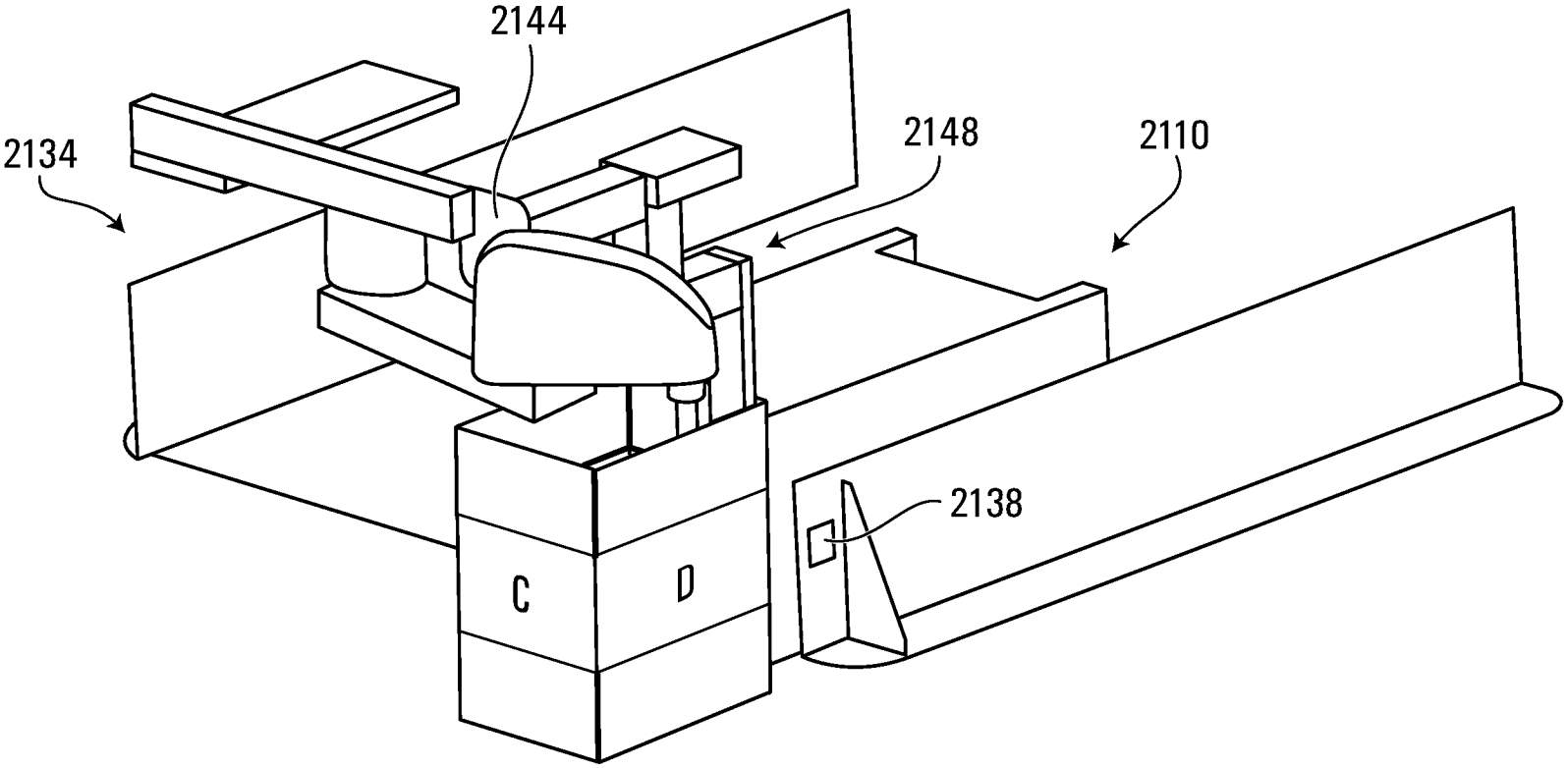
FIG. 31 is an upper, right front perspective view of the case forming system of FIG. 28, in a fourth operational position.

Mandrel side wall 2121*b* may be provided with a vertical slot 2123 that may be configured to permit part of end effector 2166 and suction cups 2168 to move from the position shown in FIG. 28, and pass through slot 2123 to the position shown in FIG. 31. By allowing the end effector 2166 to pass through vertical slot 2123, major side panel D of case blank 1000 may be held substantially flat against the outside surface of major side wall 2121*b* of mandrel 2137.

Mandrel side wall 2122*b* may not extend transversely the full length of bottom wall 2118 and may have a vertical end edge that defines a slot 2170. Mounted to an inward surface of rear side wall 2122*b* may be a releasable mandrel mounting bracket unit 2125. Mandrel mounting unit 2125 may be configured to releasably connect a transversely extending mandrel mounting plate 2155 to mandrel rear side wall 2122*b*, such as having mounting plate 2155 be received into a slot in mounting bracket unit 125, with the plate being releasably held in the slot by a screw of the mounting bracket unit being removably receivable in a threaded aperture of the mounting plate 2155.

Horizontally and vertically oriented mounting plate 2155 can be fixedly connected to an end of vertical mandrel support member 2154. A lower portion of mandrel support member 2154 may also serves to complete the rear side wall of mandrel 2137, when mandrel mounting plate 2155 is received into mounting bracket unit 2125.

Mounted in an opening 2199 in side wall 2121*b* may be one or more suction cups 2198. In some embodiments, to establish a firm connection between the outer surface mandrel wall 2122*b* and the adjacent surface of panel A of a blank 2000 held in magazine 2110, mounted in an opening 2196 in side wall 2122*b* may also be one or more suctions cups 2195 (FIG. 32). In other embodiments there may be only suction cups on side wall 2122*b* and in some embodiments suction cups may not be required on either wall 2121*b* or 2122*b* or on any other wall. Friction or other forces may be sufficient to hold the tubular shaped blank once formed on the mandrel, during subsequent folding of the lower panels.

Suction cups 2195 and 2198, if present, may be supplied with pressurized air controlled by valves (not shown) operated by the PLC. Air suction cups 2195 and 2198 may be interconnected through hoses 2194 and 2197 respectively passing through cavities (not shown) in vertical support member 2154, longitudinally oriented mandrel support member 2152, second vertical mandrel support member 2150 and longitudinally oriented and carriage support arm 2146 and carriage 2144 to a source of vacuum by providing for one or more air channels carrying pressurized air through the aforesaid components. The supply vacuum to suction cups 2195 and 2198 may be controlled by pressurized air distribution unit which may include a plurality of valves that may be operated by the PLC and may also include local vacuum generator apparatuses that may be in close proximity to, or integrate as part of, suction cups 2195 and 2198. With local vacuum generators utilized in close proximity to suction cups 2198, pressurized air may be delivered from an external source through air distribution unit to the vacuum generators. The local vacuum generators will then convert the pressurized air to vacuum that can then be delivered to suction cups 2195 and 2198.

An air suction force that may be developed at the outer surfaces of suction cups 2195 that is may be sufficient so that when activated they can engage with and hold panel A to mandrel side wall 2122*b*, as the rest of case blank 2000 is wrapped around mandrel 2137. The vacuum generated at suctions cups 2195 can be activated and de-activated by the PLC through operation of distribution unit.

The air suction force that may be developed at the outer surfaces of suction cups 2198 will be sufficient so that when activated they can engage and hold panel D and the rest of case blank 2000 wrapped around mandrel 2137 on the mandrel including during vertical downward movement to close the bottom panels. The vacuum generated at suctions cups 2198 can be activated and de-activated by PLC through operation of distribution unit.

Horizontally and vertically oriented mounting plate 2155 may be fixedly connected at an outer end to a lower end portion of vertical mandrel support member 2154. An opposite, upper end of vertical mandrel support member 2154 may be fixedly connected to a first end of a longitudinally oriented mandrel support member 2152. An opposite second end of longitudinally oriented mandrel support member 2152 may be fixedly connected to a first end of a second vertical mandrel support member 2150. A second opposite end of second vertical mandrel support member 2150 is fixedly attached to a first end of longitudinally oriented and extending carriage arm 2146. Proximate the connection location of mandrel support member 2150 and carriage arm 2146 may be mounted to opposite outer surfaces of vertical mandrel support member 2150, a pair of spaced and opposed, longitudinally oriented support blocks 2147*a*, 2147*b* which can be used to secure adhesive applicator apparatus 2135. Mandrel side wall 2122*b*, with its mounting plate 2125 can facilitate the support of mandrel 2137 on mandrel support frame 2148.

Vertical mandrel support member 2150 can be fixedly attached at is upper end portion to a first end portion of longitudinally oriented and extending carriage arm 2146. The opposite end portion of longitudinally oriented and extending carriage arm 146 is fixedly connected to carriage block 2144. Carriage block 2144 can be attached for sliding vertical upward and downward movement on a vertically oriented linear rail.

First vertical support member 2154, longitudinally oriented mandrel support member 2152, second vertical mandrel support member 2150 and longitudinally oriented and carriage support arm 2146 and carriage 2144 may be appropriately configured to permit electrical and communication cables and pressurized air/vacuum air hoses to pass through from an upper end to a lower end where operational components of mandrel apparatus 2120 are located. In this way, electrical power/communication cable and air hoses can deliver power, electrical signals and pressurized air/vacuum to the mandrel 2137 and second panel rotating apparatus 2130 which is mounted on mandrel 2137.

It will also be appreciated that in first panel rotation apparatus 2124 with suction cups 2198 and 2195, suction cups are used to apply a force to move and hold to mandrel 2137 panels of a case blank 2000.

Just like with mandrel 137 in system 100, the start position of mandrel 2137 in system 2100 will typically be a vertically downward position, where the adhesive ejection nozzles of the adhesive applicators are below the level of the bottom edge of case blank 2000 held in magazine 2110. Then, under control of PLC, the vertical movement apparatus can cause mandrel apparatus 2120 including mandrel 2137 to move vertically upwards. In doing so, ejection nozzles of adhesive applicators can be operated by PLC over a suitable range of upward movement, to apply adhesive to respective panels D, F and H. PLC 132 is able to activate adhesive applicators at a suitable vertical location because signals received from the encoder associated with the servo drive motor. Adhesive applicators will then apply adhesive lines 2001, 2002, 2003, 2004 and 2005 as shown in FIG. 26, to the outward facing surface of the front case blank 2000 in magazine 2110, while the front case blank is in the pick-up position.

Next, under control of the PLC, magazine 2110 and first panel rotating apparatus 2124 may co-operate so that suction cups (not shown) on end effector 2166, engage and hold the outward facing surface of major side wall panel D, and pull panels N/D/F; M/C/G and L/B/H from a clip mechanisms (not shown), while another clip mechanism (not shown) holding panels K/A/J in the pick-up positon in the magazine.

First panel rotating apparatus 2124 can then rotate all of major side wall panel D along with panels N/F; M/C/G; and L/B/H, 90 degrees in a counter clockwise direction about the vertical fold line between side wall panels B and A, to the configuration shown in FIG. 29, where major side wall panel B has an inward surface held against the outer surface of mandrel side 2121*a* (see also step 2000(3) in FIG. 27).

Figure 30:
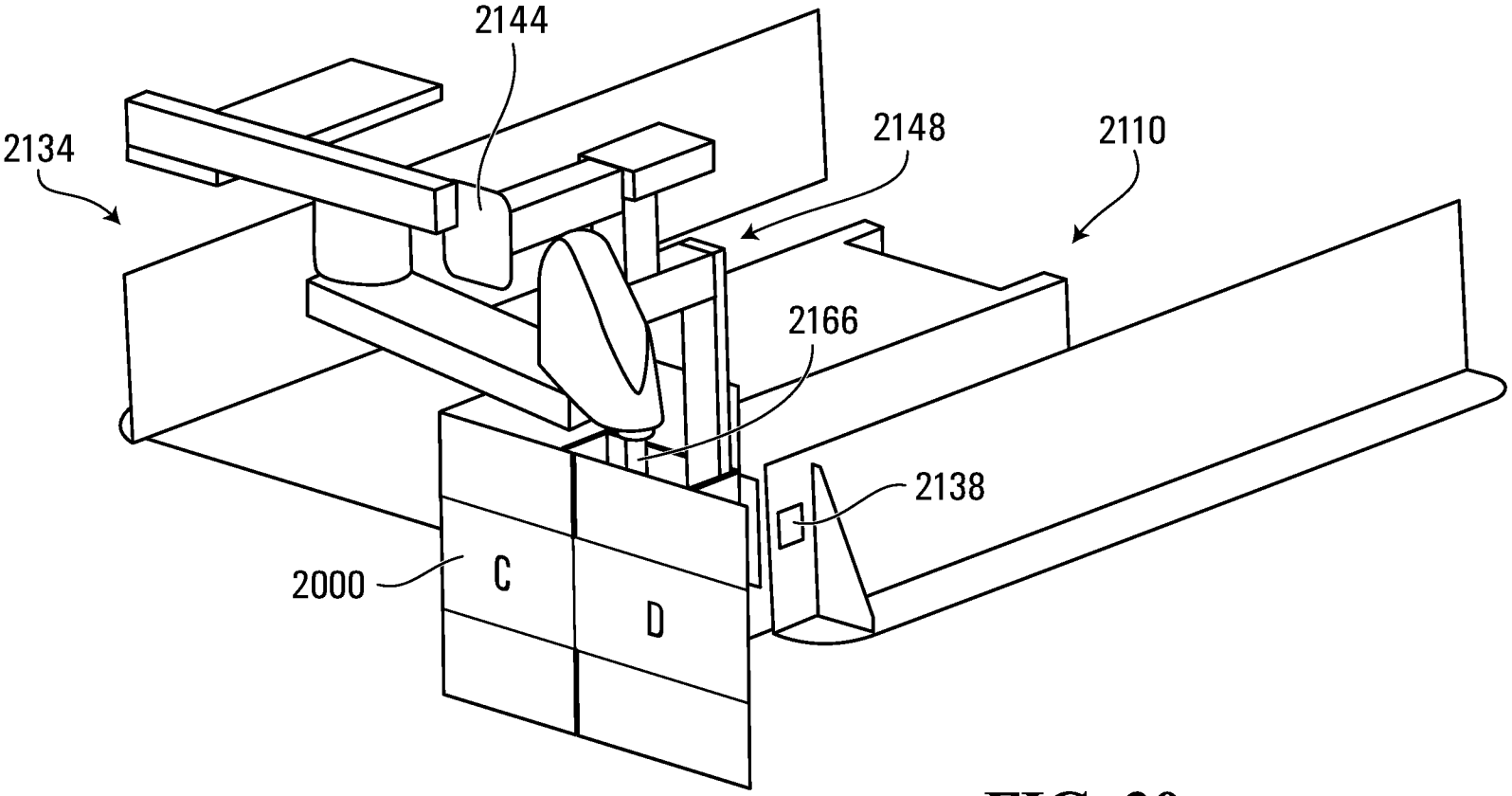
FIG. 30 is an upper, right front perspective view of the case forming system of FIG. 28, in a third operational position.

In the next folding step, PLC causes first panel rotating apparatus 2124 to rotate side wall panel D and its respective adjacent upper and lower major panels N and F, along with panels M/C/G, together, counter clockwise 90 degrees about the vertical fold line between side wall panels C and B, to the configuration shown in FIG. 30, where major side wall panel C has an inward surface held against the outer surface of mandrel side wall 2122*a*, (see also step 2000(4) in FIG. 27).

In the next folding step , PLC causes plough plate of panel rotating apparatus 2138 to extend longitudinally causing sealing panel E to be rotated clockwise 90 degrees about the vertical fold line between sealing panel E and side wall pane A to the configuration (see step 2000(5) in FIG. 27).

In the next folding step, the PLC can cause panel rotating apparatus 2124 to rotate side wall panel D and its respective adjacent upper and lower major panels N and F, counter clockwise 90 degrees about the vertical fold line between side wall panels D and C, to the configuration shown in FIG. 31, where major side wall panel D has an inward surface held against the outer surface of mandrel side wall 2121*b*, (see also step 2000(6) in FIG. 27). In moving to this position, part of end effector 2166 and suction cups 2168 can slide thorough slot 2123 to a position where suction cups are still able to engage with the inward directed surface of panel D of case blank 2000. Also, as panel D is approaching the position shown in FIG. 31, where a large portion of side wall panel D is held against the outer surface of mandrel side wall 2121*b*, PLC can cause the plough plate of panel rotating apparatus 2138 to retract allowing an outward facing surface of sealing panel E to engage with an edge portion of the inward facing surface of side wall panel D, and wherein the surface of sealing panel E becomes connected to side wall panel D as a result of adhesive line D005 bonding the two panels together.

The result at the end of this step is that blank 2000 is formed into a generally rectangular shaped tube, such that panels A-E have been wrapped about a centrally positioned mandrel 2137 as shown in FIG. 31 (see also step 2000(6) in FIG. 26) while being held by panel rotating apparatus 2134 on a surface that will become an interior surface of the tubular shaped blank.

The remaining steps to close and seal the bottom panels F, G, H and J can be carried out by case forming system 2100 in the same manner as case forming system 100 closes and seals the bottom panels of case blank 1000. In carton forming system 2100 the PLC will de-activate suction cups 2168 so that only suction cups 2198 hold case blank 2000 on mandrel 2137 allowing mandrel 2137 with tubular case blank 2000 secured thereto, to be move vertically downwards.

Many other variations of the embodiments described above are possible. By way of example, in some other embodiments, a first panel rotating apparatus like panel rotating apparatuses 124 or 2124 may be employed and configured to on its own engage a suitable case blank and wrap the case blank around a mandrel while holding the case blank on one or more surfaces that will form an interior surface of a tubular shaped case blank. Similarly, there are other embodiments where while a case blank is being held in a magazine with a surface exposed, adhesive is applied to the exposed surface of the blank prior to it being removed from the magazine for folding into a case that is suitable to be loaded.

By way only of another example, in some other embodiments, case blanks that are not used to form substantially cuboid shaped boxes, may be formed with a modified system. For example, the initial rotation of one portion of the blank from a generally flat configuration of the entire blank, may for example be only in the range of from forty-five degrees to ninety degrees onto a correspondingly shaped mandrel Once the first portion has been rotated from the flat configuration to the angled position, the blank is then more readily capable of being engaged by other mechanisms such that a further rotation of other portions of the blank can be carried out wrap the case around the mandrel to form a generally tubular shape. In some applications a mandrel might be employed which has outer surfaces that are not completely at rights angles to each other.

While it is contemplated that system 100 is oriented in a particular mutually orthogonal vertical, transverse and longitudinal frame of reference, systems could, with some other modifications, be provided in other spatial orientations. In such an inverted configuration, a blank could by way of example only, be retrieved from the stack and after being wrapped around a mandrel be moved vertically upwards to close the bottom panels.

Of course, the above described embodiments are intended to be illustrative only and in no way limiting. The described embodiments of carrying out the invention are susceptible to many modifications of form, arrangement of parts, details and order of operation. The invention, rather, is intended to encompass all such modification within its scope, as defined by the claims.

When introducing elements of the present invention or the embodiments thereof, the articles "a," "an," "the," and "said" are intended to mean that there are one or more of the elements. The terms "comprising," "including," and "having" are intended to be inclusive and mean that there may be additional elements other than the listed elements.

The invention claimed is:

1. A method for forming a container from a re-configurable blank, said method comprising:

(a) supporting a plurality of reconfigurable blanks in a first generally flat configuration in a magazine;

(b) positioning a first portion of an outward facing surface of a blank support device proximate a first portion of a forwardmost blank of said plurality of blanks in said magazine while said forwardmost blank is in said first configuration held in said magazine and while said blank is in a first orientation; wherein said blank support device comprises a mandrel;

(c) while said first portion of said forwardmost blank is in said first orientation held in said magazine, with a first rotating apparatus comprising at least one vacuum device, extracting a second portion of said forwardmost blank from said magazine and rotating said second portion of said forwardmost blank from said first orientation, to pull the second portion of the blank around a second portion of the outward facing surface of said blank support device to a second orientation while the blank support device remains stationary;

(d) while said first portion of said forwardmost blank is in said first orientation held in said magazine, with a second rotating apparatus comprising at least one vacuum device, extracting a third portion of said blank from said magazine and rotating said third portion of said blank from said first orientation, to pull the third portion of said blank in an opposite rotational direction to the rotation of the second portion of said blank, around a third portion of the outward facing surface of said blank support device to a third orientation while the blank support device remains stationary;

(e) positioning and fixedly connecting said second and third portions of said forwardmost blank together to form a second generally tubular configuration around said blank support device while the blank support device remains stationary, said generally tubular configuration having opposed first and second end openings;

wherein during at least part of said rotating of said second portion of said blank, said blank is engaged by said rotating apparatus on a first side surface of said blank which forms part of an inward facing surface of said blank when said blank is in said second generally tubular configuration; and wherein, during at least part of said rotating of said third portion of said blank, said blank is engaged by said second rotating apparatus on the first side surface of said blank which also forms part of said inward facing surface of said blank when said blank is in said second generally tubular configuration;

wherein said blank support device has a wall with a recess, said recess being configured to receive at least one vacuum cup of said at least one vacuum device of said first rotating apparatus therein; and wherein when said first rotating apparatus has rotated said second portion of said blank from said first orientation around the second portion of the surface of said blank support device to said second orientation, said second portion of said blank is held substantially against the second portion of the surface of the blank support device and said at least one vacuum cup of said at least one vacuum device of said first rotating apparatus is received within said recess.

2. A method as claimed in claim 1 wherein during said rotating of said second portion of said blank, said forwardmost blank is engaged by said first rotating apparatus on a surface side which forms an inward facing surface of said forwardmost blank when said forwardmost blank is in said second generally tubular configuration; and wherein during said rotating of said third portion of said forwardmost blank, said forwardmost blank is engaged by said second rotating apparatus on a surface side which forms an inner surface of said forwardmost blank when said forwardmost blank is in said second generally tubular configuration.

3. A method as claimed in claim 2 wherein said wall comprises a first wall portion and said recess is first recess, and wherein said blank support device comprises a second wall portion of said wall with a second recess, said second recess being configured to receive at least one vacuum cup of said second rotating apparatus therein; and wherein when said second rotating apparatus has rotated said third portion of said blank from said first orientation around the third portion of the surface of said blank support device to said third orientation, said third portion of the blank is held substantially against the third portion of the surface of the blank support device and the at least one vacuum cup of said second rotating apparatus is received within said second recess.

4. A method as claimed in claim 1 wherein said recess is an opening through said wall, and at least a part of said at least one vacuum device of said first rotating apparatus passes through said opening.

5. A method as claimed in claim 1, said method further comprises releasably holding said first portion of said forwardmost blank in said first orientation.

6. A method as claimed in claim 1 wherein said fixedly connecting said third and second portions of said forwardmost blank to secure said forwardmost blank in said second generally tubular configuration comprises:

applying adhesive to a surface of a sealing portion of said forwardmost blank; and interconnecting said surface of said sealing portion of said forwardmost blank with said adhesive thereon, with a surface of an overlapping portion of said blank to secure said forwardmost blank in said second generally tubular configuration.

7. A method as claimed in claim 1, wherein after (e), further comprising: (f) releasing said first portion of said forwardmost blank from said first orientation and moving said first and second portions of said forwardmost blank with said blank support device for folding other portions of said forwardmost blank.

8. A method as claimed in claim 7 further comprising after (e), then (g) moving said blank support device with said forwardmost blank in said second generally tubular configuration to a bottom portion folding station.

9. A method as claimed in claim 8 further comprising after (g), then (h) folding lower portions of said forwardmost blank in said second generally tubular configuration, to form said forwardmost blank into a third configuration comprising an open-top container with a closed bottom portion.

10. A method as claimed in claim 8, wherein (g), applying adhesive to said surface area of said forwardmost blank while said forwardmost blank is in said first configuration is performed before (b), said positioning of said first portion of said outward facing surface of said blank support device proximate said first portion of said blank while said blank is in said first generally flat configuration.

11. A method as claimed in claim 1 further comprising: (f) applying adhesive to at least one surface area of said blank while said forwardmost blank is in said first generally flat configuration.

12. A method as claimed in claim 11 wherein (f) comprises applying adhesive to a plurality of surface areas of said forwardmost blank while said forwardmost blank is in said first generally flat configuration.

13. A method as claimed in claim 12 wherein said each of said plurality of surface areas comprises a panel of a case, each of said panels being foldable relative to another portion of said forwardmost blank.

14. A method as claimed in claim 11 wherein said applying said adhesive occurs while said forwardmost blank is held in a magazine.

15. A method as claimed in claim 11, wherein (f), applying adhesive to said surface area of said forwardmost blank while said forwardmost blank is in said first configuration occurs before (b), said positioning of said first portion of said outward facing surface of said blank support device proximate said first portion of said forwardmost blank while said forwardmost blank is in said first configuration.

16. A method as claimed in claim 1 wherein said reconfigurable blank comprises a blank having a plurality of foldable panels.

17. A method as claimed in claim 16 wherein said blank support device comprises a plurality of outward facing side surface areas that are rectangular in shape and wherein said forwardmost blank has a plurality of side wall panels that are of a rectangular shape that are substantially the same size as the outward facing surface areas of the blank support device.

18. A method as claimed in claim 1 wherein said forwardmost blank is a case blank for forming a case.

19. A method for forming a container from a re-configurable blank having a first generally flat configuration having a first side surface and a second side surface on an opposite side of said blank to said first side surface, into a second generally tubular configuration, said method comprising:

(a) rotating a first portion of said blank around a first portion of an outward facing surface of a mandrel to bring the first side surface of the blank into contact with the first portion of the outward facing surface of said mandrel while the mandrel remains stationary;

(b) rotating a second portion of said blank from said first generally flat configuration in an opposite rotational direction to the rotation of the first portion of the blank, around a second portion of the outward facing surface of said mandrel to bring the first side surface of the blank into contact with the second portion of the outward facing surface of said mandrel while the mandrel remains stationary;

(c) fixedly connecting said first and second portions of said blank together to form said second generally tubular configuration around said mandrel while the mandrel remains stationary, said second generally tubular configuration having opposed first and second open ends;

wherein said rotating of said first portion of said blank and said second portion of said blank forms said second generally tubular configuration;

and wherein, during at least part of said rotating of said first portion of said blank, said blank is engaged by a first rotating apparatus on the first side surface of said blank which forms part of an inward facing surface of said blank when said blank is in said second generally tubular configuration, to pull the first portion of said blank around the mandrel; and wherein, during at least part of said rotating of said second portion of said blank, said blank is engaged by a second rotating apparatus on the first side surface of said blank which also forms part of said inward facing surface of said blank when said blank is in said second generally tubular configuration, to pull the second portion of said blank around said mandrel;

wherein:

said first rotating apparatus comprises a first vacuum device comprising at least one vacuum cup and said second rotating apparatus comprises a second vacuum device comprising at least one vacuum cup;

said mandrel has a wall with a first recess and a second recess, said first recess being configured to receive said at least one vacuum cup of said first vacuum device therein; and wherein when said first rotating apparatus rotates said first portion of said blank from said first generally flat configuration, said at least one vacuum cup of said first vacuum device is received in said first recess, and wherein said second recess is configured to receive said at least one vacuum cup of said second vacuum device therein; and wherein when said second rotating apparatus rotates said second portion of said blank from said first generally flat configuration, said at least one vacuum cup of said second vacuum device is received in said second recess.

20. A method as claimed in claim 1 wherein said at least said recess is a first recess, and wherein said bank support device comprises a second recess in said wall, said second recess being configured to receive at least one vacuum cup of at least one vacuum device of said second rotating apparatus therein; and wherein when said second rotating apparatus has rotated said third portion of said blank around the third portion of the surface of said blank support device, said third portion of said blank is held substantially against the third portion of the surface of the blank support device and said at least one vacuum cup of said at least one vacuum device of said second rotating apparatus is received within said second recess.

21. A method as claimed in claim 19 wherein said first recess is a first opening through said wall and at least a portion of said first rotating apparatus passes through said first opening, and wherein said second recess is a second opening through said wall, and at least a portion of said second rotating apparatus passes through said second opening.

22. A method for forming a container from a re-configurable blank having a first generally flat configuration into a second tubular configuration, said method comprising:

(a) moving a mandrel apparatus between a bottom forming station and a tubular blank forming station, said mandrel apparatus being interconnected thereto for synchronized reciprocating linear movement with the mandrel apparatus, an adhesive application apparatus;

(b) during the synchronized reciprocating linear movement of both the mandrel apparatus and the adhesive application apparatus between the bottom forming station and the tubular blank forming station, applying an adhesive to an outward facing surface of a blank while the mandrel apparatus and adhesive application apparatus are moving together and said blank is in said first generally flat configuration;

(c) engaging said blank on an inward facing surface in the first position;

(d) rotating said blank from said first configuration, around an outward facing surface of a mandrel into said second tubular configuration;

(e) fixedly connecting said blank with said adhesive into said second tubular configuration around said mandrel.

23. A method as claimed claim 22 wherein said rotating said blank from said first configuration, around an outward facing surface of a mandrel into said second tubular configuration comprises:

(i) rotating a first portion of said blank in a first rotational direction around a first portion of the outward facing surface of said mandrel;

(ii) rotating a second portion of said blank in an opposite rotational direction to the rotation of the first portion of the blank, around a second portion of the outward facing surface of said mandrel.

24. A method as claimed claim 23 wherein (a) during said rotating of said first portion of said blank, said blank is engaged by a first rotating apparatus on a surface side of said blank which forms part of an inward facing surface of said blank when said blank is in said second generally tubular configuration; and wherein during said rotating of said second portion of said blank, said blank is engaged by a second rotating apparatus on a surface side of said blank which also forms part of said inward facing surface of said blank when said blank is in said generally tubular configuration.

25. A method for forming a container from a generally flat foldable blank using a mandrel comprising an outward facing surface, said outward facing surface of said mandrel configured for forming a tubular shaped blank around said outward facing surface of said mandrel, wherein the blank comprises a first side surface and a second side surface on an opposite side of said blank to said first side surface, and wherein said blank further comprises first and second blank portions, said method comprising:

(a) releasably holding said generally flat foldable blank proximate the mandrel;

(b) engaging the first blank portion on the first side surface of the blank with a first rotating apparatus and rotating the first blank portion around a first portion of the outward facing surface of the mandrel to pull the first blank portion around said mandrel to bring the first side surface of the blank into contact with the first portion of the outward facing surface of said mandrel while the mandrel remains stationary;

(c) engaging the second blank portion on the first side surface of the blank with a second rotating apparatus and rotating the second blank portion around a second portion of the outward facing surface of the mandrel to pull the second blank portion around the mandrel to bring the first side surface of the blank into contact with a second portion of said outward facing surface of said mandrel while the mandrel remains stationary;

(d) positioning and fixedly connecting together the first blank portion and the second blank portion to form the tubular shaped blank around the outward facing surface of said mandrel, wherein an inward facing tubular surface of the tubular shaped blank is formed from the first side surface of the blank while the mandrel remains stationary, the tubular shaped blank having opposed first and second open ends;

(e) releasing the blank from being held;

wherein:

said first rotating apparatus comprises a first vacuum device comprising at least one vacuum cup and said second rotating apparatus comprises a second vacuum device comprising at least one vacuum cup;

said mandrel has a wall with a first recess and a second recess, said first recess being configured to receive said at least one vacuum cup of said first vacuum device therein; and wherein when said first rotating apparatus rotates said first portion of said blank from said first generally flat configuration, said at least one vacuum cup of said first vacuum device is received in said first recess, and wherein said second recess is configured to receive said at least one vacuum cup of said second vacuum device therein; and wherein when said second rotating apparatus rotates said second portion of said blank from said first generally flat configuration, said at least one vacuum cup of said second vacuum device is received in said second recess.

26. A method as claimed in claim 25 further comprising:

(f) after (e), closing a bottom opening of said opposed first and second end openings of said tubular shaped blank.

27. A method as claimed in claim 25 further comprising:

(f) moving said mandrel to a bottom closing station at which a bottom portion closing apparatus closes a bottom opening of said opposed first and second end openings of said tubular shaped blank when located at said bottom closing station.

28. A method as claimed in claim 27 wherein when said mandrel is moved to bottom closing station, adhesive is applied to a surface of a blank while said blank is being releasably held with said first and second portions oriented at a first orientation.

29. A method as claimed in claim 25 wherein said first recess is an opening through said wall, and at least a portion of said first rotating apparatus passes through said opening.

30. A method as claimed in claim 14 wherein said opening is a first opening and wherein said second recess is a second opening through said wall, and at least a portion of said second rotating apparatus passes through said second opening.

* * * * *